United States Patent [19]

Ishigaki et al.

[11] Patent Number: 4,956,263

[45] Date of Patent: Sep. 11, 1990

[54] SILVER HALIDE PHOTOGRAPHIC MATERIAL CONTAINING A COMPOUND CAPABLE OF RELEASING A DYE

[75] Inventors: Kunio Ishigaki; Kazunobu Katoh; Nobuaki Inoue; Hisashi Okada; Toshinao Ukai; Morio Yagihara; Yoshihiro Takagi; Masakazu Yoneyama, all of Kanagawa, Japan

[73] Assignee: Fuji Photo Film Co., Ltd., Kanagawa, Japan

[21] Appl. No.: 238,796

[22] Filed: Aug. 31, 1988

[30] Foreign Application Priority Data

| | | | |
|---|---|---|---|
| Sep. 1, 1987 | [JP] | Japan | 62-218648 |
| Sep. 4, 1987 | [JP] | Japan | 62-221283 |
| Sep. 4, 1987 | [JP] | Japan | 62-221285 |
| Dec. 18, 1987 | [JP] | Japan | 62-320701 |
| Jan. 18, 1988 | [JP] | Japan | 63-7856 |

[51] Int. Cl.[5] ..... G03C 1/10

[52] U.S. Cl. ..... 430/264; 430/223; 430/512; 430/517; 430/615; 430/955

[58] Field of Search ..... 430/264, 512, 615, 223, 430/517, 955, 223, 264, 512, 615

[56] References Cited

U.S. PATENT DOCUMENTS

| | | | |
|---|---|---|---|
| 4,332,878 | 6/1982 | Akimura et al. | 430/264 |
| 4,740,453 | 4/1988 | Nakamura et al. | 430/505 |
| 4,783,396 | 11/1988 | Nakamura et al. | 430/353 |

FOREIGN PATENT DOCUMENTS

| | | |
|---|---|---|
| 0217260 | 8/1978 | European Pat. Off. . |
| 0280252 | 10/1979 | European Pat. Off. . |
| 2376437 | 3/1979 | France . |
| 1600573 | 7/1981 | United Kingdom . |

OTHER PUBLICATIONS

Patent Abstracts of Japan, vol. 10, No. 206 (P-478)[2262], Jul. 18, 1986, abstracting JP-A-61 47 953 (Konishiroku Photo Ind. Co., Ltd.), 08-03-1986.

*Primary Examiner*—Paul R. Michl
*Assistant Examiner*—Janet C. Baxter
*Attorney, Agent, or Firm*—Sughrue, Mion, Zinn, Macpeak & Seas

[57] ABSTRACT

A silver halide photographic material capable of providing very high contrast image and having improved safelight safety is described, which comprises a support having thereon at least one silver halide emulsion layer, and containing in the silver halide emulsion layer or another hydrophilic colloid layer (i) a compound represented by formula (I)

$$\text{PWR}\text{-}(\text{Time})_t\text{LA} \qquad \text{(I)}$$

wherein PWR represents a group capable of releasing $$(\text{Time})_t\text{LA}$$

upon being reduced; Time represents a group capable of releasing LA after being released from PWR, t is 0 or 1; and LA represents a group having an absorption maximum in the wavelength region longer than 310 nm, (ii) a hydrazine derivative, and (iii) at least one compound represented by formulae (IX) and (X)

(IX)

(X)

wherein $R^{91}$, $R^{92}$, $R^{93}$, and $R^{94}$, which may be the same or different, each represents hydrogen, an alkyl group, an aryl group, an amino group, a hydroxyl group, an alkoxy group, an alkylthio group, a carbamoyl group, a halogen atom, a cyano group, a carboxyl group, an alkoxycarbonyl group or a heterocyclic group and $R^{91}$ and $R^{92}$ or $R^{92}$ and $R^{93}$ may be linked to form a 5- or 6-membered ring; provided that at least one of $R^{91}$ and $R^{93}$ represents a hydroxyl group.

18 Claims, No Drawings

SILVER HALIDE PHOTOGRAPHIC MATERIAL CONTAINING A COMPOUND CAPABLE OF RELEASING A DYE

FIELD OF THE INVENTION

This invention relates to silver halide photographic materials having uniformly, stably, and effectively incorporated in specific layers functional compounds that are cleaved in the presence of a reducing material to selectively provide a photographically useful effect for photographic light-sensitive material. More particularly, the invention relates to a black-and-white photographic light-sensitive material such as a super high contrast negative light-sensitive material (suitable for use under daylight; hereafter referred to as a "daylight type") excellent in image sharpness, tone reproducibility, and handled under safelight.

BACKGROUND OF THE INVENTION

In the field of graphic arts, an image-forming system providing super high contrast (in particular, 10 or more in gamma) is required for improving the reproduction of continuous tone images by dot images or the reproduction of line images.

For obtaining high contrast photographic characteristics using a stable developer, there are known methods using hydrazine derivatives as described in U.S. Pat. Nos. 4,224,401, 4,168,977, 4,166,742, 4,311,781, 4,272,606, 4,221,857, 4,269,929, 4,650,746, 4,243,739, and 4,618,574, JP-A-No. 62-150343 and JP-A-No. 62-90646, and Japanese Patent Application No. 62-43704. (The term "JP-A" as used herein means an "unexamined published Japanese patent application".)

According to these methods, photographic characteristics of super high contrast and high speed are obtained and further it is possible to add a sulfite at a high concentration to a developer, whereby the stability of the developer to air oxidation is greatly improved as compared to a lith developer.

However, although this imaging system is suitable for a high contrast system of very high speed, the system is unsuitable for daylight type low-speed photographic light-sensitive materials, which are widely used for contact work in printing plate making steps.

Methods of obtaining daylight type low-speed photographic light-sensitive materials containing hydrazines are described in JP-A-No. 60-14038, JP-A-No. 60-162246, and JP-A-No. 61-238049 and Japanese Patent Application No. 62-65116.

Silver halide photographic materials generally incorporate a light absorptive compound in silver halide emulsion layer(s) or other hydrophilic colloid layer(s) for absorbing light of specific wavelengths, for the purposes of controlling the speed of the photographic light-sensitive materials, improving the safelight safety, controlling the color temperature of light, and preventing the occurrence of halation and, in particular, for the purpose of controlling the balance of sensitivities in multilayer color photographic materials.

In particular, a silver halide photographic material which is used for a photographic printing plate making process or more specifically a daylight type photographic light-sensitive material contains a dye absorbing ultraviolet light or visible light in the light-sensitive emulsion layer or a layer disposed between a light source and a light-sensitive emulsion layer thereof.

Also, this dye is incorporated in a hydrophilic colloid layer disposed between a light-sensitive silver halide emulsion layer and the support of a photographic light-sensitive material for preventing the occurrence of halation.

The dyes which are used for these purposes must satisfy various factors: the dyes must be easily dissolved out from the bleached silver halide photographic materials during photographic processing to prevent the occurrence of substantial color stain; the dyes must not adversely affect silver halide photographic emulsions (by fogging or desensitization); the dyes must not diffuse into other layers from the layer colored by the dyes; the dyes must have good spectral absorption characteristics according to purpose; and further the dyes must be excellent in stability with the passage of time and must not change their properties in solutions or silver halide photographic materials.

Various efforts have been made to find dyes capable of meeting these factors. For example, there are proposed pyrazolone oxonol dyes described in British Patent No. 506,385; barbituric acid oxonol dyes described in U.S. Pat. No. 3,247,127; azo dyes described in U.S. Pat. No. 2,390,707; styryl dyes described in U.S. Pat. No. 2,255,077; hemioxanol dyes described in British Patent No. 584,609; merocyanine dyes described in U.S. Pat. No. 2,493,747; cyanine dyes described in U.S. Pat. No. 2,843,486; and methylene type benzilidene dyes described in U.S. Pat. No. 4,420,555. Also, Japanese Patent Application No. 61-249871 discloses a daylight type silver halide photographic material containing a dye having $\lambda_{max}$ shorter than 390 nm.

When the layer containing this dye functions as a filter layer or an antihalation layer, it is necessary that it only is selectively colored by the dye, and that other layers are not substantially colored by the dye.

However, there is a problem that even when the dye is incorporated in a layer other than the silver halide emulsion layer(s), the dye diffuses into the emulsion layer(s) to prevent the irradiation by exposure light of the emulsion layer(s), whereby the line width control of characters in contact work and the tone control of dot images is lost, i.e., practically, the capability of broadening the width of the character line of the original to some extent or broadening the dot area of the original to some extent. In contact work in a printing plate making process, the capability of correcting the images is required for adding an artistic expression to the images formed, in addition to the capability of reproducing the same line width or dot area as that of original.

For solving this problem, it is known to localize an acid dye having a sulfo group or a carboxyl group in a specific layer of a silver halide photographic material using a mordant.

As such a mordant, there are known ethylenically unsaturated polymers having a dialkylaminoalkyl ester residue described in British Patent No. 685,475; reaction products of a polyvinyl alkyl ketone and aminoguanidine described in British Patent No. 850,281; and vinylpyridine polymers and vinylpyridinium cation polymers described in U.S. Pat. Nos. 2,548,564, 2,484,430, 3,148,061 and 3,756,814. When cationic mordants having in the polymer a secondary amino group, a tertiary amino group, a nitrogen-containing heterocyclic group or a quaternary cation group are used, the acid dyes can be effectively mordanted.

However, these cationic mordants sometimes cause an electrostatic interaction with gelatin which is ordinarily used as a hydrophilic colloid for photographic light-sensitive materials and surface active agent having an alcoholate group, a carboxylate group, a sulfonate group or a sulfate group, which is usually used as a coating aid in the case of producing photographic light-sensitive materials, whereby the coating properties of photographic coating compositions are reduced.

Also, in the case of using such a mordant, it frequently occurs that the acid dye described above diffuses into other photographic layers and hence it is necessary to use a large amount of the mordant to prevent the diffusion of the acid dye. However, in such a case it is difficult to completely prevent the diffusion of the acid dye, and the thickness of the layer containing a large amount of the mordant is increased, to cause the problem that the dye remains in the photographic light-sensitive materials after processing.

Furthermore, for processing a light-sensitive material for making a printing plate, processing called "reduction" using a reducer is typically performed for controlling density and gradation, and the reducer contains a water-soluble iron complex as a reducing agent. However, if a cationic mordant is used in the photographic light-sensitive materials being processed by such a reducer, the mordant undergoes electrostatic bonding with the iron complex to form yellow stains by the iron complex.

For solving such a problem, dyes the diffusion of which into other layers is restrained and which are decolored during processing to give reduced color stain are disclosed in Japanese Patent Application No. 62-43704. However, although the dyes show excellent diffusion resistance and decoloring properties, it has been found that the use of the dyes reduces gamma and also reduces the quality of white lettering on solid background.

It is also common to increase the surface roughness of a silver halide photographic material by incorporating a matting agent in the protective layer of the photographic light-sensitive material for reducing its adhesive properties upon contact of the light-sensitive materials or contact of the light-sensitive material and the apparatus for processing it; for improving static prevention; and also close-contact with a vacuum on contact exposure. Spherical matting agents are generally used for improving the transparency of the photographic material after processing and efficiently increasing the surface roughness. However, it has been found that when such spherical matting agents are incorporated in a protective layer together with the non-diffusible dye, relatively small "black pepper" spots form in the edge portions of dot images or line images and in fine white lines having a line width of less than about 40 μm. This small "black pepper" phenomenon different from ordinary relatively large black pepper caused by infectious development in the unexposed portions of a high speed high contrast light-sensitive material. The existence of the relatively small black pepper in the edge portions and white lines results in reducing the smoothness of edges (hereinafter, referred to as "edge smoothness") in dot images or line images. Also, the small black pepper in fine white lines of characters causes fogging of the characters, which reduces the image quality.

As a method of preventing the formation of the relatively large black pepper occurring in unexposed portions, there are known a method of preparing a silver halide in the presence of an iridium salt and increasing the silver iodide content at the surfaces of the silver halide grains as described in JP-A-No. 61-29837; a method of adding a mercapto compound having a water solubilizing group as described in JP-A-No. 61-52640; and a method of adding an acid material to reduce the pH of the surface of the layer below 5.8.

These methods are effective for the prevention of the relatively large black pepper formed in unexposed portions, but do not prevent the relatively small black pepper formed in edge portions of dot images or line images or the fine white lines of characters. A method for preventing the occurrence of such small black pepper has been keenly desired.

SUMMARY OF THE INVENTION

An object of this invention is to provide a silver halide photographic material capable of providing very high contrast images having a gamma ($\gamma$) over 10.

Another object of this invention is to provide a daylight type photographic light-sensitive material, in which high contrast is provided by a hydrazine compound.

Yet another object of this invention is to provide a daylight type photographic light-sensitive material having improved safelight safety without reducing the image quality i.e., white lettering on a solid background and tone variability.

A still further object of this invention is to provide a silver halide color photographic material with reduced color stain after processing.

An additional object of this invention is to provide a silver halide photographic material with reduced variation of sensitivity even when the photographic material is stored for a long period of time.

Still another object of this invention is to provide a black-and white photographic light-sensitive material providing images with good edge smoothness and having improved safelight safety.

It has now been discovered that these and other objects of the present invention can be attained by a silver halide photographic material comprising a support having thereon at least one silver halide emulsion layer, and containing in the silver halide emulsion layer or another hydrophilic colloid layer (i) a compound represented by formula (I)

$$\mathrm{PWR}\text{-}(\text{-Time})_t\text{-LA} \qquad \text{(I)}$$

wherein PWR represents a group capable of releasing $$(\text{-Time})_t\text{-LA}$$

upon being reduced; Time represents a group capable of releasing LA after being released from PWR, t is 0 or 1; and LA represents a group having an absorption maximum in the wavelength region longer than 310 nm, (ii) a hydrazine derivative, and (iii) at least one compound represented by formulae (IX) and (X)

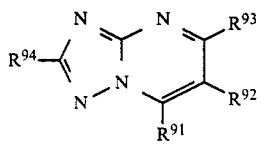

(IX)

-continued

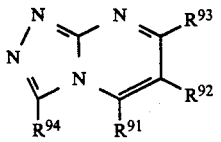

(X)

wherein $R^{91}$, $R^{92}$, $R^{93}$, and $R^{94}$, which may be the same or different, each represents hydrogen, an alkyl group, an aryl group, an amino group, a hydroxyl group, an alkoxy group, an alkylthio group, a carbamoyl group, a halogen atom, a cyano group, a carboxyl group, an alkoxycarbonyl group or a heterocyclic group and $R^{91}$ and $R^{92}$ or $R^{92}$ and $R^{93}$ may be linked to form a 5 or 6-membered ring; provided that at least one of $R^{91}$ and $R^{93}$ represents a hydroxyl group.

DETAILED DESCRIPTION OF THE INVENTION

The compound for use in this invention is now explained in greater detail.

In formula (I) described above, PWR may be a group containing an electron acceptive center and an intramolecular nucleophilic reaction center in a compound releasing a photographic reagent by a nucleophilic reaction in the molecule after being reduced as disclosed in U.S. Pat. Nos. 4,139,389 and 4,139,379 and JP-A-No. 59-185333; or may be a group containing an electron acceptive quinoid center in the compound releasing a photographic reagent by an intramolecular electron transfer reaction after being reduced and a carbon atom bonding the quinoid center and the photographic reagent as disclosed in U.S. Pat. No. 4,232,107 and JP-A-No. 59-101649 and JP-A-No. 61-88257. Also, PWR in formula (I) may be a group containing an aryl group substituted by an electron attractive group in a compound releasing a photographic reagent by cleaving the single bond after being reduced and an atom (sulfur atom, carbon atom, or nitrogen atom) bonding the aryl group and the photographic reagent as disclosed in JP-A-No. 56-142530 and U.S. Pat. Nos. 4,343,893 and 4,619,884.

Furthermore, PWR in formula (I) may be a group containing a nitro group in a nitro compound releasing a photographic reagent after receiving an electron, and a carbon atom bonding the nitro group and the photographic reagent as disclosed in U.S. Pat. No. 4,450,223; or may be a group containing a dieminaldinitro moiety in a dinitro compound $\beta$-releasing a photographic reagent after receiving an electron, and a carbon atom bonding the dieminaldinitro moiety and the photographic reagent as disclosed in U.S. Pat. No. 4,609,610.

The compound represented by formula (II) is preferred among of formula (I) described above:

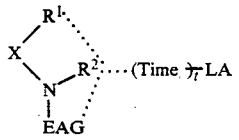

(II)

-continued

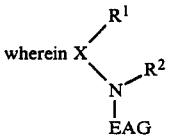

corresponds to PWR in formula (1) and (Time)$_{\pi}$LA is bonded to at least one of $R^1$, $R^2$ and EAG.

In formula (II), X represents —O—, —S—, or a group —N($R^3$)—; and $R^1$, $R^2$, and $R^3$ which may be the same or different, each represents a group (substituent) other than hydrogen.

Examples of the group represented by $R^1$ and $R^3$ are an alkyl group (e.g., a substituted or unsubstituted alkyl group, such as methyl, trifluoromethyl, benzyl, chloromethyl, dimethylaminomethyl, ethoxycarbonylmethyl, aminomethyl, acetylaminomethyl, ethyl, 2-(4-dodecanoylaminophenyl)ethyl, carboxyethyl, allyl, 3,3,3-trichloropropyl, n-propyl, iso-propyl, n-butyl, iso-butyl, sec-butyl, t-butyl, n-pentyl, sec-pentyl, t-pentyl, cyclopentyl, n-hexyl, sec-hexyl, t-hexyl, cyclohexyl, n-octyl, sec-octyl, t-octyl, n-decyl, n-undecyl, n-dodecyl, n-tetradecyl, n pentadecyl, n-hexadecyl, sec-hexadecyl, t-hexadecyl, n-octadecyl, t-octadecyl); an aryl group (e.g., a substituted or unsubstituted aryl group such as phenyl, naphthyl, 3-hydroxyphenyl, 3-chlorophenyl, 4-acetylaminophenyl, 4-hexadecanesulfonylaminophenyl, 2-methanesulfonyl-4-nitrophenyl, 3-nitrophenyl, 4-methoxyphenyl, 4-acetylaminophenyl, 4-methanesulfonylphenyl, 2,4-dimethylphenyl, 4-tetradecyloxyphenyl); a heterocyclic group (e.g., a substituted or unsubstituted heterocyclic group such as a 1-imidazolyl, 2-furyl, 2-pyridyl, 5-nitro-2-pyridyl, 3-pyridyl, 3,5-dicyano-2-pyridyl, 5-tetrazolyl, 5-phenyl-1-tetrazolyl, 2-benzothiazolyl, 2-benzimidazolyl, 2-benzoxazolyl, 2-oxazolin-2-yl, morpholino); an acyl group (e.g., a substituted or unsubstituted acyl group such as acetyl, propionyl, butyroyl, iso-butyroyl, 2,2-dimethylpropionyl, benzoyl, 3,4-dichlorobenzoyl, 3-acetylamino-4-methoxybenzoyl, 4-methylbenzoyl, 4-methoxy-3-sulfobenzoyl); and a sulfonyl group (e.g., a substituted or unsubstituted sulfonyl group such as methanesulfonyl, ethanesulfonyl, chloromethanesulfonyl, propanesulfonyl, butanesulfonyl, n-octanesulfonyl, n-dodecanesulfonyl, n-hexadecanesulfonyl, benzenesulfonyl, 4-toluenesulfonyl, 4-n-dodecyloxybenzenesulfonyl).

The total number of carbon atoms in the group represented by $R^1$ and $R^3$ is preferably from 1 to 40. $R^2$ is preferably a substituted or unsubstituted acyl group or a substituted or unsubstituted sulfonyl group as illustrated above. The carbon atom number of $R^2$ is also preferably from 1 to 40. Also, $R^1$, $R^2$, $R^3$ and EAG may combine with each other to form a ring. EAG is explained in more detail below.

The compounds represented by formula (II) described above is preferably represented by Formula (III):

(III)

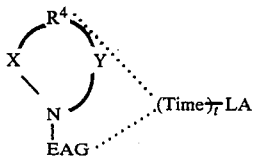

wherein

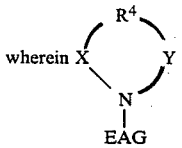

corresponds to PWR in formula (I) and $(Time)_{\overline{r}}LA$ is bonded to at least one of $R^4$ and EAG.

In the above formula, Y is a divalent linking group such as, preferably —(C=O)— or —$SO_2$—. X is the same as in formula (II) and is preferably an oxygen atom.

$R^4$ in formula (III) represents an atomic group necessary for forming a 5- to 8-membered monocyclic or condensed heterocyclic ring in combination with X, Y and N. Preferred examples of the heterocyclic groups are illustrated below, but the present invention is not to be construed a being limited thereto.

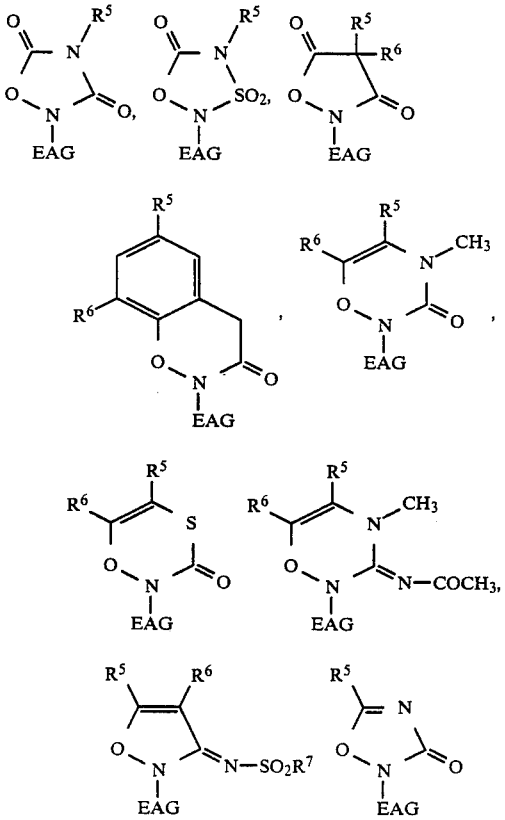

-continued

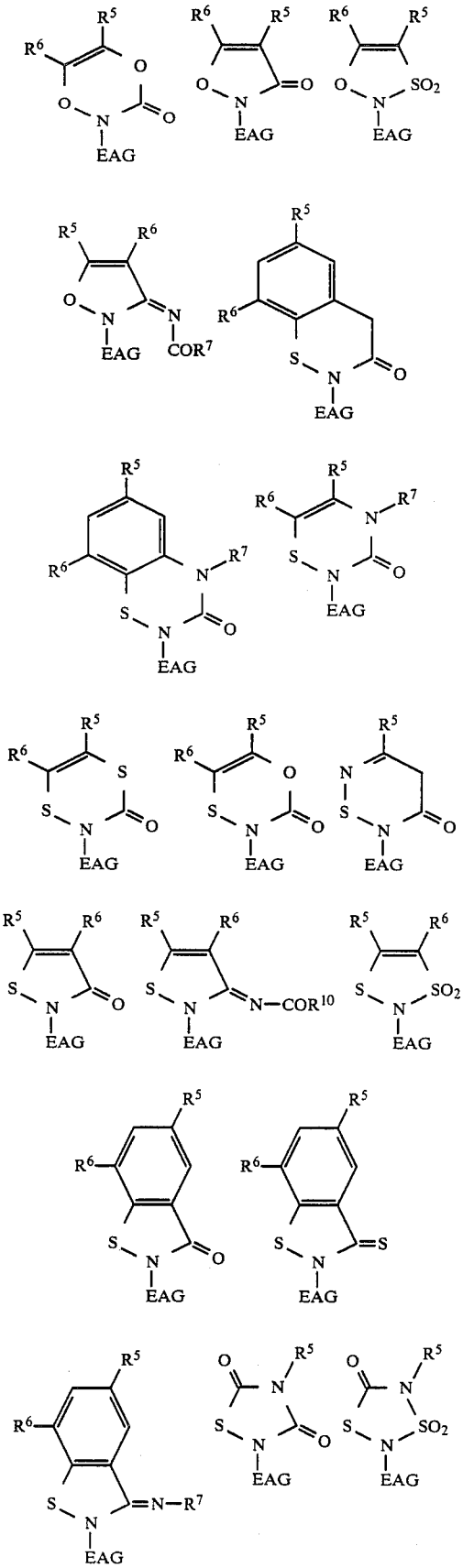

-continued

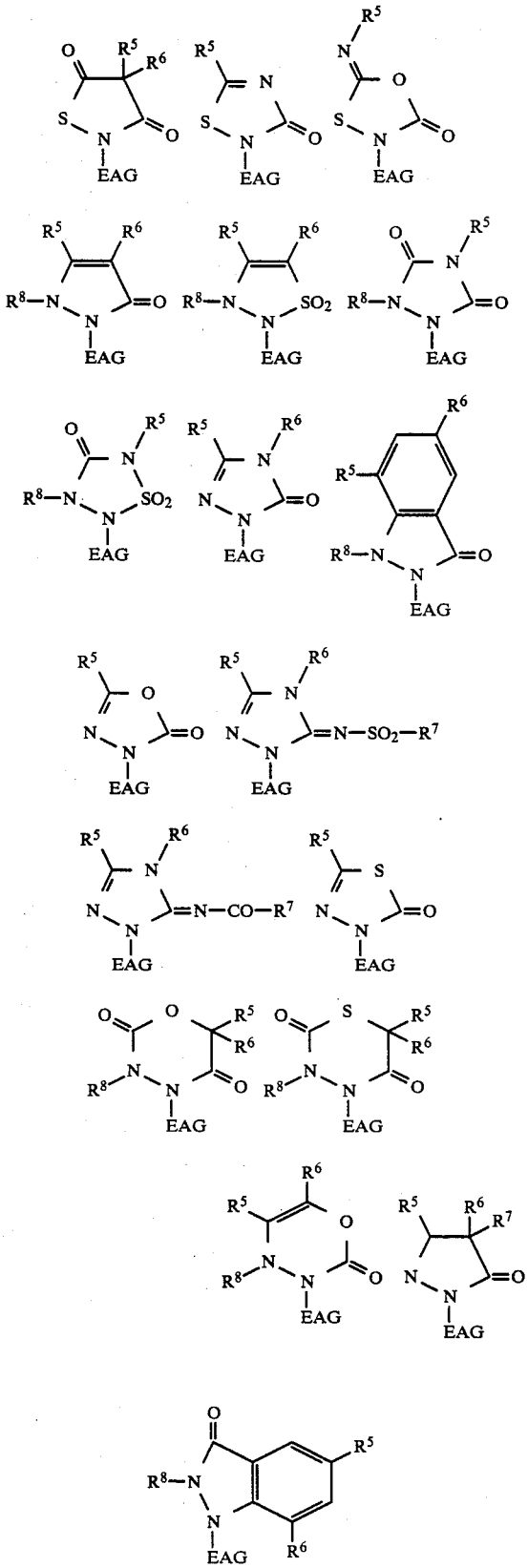

In the above formulae, $R^5$, $R^6$, and $R^7$, which may be the same or different, each represents hydrogen, an alkyl group, an aryl group or a heterocyclic group and $R^8$ is preferably an acyl group or a sulfonyl group.

Particularly preferred examples of the heterocyclic group are illustrated below showing the bonding position of $$(\text{Time})_t\text{LA},$$

but this invention is not to be construed as being limited thereto.

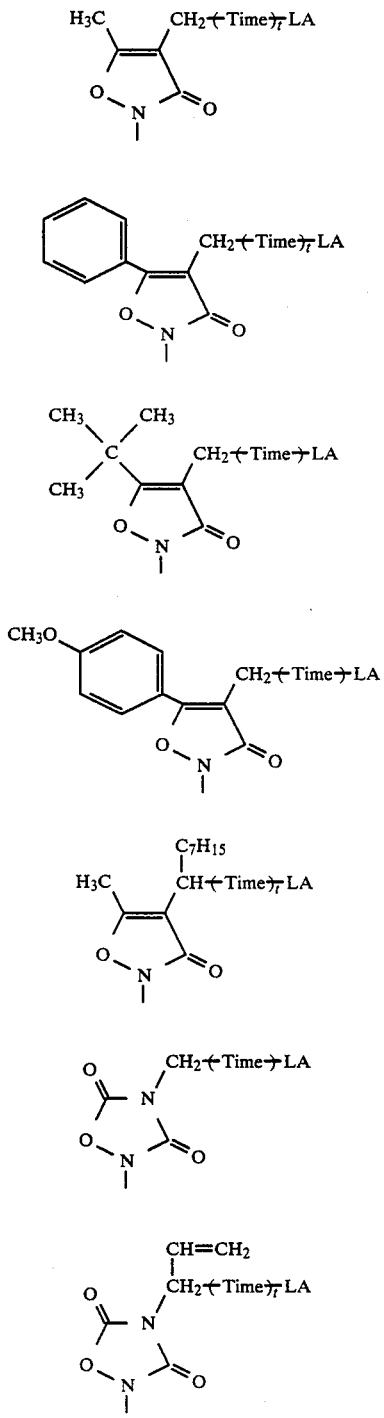

-continued
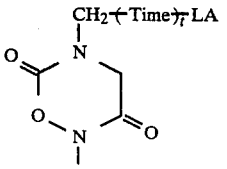
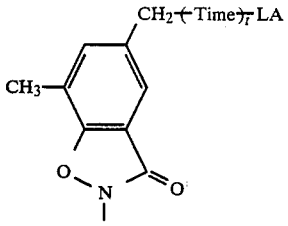
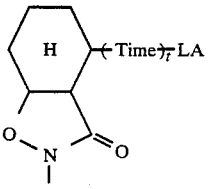
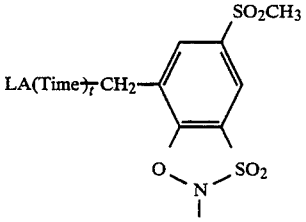
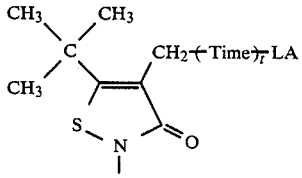
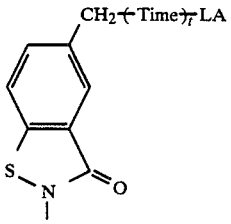
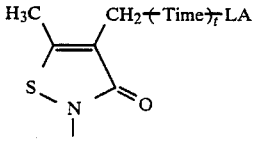
-continued
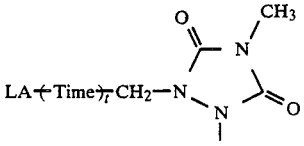
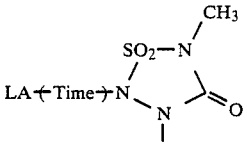
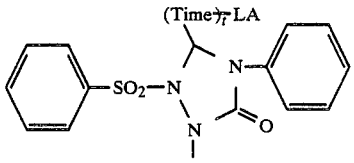
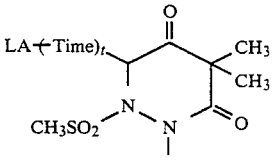
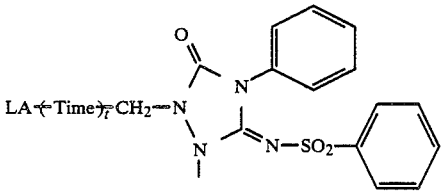
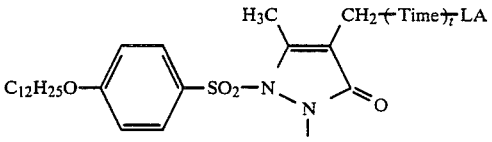
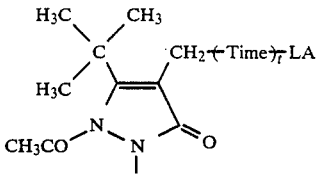
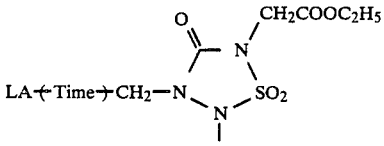
EAG in formula (II) or (III) described above is a group capable of receiving electron from a reducing material and is bonded to the nitrogen atom of the formula.
The group represented by EAG is preferably an aromatic group represented by formula (A) or a group represented by formula (B):

(A)

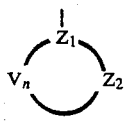

(B)

Un'

In formula (A), $Z_1$ represents

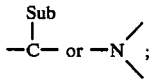

and Vn represents an atomic group necessary for forming a 3- to 8-membered ring with $Z_1$ and $Z_2$ and n represents an integer of from 3 to 8. Vn (n=3 to 8) has the following meanings:

$V_3$: $—Z_3—$, $V_4$: $—Z_3—Z_4—$, $V_5$: $—Z_3—Z_4—Z_5—$, $V_6$: $—Z_3—Z_4—Z_5—Z_6—$, $V_7$: $—Z_3—Z_4—Z_5—Z_6—Z_7—$, and $V_8$: $—Z_3—Z_4—Z_5—Z_6—Z_7—Z_8—$.

$Z_2$ to $Z_8$ each represents

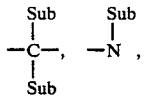

—O—, —S— and $—SO_2—$. Sub represents a simple bond ($\pi$ bond), hydrogen or a substituent described below. Plural Sub groups may be the same or different and may be linked to form a 3- to 8-membered saturated or unsaturated carbon ring or heterocyclic ring. In formula (A) described above, the Sub groups are selected such that the total of the Hammett's substituent constants op of the Sub groups is at least +0.09, preferably at least +0.3, and more preferably at least +0.45.

The substituent represented by Sub preferably has a carbon atom number of from 0 to 40 and specific examples of the substituent are a substituted or unsubstituted alkyl group (e.g., methyl, ethyl, sec-butyl, t-octyl, benzyl, cyclohexyl, chloromethyl, dimethylaminomethyl, n-hexadecyl, trifluoromethyl, 3,3,3-trichloropropyl, and methoxycarbonylmethyl), a substituted or unsubstituted alkenyl group (e.g., vinyl, 2-chlorovinyl, and 1-methylvinyl), a substituted or unsubstituted alkynyl group (e.g., ethynyl and 1-propynyl), a cyano group, a nitro group, a halogen atom (e.g., fluorine, chlorine, bromine, and iodine), a substituted or unsubstituted heterocyclic group (e.g., 2-pyridyl, 1-imidazolyl, benzothiazol-2-yl, morpholino, and benzoxazol-2-yl), a sulfo group, a carboxyl group, a substituted or unsubstituted aryloxycarbonyl or alkoxycarbonyl group (e.g., methoxycarbonyl, ethoxycarbonyl, tetradecyloxycarbonyl, 2-methoxyethylcarbonyl, phenoxycarbonyl, 4-cyanophenylcarbonyl, and 2-chlorophenoxycarbonyl), a substituted or unsubstituted carbamoyl group (e.g., carbamoyl, methylcarbamoyl, diethyl carbamoyl, methylhexadecylcarbamoyl, methyloctadecylcarbamoyl, phenylcarbamoyl, 2,4,6-trichlorophenylcarbamoyl, N-ethyl-N-phenylcarbamoyl, and 3-hexadecylsulfamoylphenylcarbamoyl), a hydroxyl group, a substituted or unsubstituted azo group (e.g., phenylazo, p-methoxyphenylazo, and 2-cyano-4-methanesulfonylphenylazo), a substituted or unsubstituted aryloxy or alkoxy group (e.g., methoxy, ethoxy, dodecyloxy, benzyloxy, phenoxy, 4-methoxyphenoxy, 3-acetylaminophenoxy, 3-methoxycarbonylpropyloxy, and 2-trimethylammonioethoxy), a sulfino group, a sulfeno group, a mercapto group, a substituted or unsubstituted acyl group (e.g., acetyl, trifluoroacetyl, n-butyroyl, t-butyroyl, benzoyl, 2-carboxybenzoyl, 3-nitrobenzoyl and formyl), a substituted or unsubstituted arylthio or alkylthio group (e.g., methylthio, ethylthio, t-octylthio, hexadecylthio, phenylthio, 2,4,5-trichlorothio, 2-methoxy- 5-t-octylphenylthio, and 2-acetylaminophenyl), a substituted or unsubstituted aryl group (e.g., phenyl, naphthyl, 3-sulfophenyl, 4-methoxyphenyl, and 3-lauroylaminophenyl), a substituted or unsubstituted or unsubstituted sulfonyl group (e.g., methylsulfonyl, chloromethylsulfonyl, n-octylsulfonyl, n-hexadecylsulfonyl, sec-octylsulfonyl, p-toluenesulfonyl, 4-chlorophenylsulfonyl, 4-dodecylphenylsulfonyl, 4-dodecyloxyphenylsulfonyl, and 4-nitrophenylsulfonyl), a substituted or unsubstituted sulfinyl group (e.g., methylsulfinyl, dodecylsulfinyl, phenylsulfinyl, and 4-nitrophenylsulfinyl), a substituted or unsubstituted amino group (e.g., methylamino, diethylamino, methyloctadecylamino, phenylamino, ethylphenylamino, 3-tetradecylsulfamoylphenylamino, acetylamino, trifluoroacetylamino, N-hexadecylacetylamino, N-methylbenzoylamino, methoxycarbonylamino, phenoxycarbonylmethylamino, N-methoxyacetylamino, amidinoamino, phenylaminocarbonylamino, 4-cyanophenylaminocarbonylamino, N-ethylethoxycarbonylamino, N-methyldodecylsulfonylamino, N-(2-cyanoethyl)-p-toluenesulfonylamino, hexanedecylsulfonylamino, and trimethylammino), a substituted or unsubstituted sulfamoyl group (e.g., dimethylsulfamoyl, hexadecylsulfamoyl, sulfamoyl, methyloctadecylsulfamoyl methylhexadecylsulfamoyl, 2-cyanoethylhexadecylsulfamoyl, phenylsulfamoyl, N-(3,4-dimethylphenyl)-N-octylsulfamoyl, dibutylsulfamoyl, dioctadecylsulfamoyl, and bis(2-methoxycarbonylethyl)sulfamoyl), a substituted or unsubstituted acyloxy group (e.g., actoxy, benzoyloxy, substituted acyloxy group (e.g., acetoxy, benzoyloxy, decyloyloxy, and chloroacetoxy), and a substituted or unsubstituted sulfonyloxy group (e.g., methylsulfonyloxy, p-toluenesulfonyloxy, and p-chlorophenylsulfonyloxy).

In form (B) described above, n' is an integer of from 1 to 6 and Un' (n'=1 to 6) has the following meaning:

$U_1$: $Y_1$, $U_2$: $—Y_1—Y_2$, $U_3$: $—Y_1—Y_2—Y_3$, $U_4$: $—Y_1—Y_2—Y_3—Y_4$, $U_5$: $—Y_1—Y_2—Y_3—Y_4—Y_5$, and $U_6$: $—Y_1—Y_2—Y_3—Y_4—Y_5—Y_6$. $Y_1$ to $Y_6$ each represents

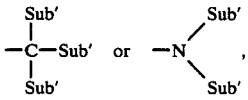

wherein Sub' represents a simple bond ($\sigma$ bond or $\pi$ bond) or a substituent defined above for Sub in formula (A), and plural Sub groups may be the same or different. In formula (B), the Sub' groups are selected such that the total of the Hammett's substituent constants $\sigma p$ of the Sub' groups is at least +0.09, preferably at +0.3, and more preferably at least +0.45. Specific examples of the substituent represented by Sub' are those illustrated above for Sub in formula (A).

EAG in formula (II) or (III) described above is now explained in more detail.

EAG represents a group capable of receiving an electron from a reducing material and is bonded to the nitrogen atom of the formula. EAG is preferably an aryl group or a heterocyclic group each group being substituted by at least one electron-attractive group.

The substituent bonded to the aryl group or heterocyclic group represented by EAG can be utilized for controlling the properties of the compound of formula (II) or (III). For example, the substituent for EAG can be utilized for controlling the electronegativity of the compound for electron as well as controlling other properties of the compound, such as water-solubility, oil solubility, diffusibility, volatility, melting point, dispersibility in a binder such as gelatin, reactivity for a nucleophilic group, and reactivity for an electrophilic group.

Specific examples of EAG are illustrated below.

Examples of the aryl group substituted by at least one electron attractive group are 4-nitrophenyl, 2-nitrophenyl, 2-nitro-4-N-methyl-N-n-butylsulfamoylphenyl, 2-nitro-4-N-methyl-N-n-octylsulfamoylphenyl, 2-nitro-4-N-methyl-N-n-dodecylsulfamoylphenyl, 2-nitro-4-N-methyl-N-n-hexadecylsulfamoylphenyl, 2-nitro-4-N-methyl-N-n-octadecylsulfamoylphenyl, 2-nitro-4-N-methyl-N-(3-carboxypropyl)sulfamoylphenyl, 2-nitro-4-N-ethyl-N-(2-sulfoethyl)sulfamoylphenyl, 2-nitro-4-N-n-hexadecyl-N(3-sulfopropyl)sulfamoylphenyl, 2-nitro-4-N-(2-cyanoethyl)-N-[(2-hydroxyethoxy)ethyl]-sulfamoylphenyl, 2-nitro-4-diethylsulfamoylphenyl, 2-nitro-4-di-n-butylsulfamoylphenyl, 2-nitro-4-di-n-octylsulfamoylphenyl, 2-nitro-4-di-n-octadecylsulfamoylphenyl, 2-nitro-4-methylsulfamoylphenyl, 2-nitro-4-n hexadecylsulfamoylphenyl, 2-nitro-4-N-methyl-N-(4-dodecylsulfonylphenyl)sulfamoylphenyl, 2-nitro-4-(3-methylsulfamoylphenyl)sulfamoylphenyl, 4-nitro-2-N-methyl-N-n-butylsulfamoylphenyl, 4-nitro-2-N-methyl-N-n-octylsulfamoylphenyl, 4-nitro-2-N-methyl-N-n-dodecylsulfamoylphenyl, 4-nitro 2-N-methyl-N-octadecylsulfamoylphenyl, 4-nitro-2-N-methyl-N-(3-boxypropyl)sulfamoylphenyl, 4-nitro-2-N-ethyl-N-(2-sulfoethyl)sulfamoylphenyl, 4-nitro-2-N-n-hexadecyl-N(3-sulfopropyl)sulfamoylphenyl, 4-nitro-2-N-(2-cyanoethyl)-N-[(2-hydroxyethoxy)ethyl]sulfamoylphenyl, 4-nitro-2-di-ethylsulfamoylphenyl, 4-nitro-2-di-n-butylsulfamoylphenyl, 4-nitro-2-di-n-octylsulfamoylphenyl, 4-nitro-2-di-n-octadecylsulfamoylphenyl, 4-nitro-2-methylsulfamoylphenyl, 4-nitro-2-n-hexadecylsulfamoylphenyl, 4-nitro-2-N-methyl-N-(4-dodecylsulfonylphenyl)sulfamoylphenyl, 4-nitro-2-(3-methylsulfamoylphenyl)sulfamoylphenyl, 4-nitro-2-chlorophenyl, 2-nitro-4-chlorophenyl, 2-nitro-4-N-methyl-N-n-butylcarbamoylphenyl, 2-nitro-4-N-methyl-N-n-octylcarbamoylphenyl, 2-nitro-4-N-methyl-N-n-dodecylcarbamoylphenyl, 2-nitro-4-N-methyl-N-n-hexadecylcarbamoylphenyl, 2-nitro-4-N-methyl-N-n-octadecylcarbamoylphenyl, 2-nitro-4-N-methyl-N-(3-carboxypropyl)carbamoylphenyl, 2-nitro-4-N-ethyl-N-(2-sulfoethyl)carbamoylphenyl, 2-nitro-4-N-n-hexadecyl-N-(3-sulfopropyl)carbamoylphenyl, 2-nitro-4-N-(2-cyanoethyl)-N-[(2-hydroxyethoxy)ethyl]carbamoylphenyl, 2-nitro-4-diethylcarbamoylphenyl, 2-nitro-4-di-n-butylcarbamoylphenyl, 2-nitro-4-di-n-octylcarbamoylphenyl, 2-nitro-4-di-n-octadecylcarbamoylphenyl, 2-nitro-4-methylcarbamoylphenyl, 2-nitro-4-n-hexadecylcarbamoylphenyl, 2-nitro-4-N-methyl-N-(4-dodecylsulfonylphenyl)carbamoylphenyl, 2-nitro-4-(3-methylsulfamoylphenyl)carbamoylphenyl, 4-nitro-2-N-methyl-N-n-butylcarbamoylphenyl, 4-nitro-2-N-dodecylcarbamoylphenyl, 4-nitro-2-N-methyl-N-n-hexadecylcarbamoylphenyl, 4-nitro-2-N-methyl-N-n-octadecylcarbamoylphenyl, 4-nitro-2-N-methyl-N-(3-carboxypropyl)carbamoylphenyl, 4-nitro-2-N-ethyl-N-(2-sulfoethyl)carbamoylphenyl, 4-nitro-2-N-n-hexadecyl-N-(3-sulfopropyl)carbamoylphenyl, 4-nitro-2-N-(2-cyanoethyl)-N-[( [(2-hydroxyethoxy)ethyl]carbamoylphenyl, 4-nitro-2-diethylcarbamoylphenyl, 4-nitro-2-di-n-butylcarbamoylphenyl, 4-nitro-2-di-n-octylcarbamoylphenyl, 4-nitro-2-di-n-octadecylcarbamoylphenyl, 4-nitro-2-methylcarbamoylphenyl, 4-nitro-2-n-hexadecylcarbamoylphenyl, 4-nitro-2-N-methyl-N-(4-dodecylsulfonylphenyl)carbamoylphenyl, 4-nitro-2-(3-methylsulfamoylphenyl)carbamoylphenyl 2,4-dimethanesulfonylphenyl, 2-methanesulfonyl-4-benzenesulfonylphenyl, 2-N-octanesulfonyl-4-methanesulfonylphenyl, 2-N-tetradecanesulfonyl-4-methanesulfonylphenyl, 2-n-hexadecanesulfonyl-4-methanesulfonylphenyl, 2,4-di-n-dodecanesulfonylphenyl, 2,4-didodecanesulfonyl-5-trifluoromethylphenyl, 2-n-decanesulfonyl-4-cyano-5-trifluoromethylphenyl, 2-cyano-4-methanesulfonylphenyl, 2,4,6-tricyanophenyl, 2,4-dicyanophenyl, 2-nitro-4-methanesulfonylphenyl, 2-nitro-4-n-dodecanesulfonylphenyl, 2-nitro-4-(2-sulfoethylsulfonyl)phenyl, 2-nitro-4-carboxymethylsulfonylphenyl, 2-nitro-4-carboxyphenyl, 2-nitro-4-ethoxycarbonyl-5-n-butoxyphenyl, 2-nitro-4-ethoxycarbonyl-5-n-hexadecyloxyphenyl, 2-nitro-4-diethylcarbamoyl-5-n-hexadecyloxyphenyl, 2-nitro-4-cyano-5-n-dodecylphenyl, 2,4-dinitrophenyl, 2-nitro-4-n-decylthiophenyl, 3,5-dinitrophenyl, 2-nitro-3,5-dimethyl-4-n-hexadecanesulfonyl, 4-methanesulfonyl-2-benzenesulfonylphenyl, 4-n-octanesulfonyl-2-methanesulfonylphenyl, 4-n-tetradecanesufonyl-2-methanesulfonylphenyl, 4-n-hexadecanesulfonyl-2-methanesulfonylphenyl, 2,5-didodecanesulfonyl-4-trifluoromethylphenyl, 4-n-decanesulfonyl-2-cyano-5-trifluoromethylphenyl, 4-cyano-2-methanesulfonylphenyl, 4-nitro-2-methanesulfonylphenyl, 4-nitro-2-n-dodecanesulfonylphenyl, 4-nitro-2-(2-sulfoethylsulfonyl)phenyl, 4-nitro-2-carboxymethylsulfonylphenyl, 4-nitro-2-carboxyphenyl, 4-nitro-2-ethoxycarbonyl-5-n-butoxyphenyl, 4-nitro-2-ethoxycarbonyl-5-n-hexadecyloxyphenyl, 4-nitro-2-diethylcarbamoyl-5-n-hexadecyloxyphenyl, 4-nitro-2-cyano-5-n-decylphenyl, 4-nitro-2-n-decylthiophenyl, 4-nitro-3,5-dimethyl-2-n-hexadecanesulfonyl, 4-nitronaphthyl, 2,4-dinitronaphthyl, 4-nitro-2-n-octadecylcarbamoylnaphthyl, 4-nitro-2-dioctylcarbamoyl-5-(3-sulfo-benzenesulfonylamino)-naphthyl, 2,3,4,5,6-pentafluorophenyl, 2-nitro-4-benzoylphenyl, 2,4-diacetylphenyl, 2-nitro-4-trifluoromethylphenyl, 4-nitro-2-trifluoromethylphenyl, 4-nitro-3-trifluoromethylphenyl, 2,4,5-tricyanophenyl, 3,4-dicyanophenyl, 2-chloro-4,5-dicyanophenyl, 2-bromo-4,5-dicyanophenyl, 4-methanesulfonyl, 4-n-hexadecanesulfonylphenyl, 2-decanesulfonyl-5-trifluoromethylphenyl, 2-nitro-5-methylphenyl, 2-nitro-5-n-octadecyloxyphenyl, 2-nitro-4-N-(vinylsulfonylethyl)-N-methylsulfamoylphenyl, 2-methyl-6-nitrobenzoxazol-5-yl, 2-N,N-dimethylsulfamoyl-4-nitrophenyl, 2-cyano-4-octadecylsulfonylphenyl, 2,4,6-tricyanophenyl, 2-nitro-4-N-methyl-N-octadecylcarbamoylphenyl, 2-nitro-5-octylthiophenyl, 2,4-dimethanesulfonylphenyl, 3,5-dinitrophenyl, 2-chloro-4-nitro-5-methylphenyl, 2-nitro-3,5-dimethyl-4-tetradecylsulfonylphenyl, 2,4-dinitronaphthyl, 2-ethylcarbamoyl-4-nitrophenyl, 2,4-bis-dodecylsulfonyl-5-trifluoromethylphenyl, 2,3,4,5,6-pentafluorophenyl, 2-acetyl-4-nitrophenyl, 2,4-diacetylphenyl, and 2-nitro-4-trifluoromethylphenyl.

Examples of the heterocyclic group represented by EAG are 2-pyridyl, 2-pyrazyl, 3-pyridyl, 4-pyridyl, 5-nitro-2-pyridyl, 5-N-hexadecylcarbamoyl-2-pyridyl, 5-nitro-N-hexadecylcarbamoyl-2-pyridyl, 3,5-dicyano-2-pyridyl, 5-dodecanesulfonyl-2-pyridyl, 5-cyano-2-pyrazyl, 4-nitrothiophen-2-yl, 5-nitro-1,2-dimethylimidazol-4-yl, 3,5-diacetyl-2-pyridyl, 1-dodecyl-5-carbamoylpyridinium-2-yl, 5-nitro-2-furyl, and 5-nitrobenzothiazol-2-yl.

Other examples of the group represented by EAG are quinones (e.g., 1,4-benzoquinon-2-yl, 3,5,6-trimethyl-1,4-benzoquinon-2-yl, 3-methyl-1,4-naphthoquinon-2-yl, 3,6-dimethyl-5-hexadecylthio-1,4-benzoquinon-2-yl, and 5-pentadecyl-1,2-benzoquinon-4-yl); their vinylogs; a nitroalkyl group (e.g., 2-nitro-2-propyl); a nitroalkenyl group (e.g., 2-nitroethenyl); and a monovalent group of an α-diketo compound (e.g., 2-oxopropanoyl).

Now —TIME)$_t$LA explained in greater detail.

In the above formulae, Time represents a group capable of releasing LA through a subsequent reaction, with the cleavage of a nitrogen-oxygen bond, a nitrogen-nitrogen bond or a nitrogen-sulfur bond as a trigger. t is 0 or 1, and when t is 0, Time represents a simple bond.

The groups shown by Time are described, for example, in JP-A-No. 61-147244, pages 5 to 6, JP-A-No. 61-236549, pages 8 to 14, and JP-A-No. 62-215270, pages 36 to 44.

Specific examples of preferred groups represented by Time are illustrated below, in which (*) indicates the bond to PWR and (*)(*) indicates the bond to LA.

(1)

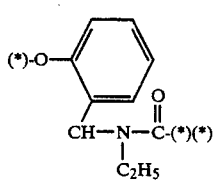

(2)

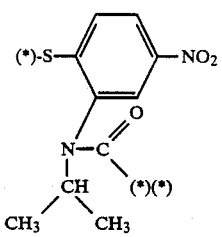

(3)

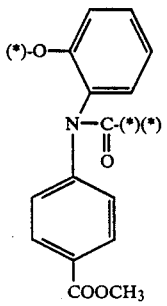

-continued (4)

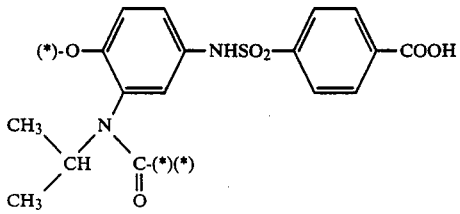

(5)

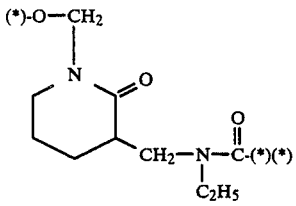

(6)

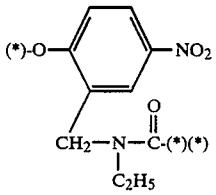

(7)

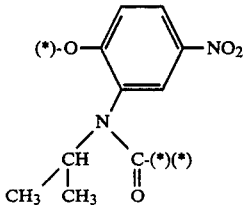

(8)

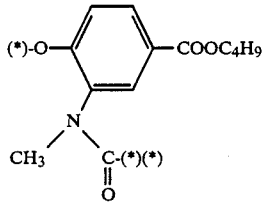

(9)

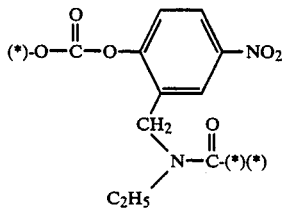

(10)

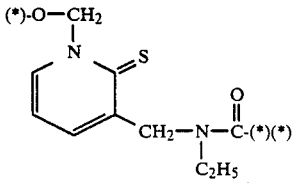

-continued
(11)
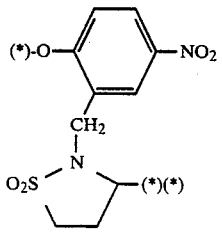
(12)
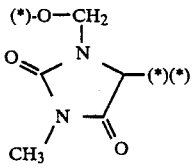
(13)
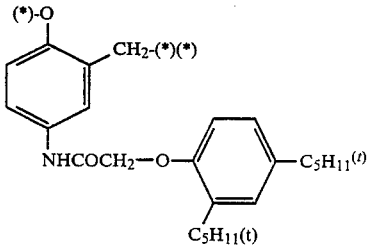
(14)
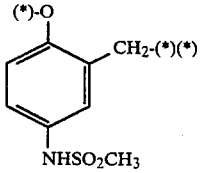
(15)
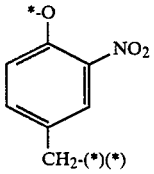
(16)
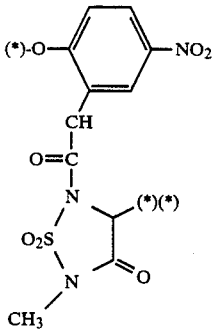
(17)
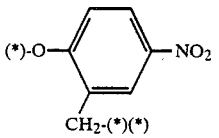
-continued
(18)
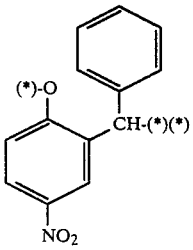
(19)
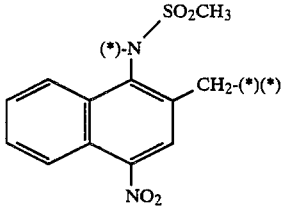
(20)
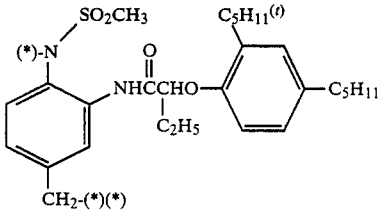
(21)
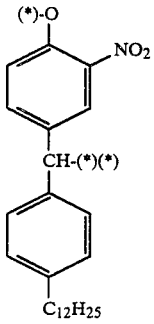
(22)
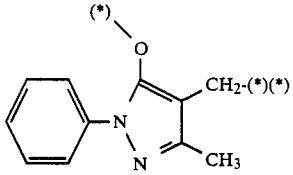
(23)
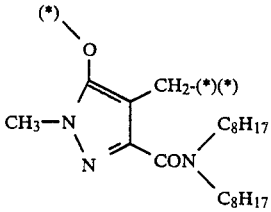
(24)
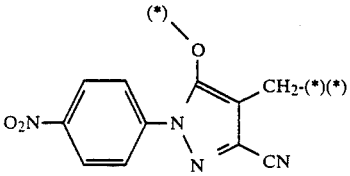

-continued (25)

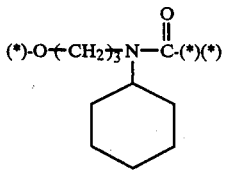

(26)

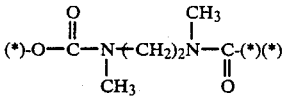

(27)

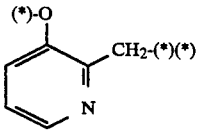

(28)

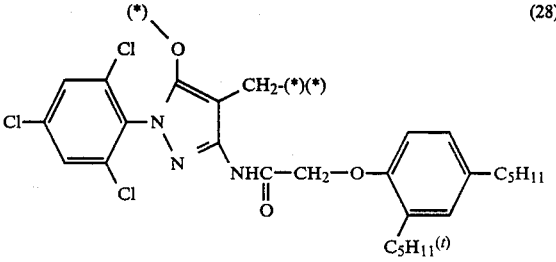

(29)

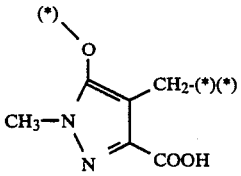

(30)

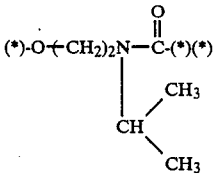

(31)

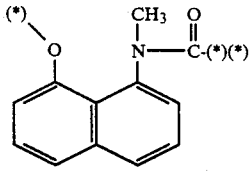

(32)

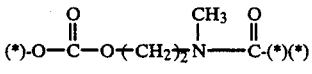

(33)

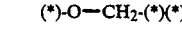

(34)

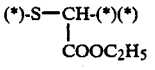

(35)

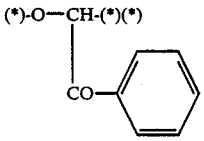

-continued (36)

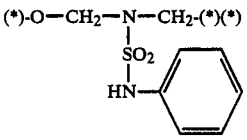

(37)

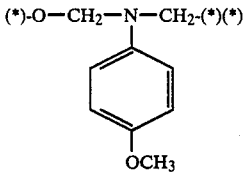

(38)

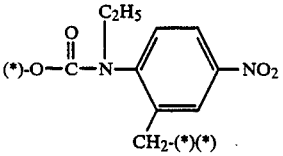

(39)

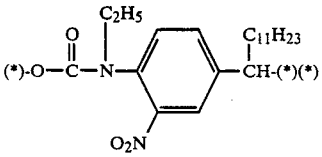

(40)

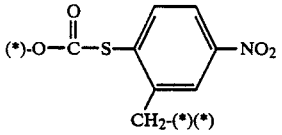

(41)

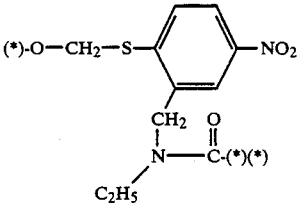

(42)

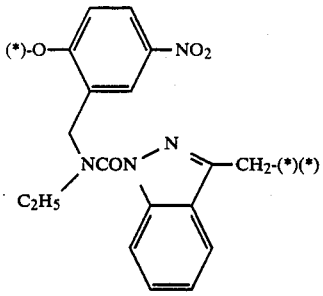

The functional compound for use in this invention preferably has at least one water solubilizing group such as a sulfonic acid group or a salt thereof, a carboxyl group or a salt thereof, a sulfuric acid group or a salt thereof, a phosphoric acid group or a salt thereof, a hydroxyl group, a sulfamido group, and a formamido group. The position of substitution may be PWR, Time or LA but is preferably LA. Also, it is preferred that the functional compound has an aliphatic group having from 4 to 18 carbon atoms (e.g., a substituted or unsubstituted straight chain or branched alkyl group or alkylene group, and in particular, a sulfamoyl group or carbamoyl group substituted by an aliphatic group).

Now, as described above, LA in formula (I) represents a photographically useful group having an absorption maximum in the wavelength region longer than 310 nm, suitably used for a daylight type photographic light-sensitive material, which is used in a photographic printing plate making process.

LA includes arylidene series dyes, styryl series dyes, butadiene series dyes, oxonol series dyes, cyanine series dyes, merocyanine series dyes, hemicyanine series dyes, diarylmethane series dyes, triarylmethane dyes, azomethine series dyes, azo dyes, metal chelate dyes, anthraquinone dyes, stilbene series dyes, chalcone series dyes, and indophenol series dyes.

Specific examples of the compound represented by formula (I) are illustrated below, but the present invention is not to be construed as being limited thereto.

1-1

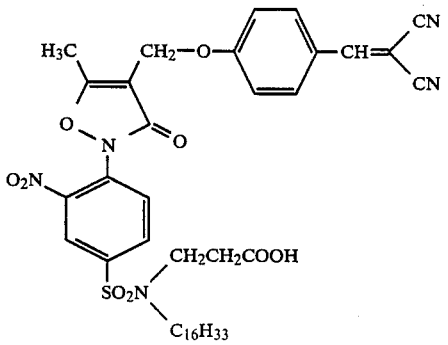

1-2

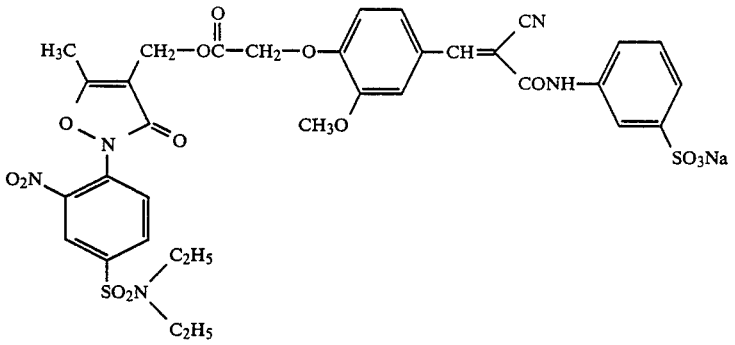

1-3

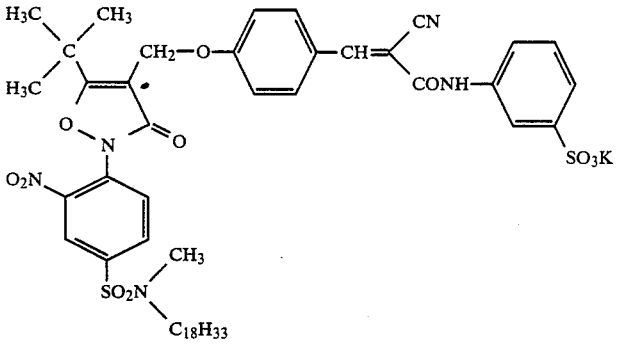

1-4

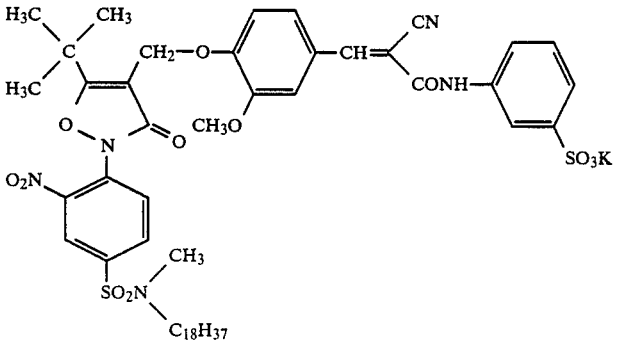

-continued
1-5
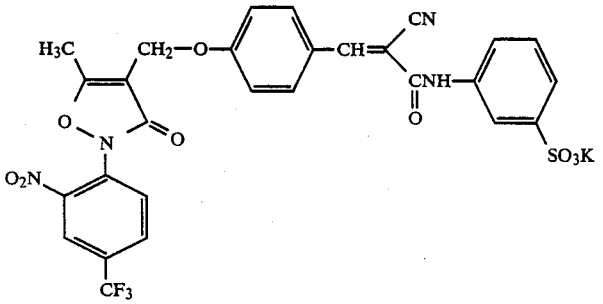
1-6
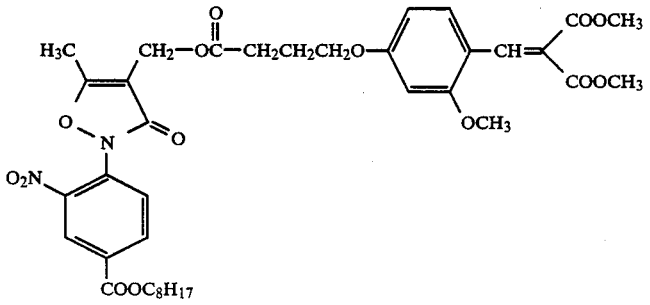
1-7
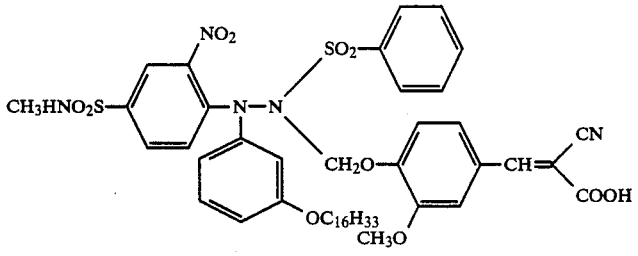
1-8
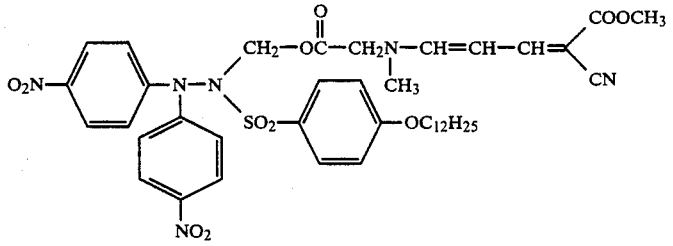
1-9
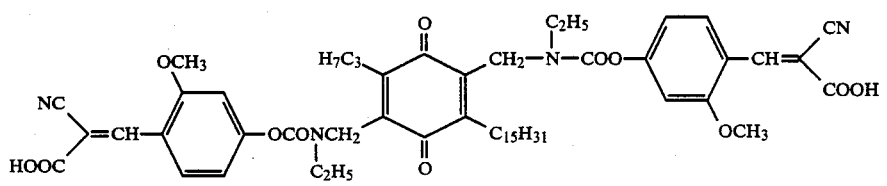
1-10
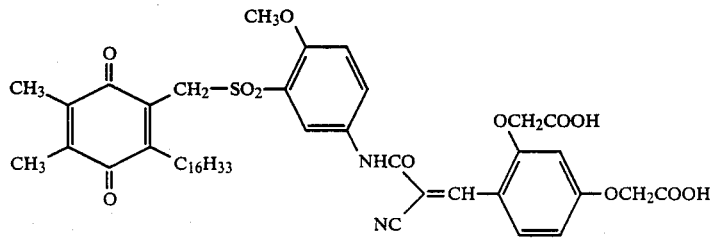

-continued
1-11
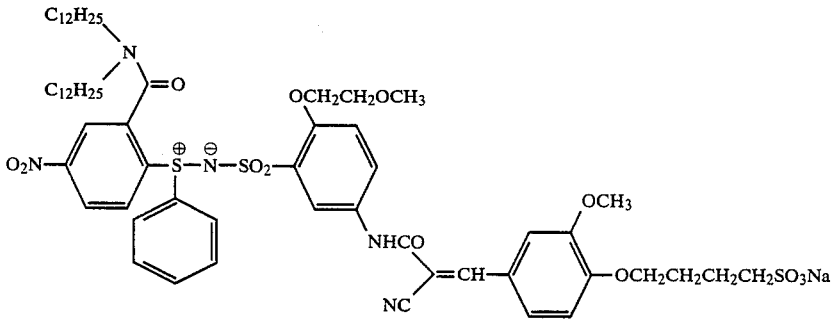
1-12
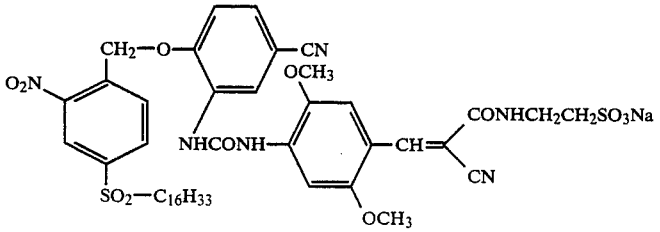
1-13
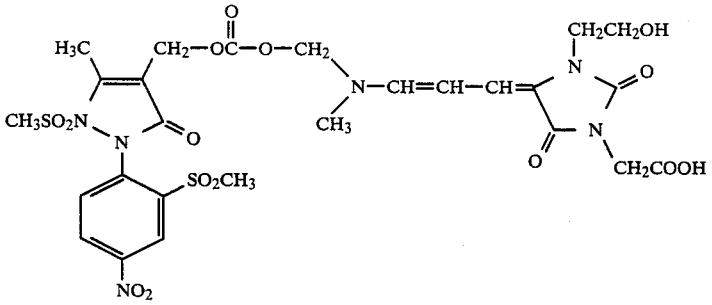
1-14
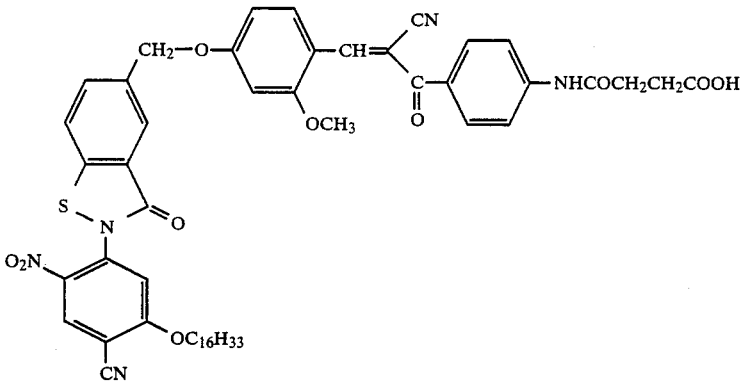
1-15
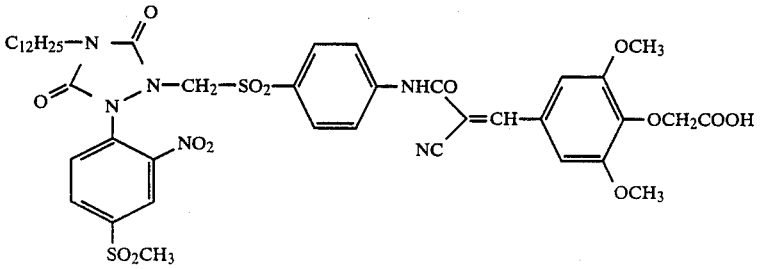

-continued
1-16
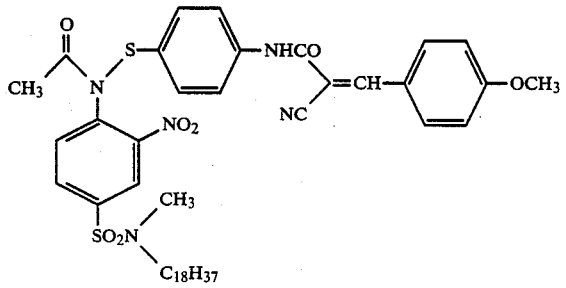
1-17
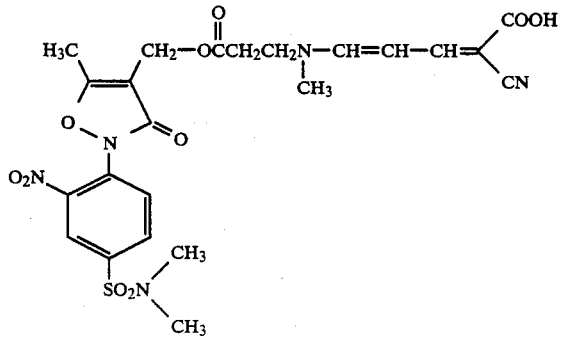
1-18
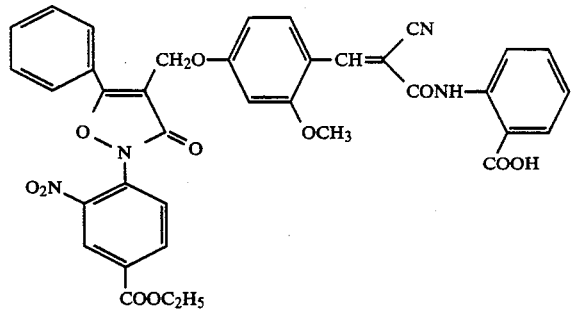
1-19
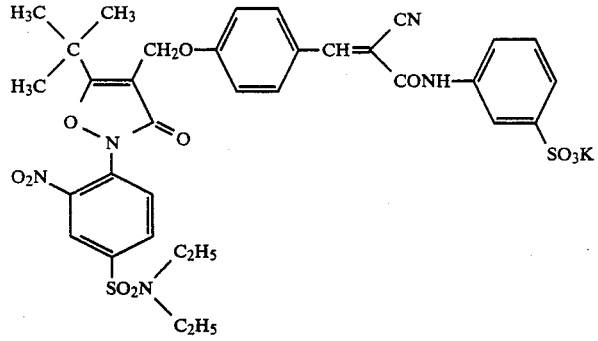
1-20
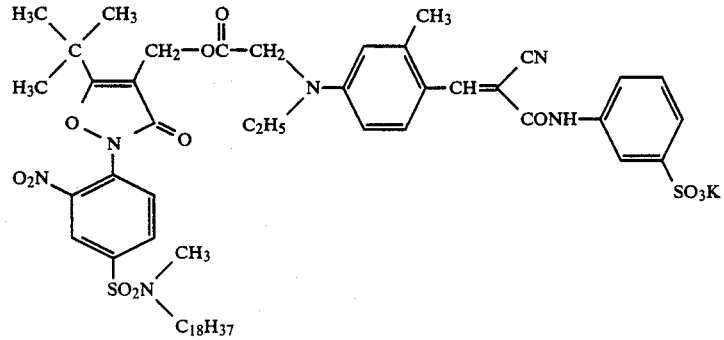

-continued
1-21
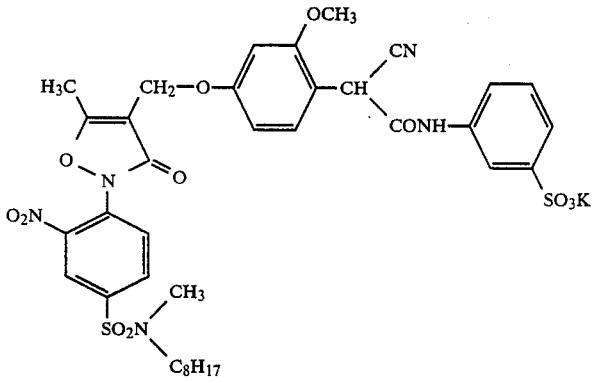
1-22
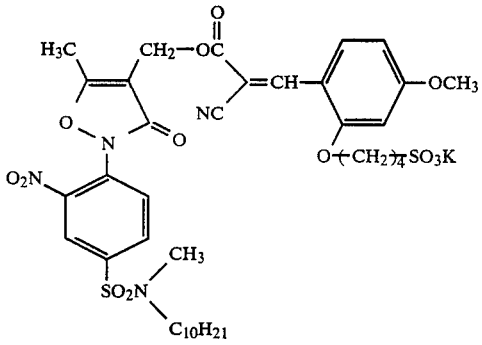
1-23
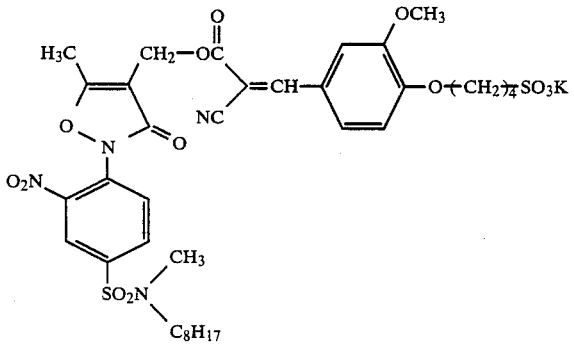
1-24
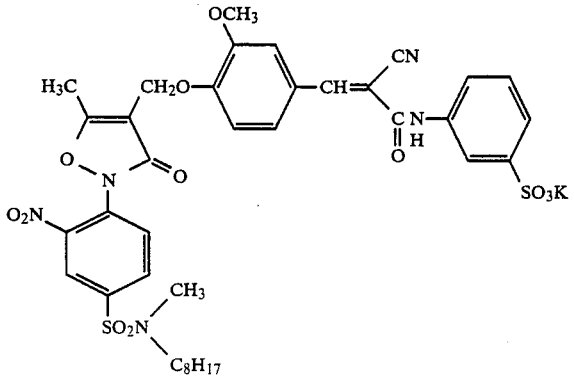

-continued
1-25
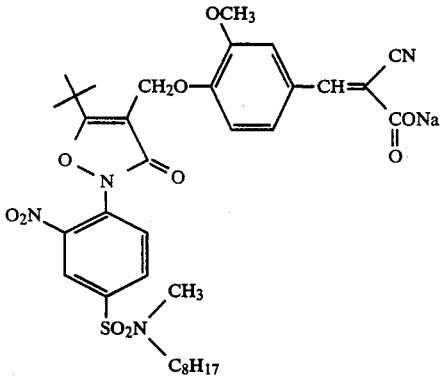
1-26
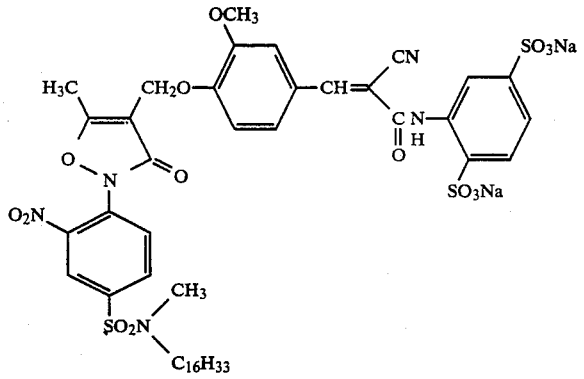
1-27
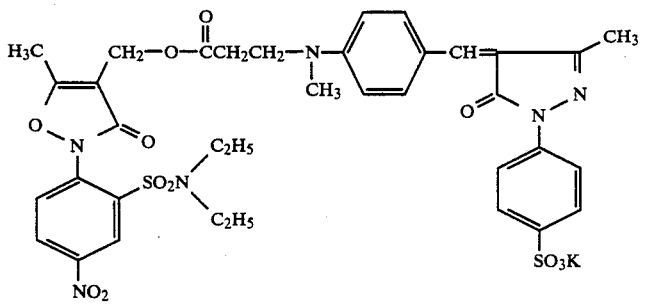
1-28
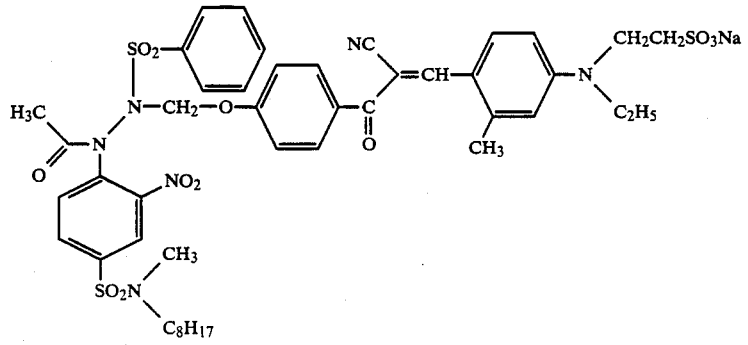

-continued
1-29
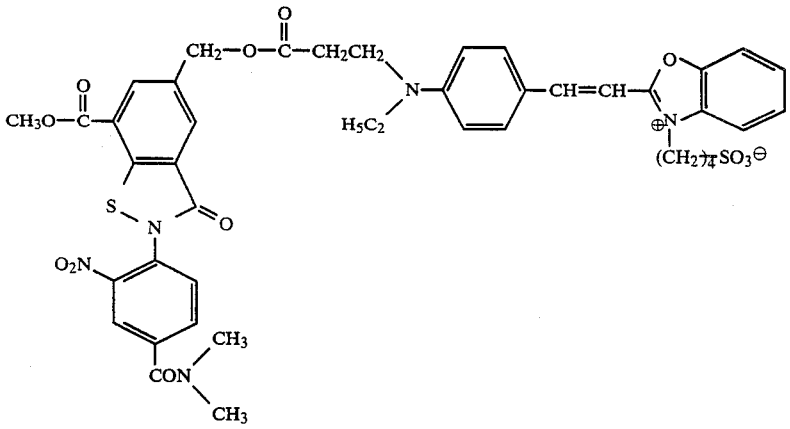
1-30
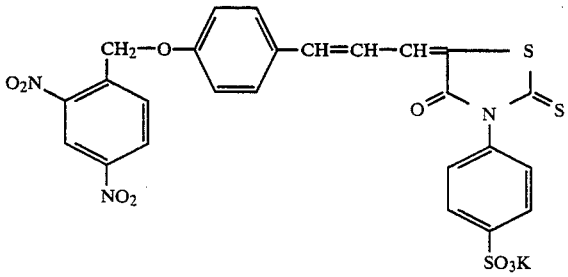
1-31
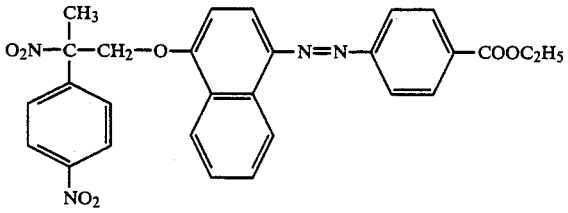
1-32
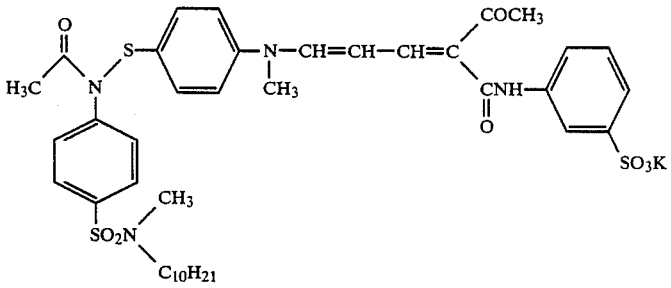
1-33
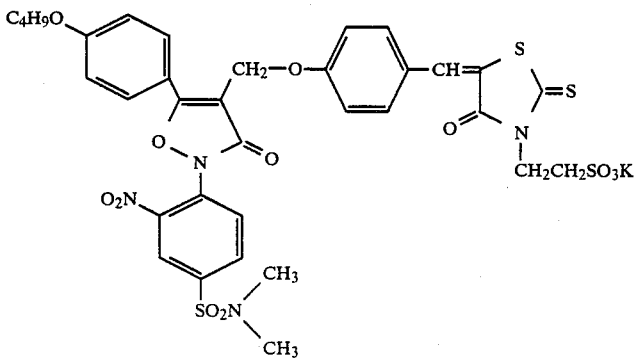

-continued
1-34
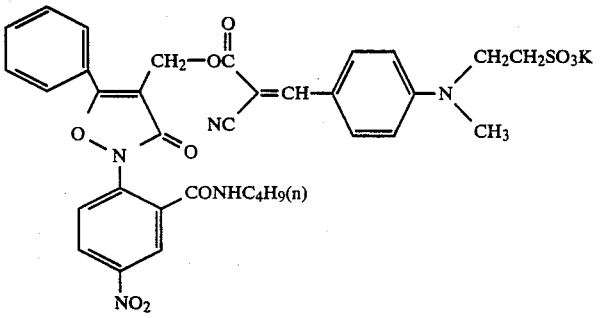
1-35
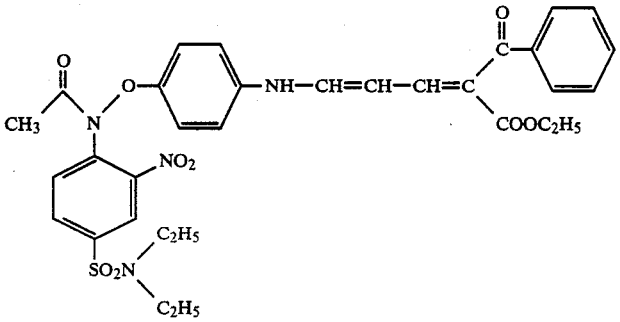
1-36
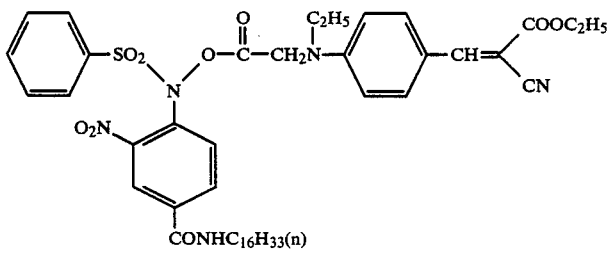
1-37
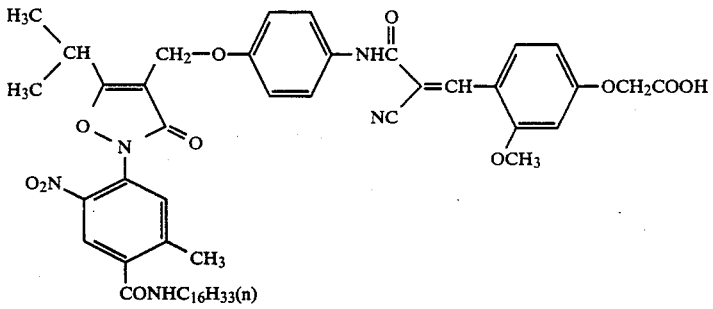
1-38
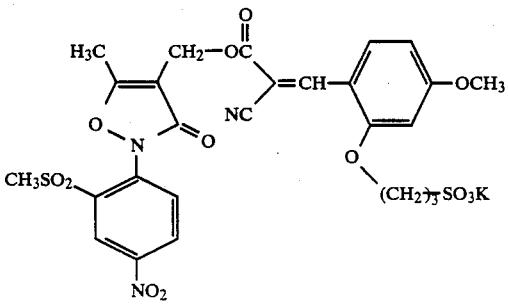

-continued
1-39
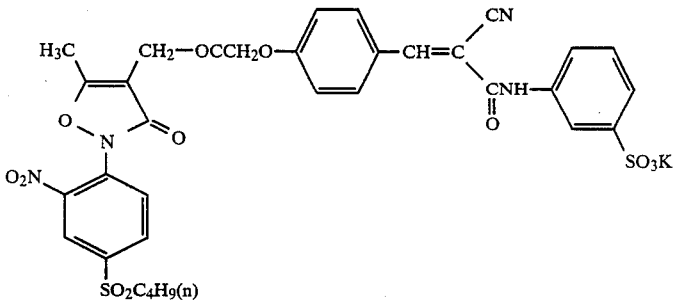
1-40
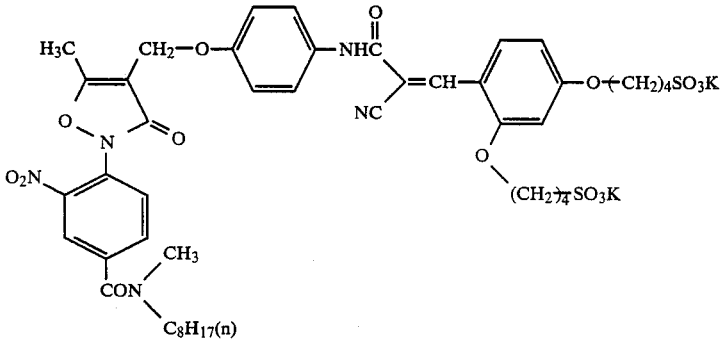
1-41
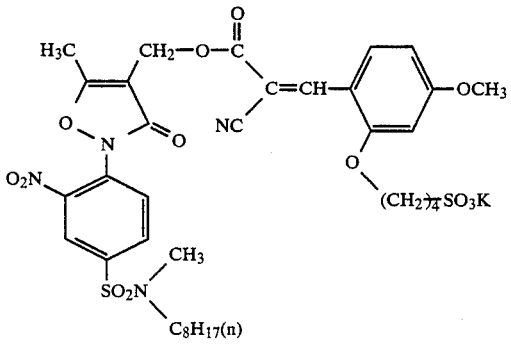
1-42
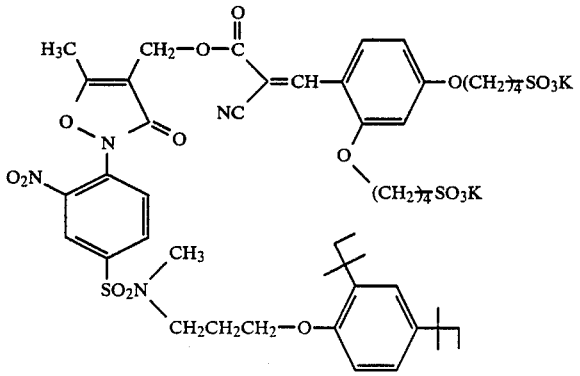

-continued
1-43
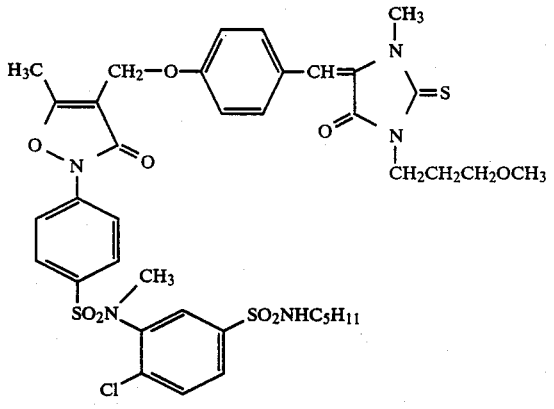
1-44
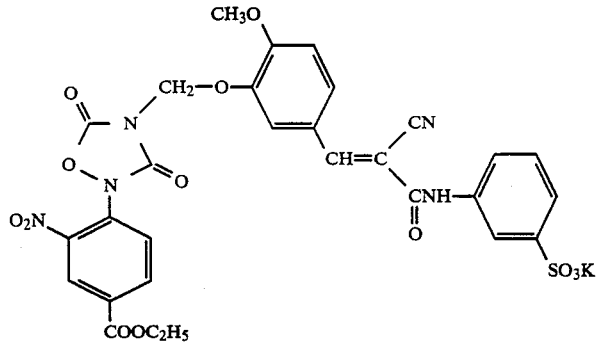
1-45
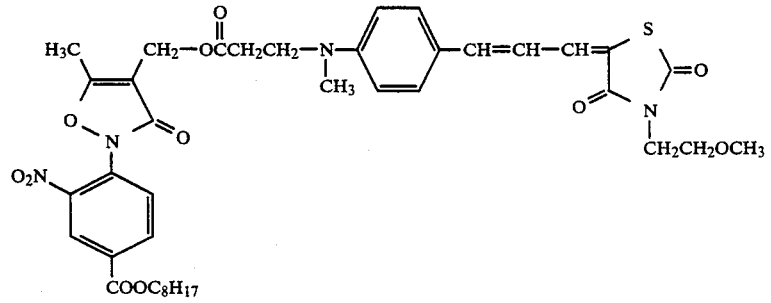
1-46
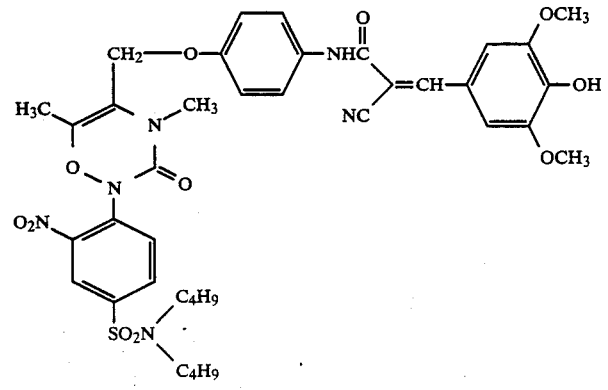

-continued
1-47
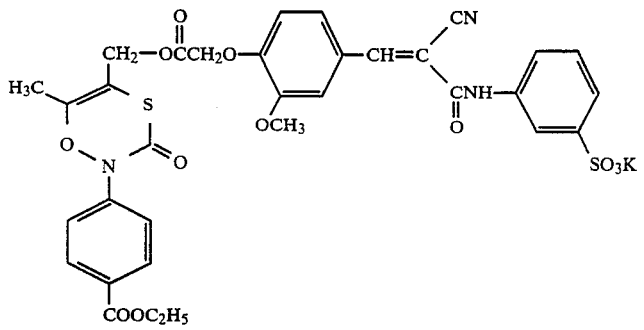
1-48
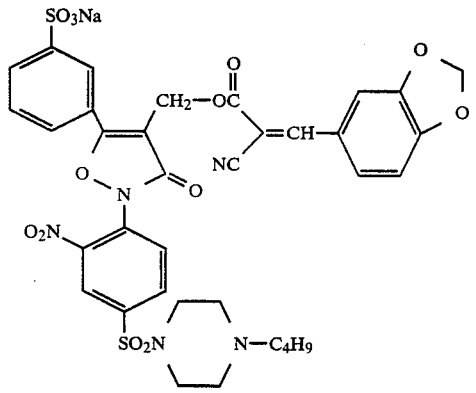
1-49
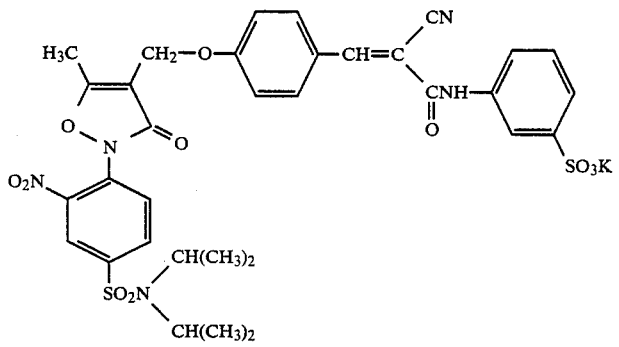
1-50
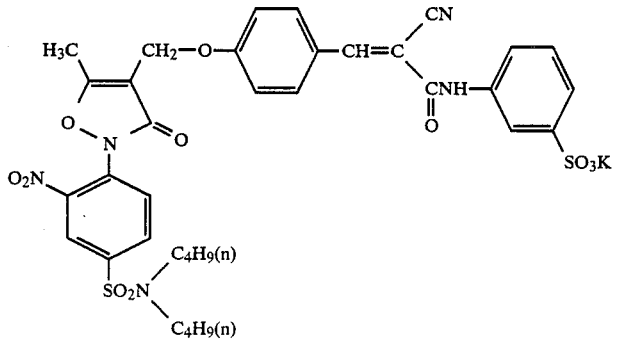

-continued
1-51
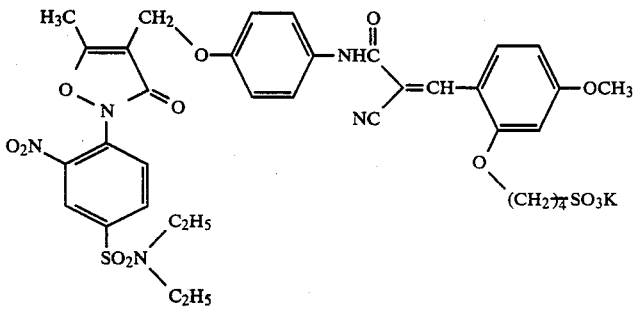
1-52
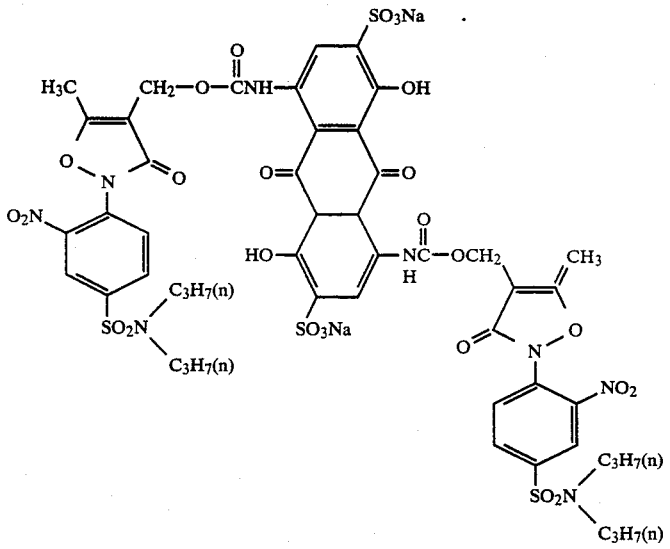
1-53
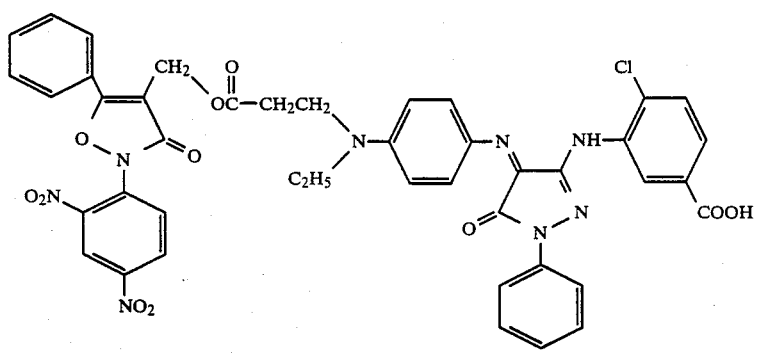
1-54
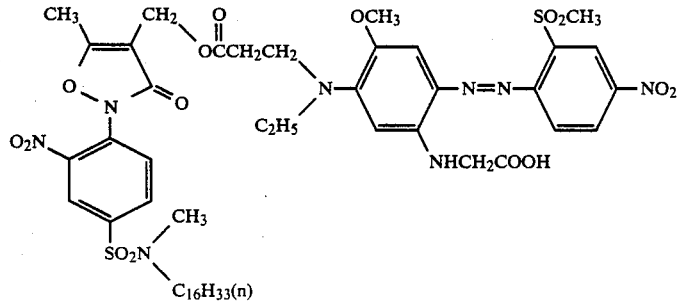

-continued
1-55
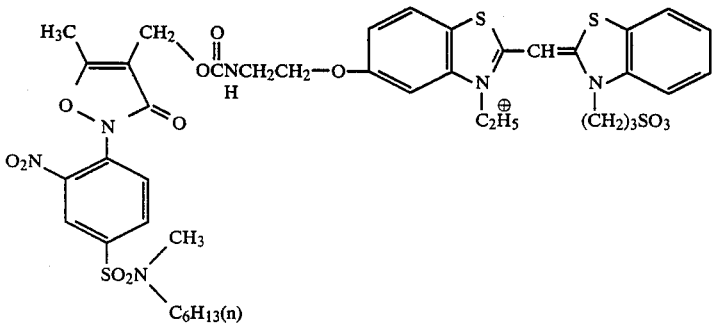
1-56
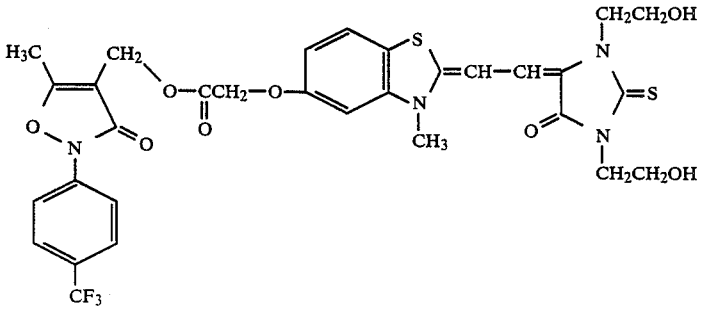
1-57
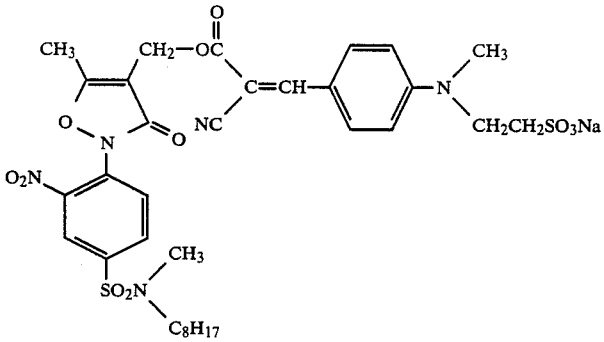
1-58
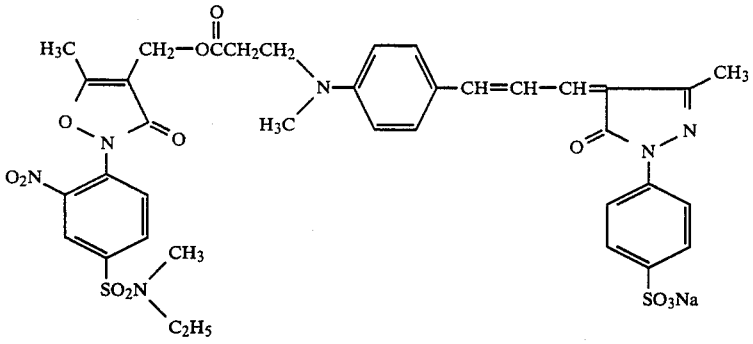
1-59
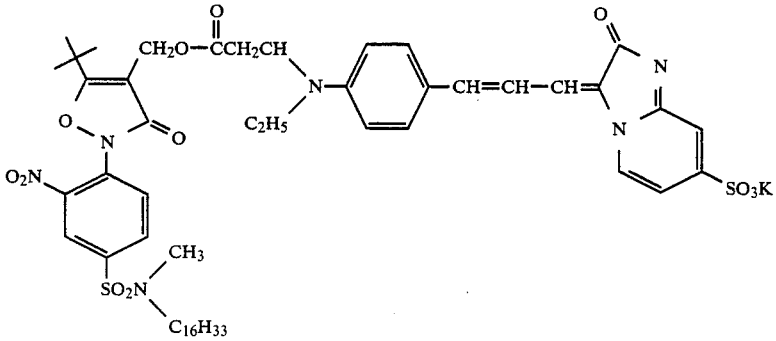

-continued
1-60
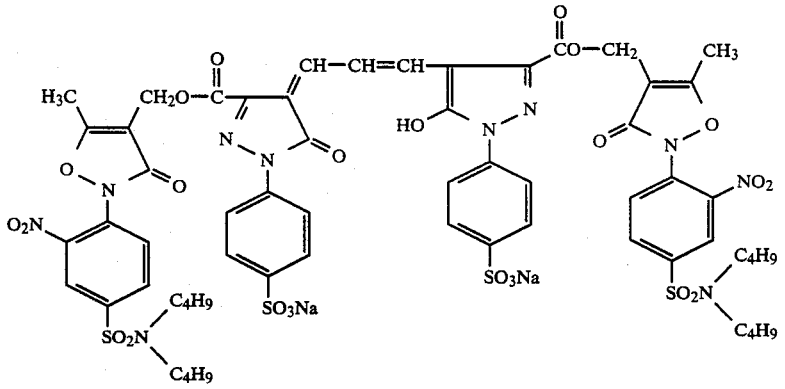
1-61
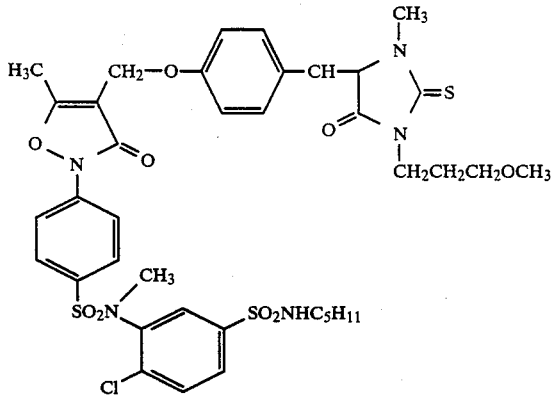
1-62
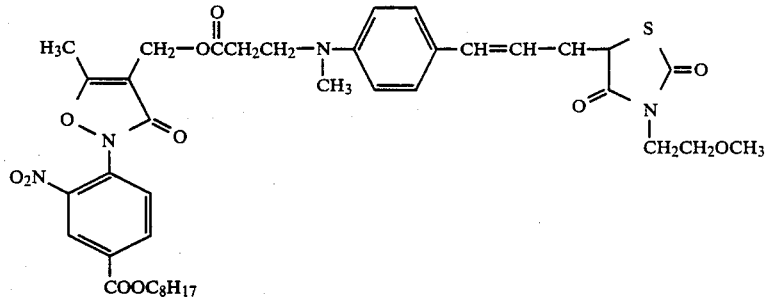
1-63
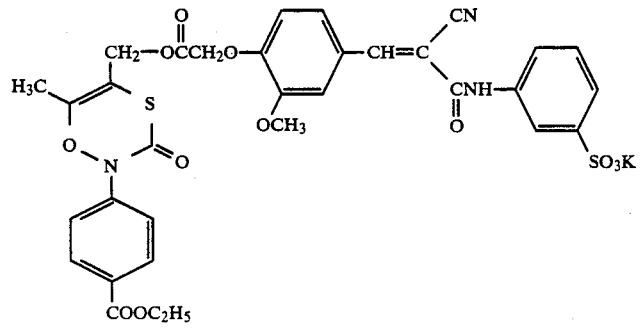

-continued
1-64
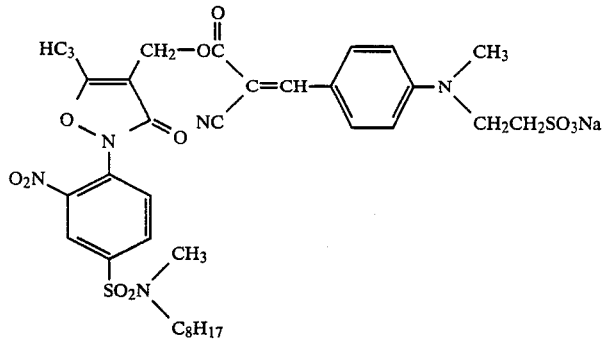
1-65
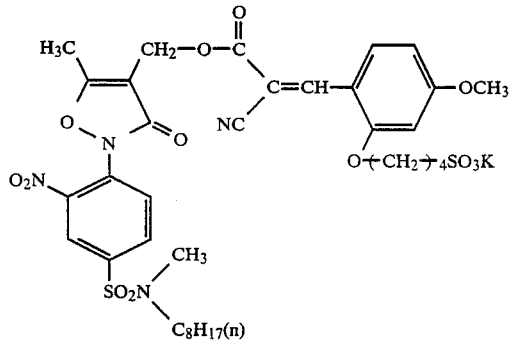
1-66
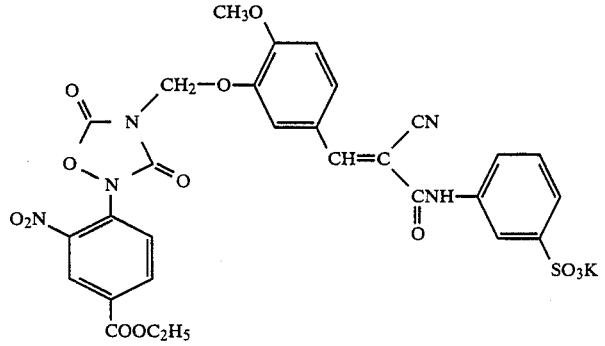
1-67
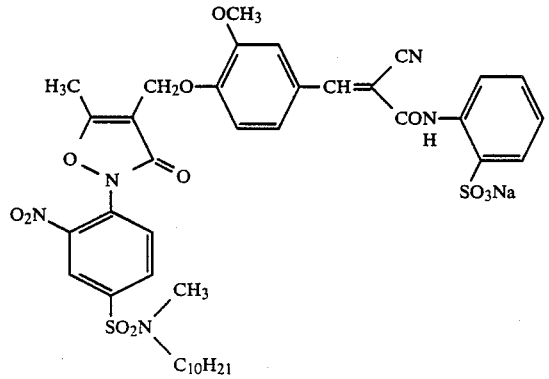

-continued
1-68
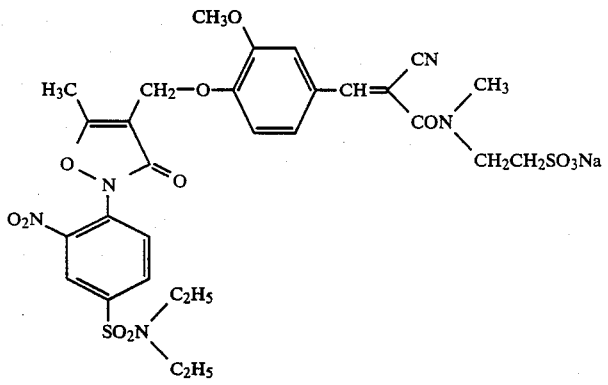
1-69
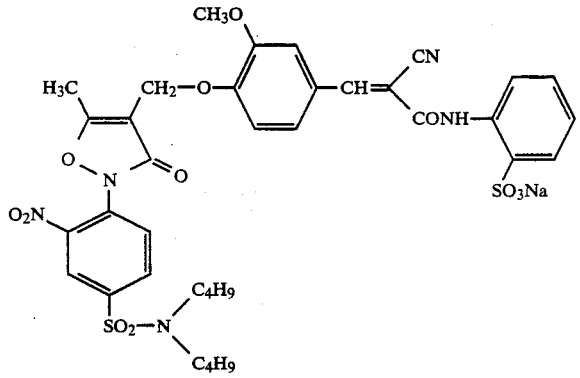
1-70
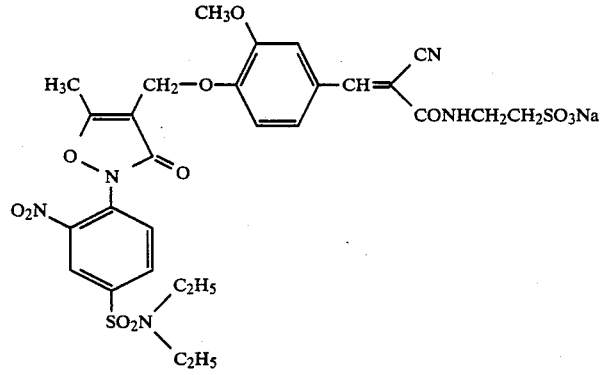
1-71
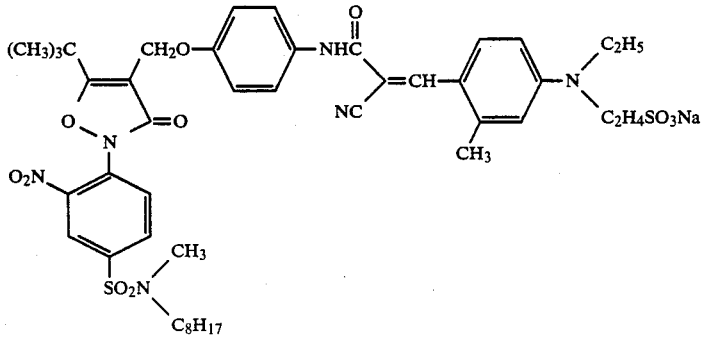

-continued 1-72

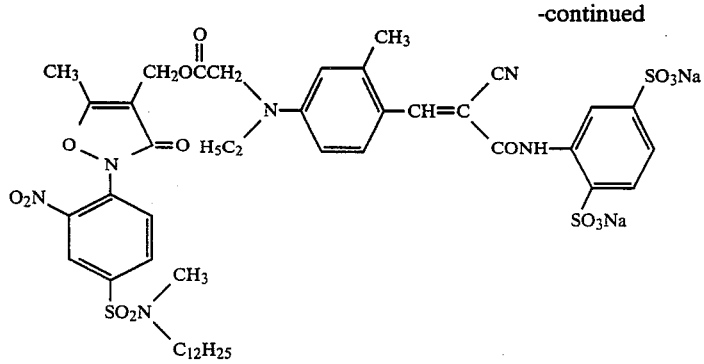

1-73

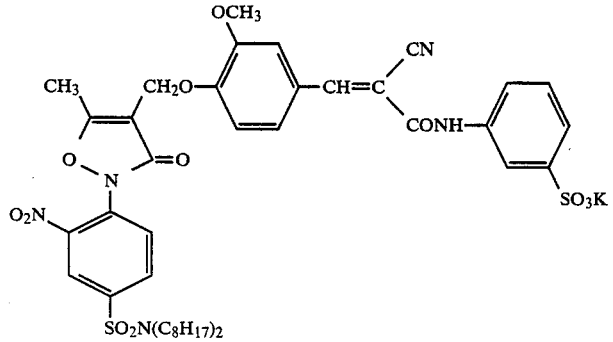

1-74

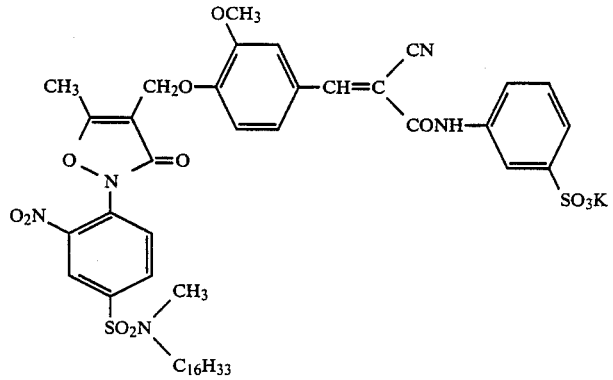

The compounds of formula (I) which are used in this invention can be easily synthesized by bonding dyes being released to the PWR moiety by the synthesis methods disclosed in U.S. Pat. Nos. 4,139,389 and 4,139,379 and JP-A-No. 59-185333, the synthesis methods disclosed in U.S. Pat. No. 4,232,107 and JP-A-No. 59-101649 and JP-A-No. 61-88257, the synthesis methods disclosed in U.S. Pat. Nos. 4,343,893 and 4,619,884, and the synthesis methods of compounds disclosed in U.S. Pat. Nos. 4,450,223 and 4,609,610, and JP-A-No. 62-215270.

Synthesis methods for the compounds of formula (I) are also disclosed in Japanese Patent Application No. 62-43704.

The compound of formula (I) can be incorporated in an interlayer, a silver halide emulsion layer or a protective layer of a silver halide photographic material, but is preferably incorporated in a light-insensitive hydrophilic colloid layer (e.g., a surface protective layer) disposed at the outer side of a silver halide emulsion layer farthest from the support, or in a light-insensitive hydrophilic colloid layer disposed between the support and the silver halide emulsion layer nearest to the support.

Any desired amount of the compound of formula (I) can be incorporated in the above-described layer of the photographic light-sensitive material of this invention according to purpose but it is preferred to use the compound in the range of optical density of from about 0.05 to about 3.0. The specific amount of the dye or the compound depends upon its nature, but is generally from about $1.0\times10^{-3}$ g/m$^2$ to about 3.0 g/m$^2$, and particularly from about $1.0\times10^{-3}$ g/m$^2$ to about 1.0 g/m$^2$.

The functional compound represented by formula (I) which is used in this invention can be incorporated in a hydrophilic colloid layer by various methods.

For example, the compound is dissolved in water or a water-soluble organic solvent, e.g., an organic solvent having a solubility of at least about 5%, in water or an aqueous solution of a hydrophilic colloid (e.g., alcohols such as methanol, ethanol, propanol; ketones such as acetone, methyl ethyl ketone; methyl cellosolve; dimethylformamide; cyclohexanone; and ethyl acetate) and then dissolved or dispersed in an aqueous gelatin solution as a solution thereof. The compound can be dissolved in a high-boiling oil or organic solvent and added to an aqueous gelatin solution as an emulsified dispersion of fine oil droplets. Such oils include tricresyl phosphate, diethyl phthalate, dibutyl phthalate and triphenyl phosphate.

It is particularly preferred that the functional compound for use in this invention is dispersed in a hydrophilic colloid layer in the presence of an amphoteric surface active agent. The amphoteric surface active agent may be added to an organic solvent solution or an aqueous solution of a hydrophilic colloid at dispersion or may be added to the dispersion after dispersing them.

The term "amphoteric surface active agent" as used herein means a surface active agent having two different functional groups selected from an anionic functional group, a cationic functional group and a nonionic functional group, and is generally classified as an anion-cation type, an anion-nonion type, and a cation/nonion type.

The amphoteric surface active agent which can be used in this invention includes a cation/anion amphoteric surface active agent having an ammonium group as the cation group and a group selected from a carboxylic acid group, a sulfonic acid group, a sulfuric acid ester group and a phosphoric acid ester group as the anion group, a cation/nonion amphoteric surface active agent such as amine oxides, polyoxyethylene alkylamines, and polyoxyethylene polyamines, and an anion/-nonion amphoteric surface active agent such as polyoxyethylenes having a carboxy group or a sulfonic acid group. Of these surface active agents, a cation/anion amphoteric surface active agent is particularly preferred.

The anion/cation amphoteric surface active agents which can be used in this invention are further classified into the following groups mainly according to the acid group:

Carboxybetaine type: (1)

(having $-\overset{\oplus}{N}-$ and $-COO^{\ominus}$)

Sulfobetaine type: (2)

(having $-\overset{\oplus}{N}-$ and $-SO_3^{\ominus}$)

Sulfuric acid ester type: (3)

(having $-\overset{\oplus}{N}-$ and $-OSO_3^{\ominus}$)

Phosphoric acid ester type: (4)

(having $-\overset{\oplus}{N}-$ and $-OPO_3^{\ominus}$)

Amino acid type: (5)

(having $-\overset{\oplus}{N}H_2-$ and $-COO^{\ominus}$)

-continued

Aminosulfonic acid type: (6)

(having $-\overset{\oplus}{N}H_2-$ and $-SO_3^{\ominus}$)

Specific examples of the anion-cation types amphoteric surface active agents which can be used in this invention are illustrated below, but the invention is not to be construed as being limited to these compounds.

1. $C_7H_{15}CONH(CH_2)_3\overset{\oplus}{N}(CH_3)_2(CH_2)_4SO_3^{\ominus}$

2. $C_9H_{19}CONH(CH_2)_3\overset{\oplus}{N}(CH_3)_2(CH_2)_4SO_3^{\ominus}$

3. $C_{11}H_{23}CONH(CH_2)_3\overset{\oplus}{N}(CH_3)_2(CH_2)_4SO_3^{\ominus}$

4. $C_{13}H_{27}CONH(CH_2)_3\overset{\oplus}{N}(CH_3)_2(CH_2)_4SO_3^{\ominus}$

5. $C_{15}H_{31}CONH(CH_2)_3\overset{\oplus}{N}(CH_3)_2(CH_2)_4SO_3^{\ominus}$

6. $C_{10}H_{21}\overset{\oplus}{N}(CH_3)_2(CH_2)_3SO_3^{\ominus}$

7. $C_{12}H_{25}\overset{\oplus}{N}(CH_3)_2(CH_2)_3SO_3^{\ominus}$

8. $C_{14}H_{29}\overset{\oplus}{N}(CH_3)_2(CH_2)_3SO_3^{\ominus}$

9. $C_{16}H_{33}\overset{\oplus}{N}(CH_3)_2(CH_2)_3SO_3^{\ominus}$

10. $C_{10}H_{21}\overset{\oplus}{N}(CH_3)_2CH_2CH(OH)CH_2SO_3^{\ominus}$

11. $C_{12}H_{25}\overset{\oplus}{N}(CH_3)_2CH_2CH(OH)CH_2SO_3^{\ominus}$

12. $C_{12}H_{25}\overset{\oplus}{N}(CH_3)_2CH_2\underset{\underset{CH_3}{|}}{C}HSO_3^{\ominus}$ 13. $C_{12}H_{25}\overset{\oplus}{N}(n\text{-}C_3H_7)_2(CH_2)_3SO_3^{\ominus}$ 14. $C_{12}H_{25}\overset{\oplus}{N}(CH_3)_2(CH_2)_3OSO_3^{\ominus}$ 15. $C_9H_{19}CONH(CH_2)_2\overset{\oplus}{N}(CH_3)_2CH_2CH(OH)CH_2SO_3^{\ominus}$ 16. $C_{11}H_{23}CONH(CH_2)_2\overset{\oplus}{N}(CH_3)_2CH_2CH(OH)CH_2SO_3^{\ominus}$ 17. $C_{13}H_{27}CONH(CH_2)_2\overset{\oplus}{N}(CH_3)_2CH_2CH(OH)CH_2SO_3^{\ominus}$ 18. $C_{11}H_{23}CONH(CH_2)_3\overset{\oplus}{N}(CH_3)_2CH_2COO^{\ominus}$ 19. $C_9H_{19}CONH(CH_2)_3\overset{\oplus}{N}(CH_3)_2CH_2COO^{\ominus}$ 20. $C_{13}H_{27}CONH(CH_2)_3\overset{\oplus}{N}(CH_3)_2CH_2COO^{\ominus}$ 21. $C_8H_{17}\overset{\oplus}{N}(CH_3)_2CH_2COO^{\ominus}$ 22. $C_{10}H_{21}\overset{\oplus}{N}(CH_3)_2CH_2COO^{\ominus}$ 23. $C_{12}H_{25}\overset{\oplus}{N}(CH_3)_2CH_2COO^{\ominus}$ -continued $C_{12}H_{25}N(CH_3)_2CH_2CH_2CH_2COO^{\ominus}$ $C_{12}H_{25}\overset{\oplus}{N}(C_2H_5)_2CH_2COO^{\ominus}$ $C_{10}H_{21}CH(\overset{\oplus}{N}(CH_3)_3)COO^{\ominus}$ $C_{12}H_{25}CH(\overset{\oplus}{N}(CH_3)_3)COO^{\ominus}$

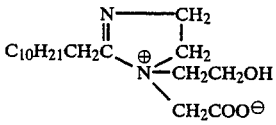

$C_{10}H_{21}\overset{\oplus}{N}(CH_3)_2CH_2CH_2OPO_3^{\ominus}$ $C_{12}H_{25}\overset{\oplus}{N}(CH_3)_2CH_2CH_2OPO_3^{\ominus}$ $C_{12}H_{25}\overset{\oplus}{N}H(H)CH_2CH_2COO^{\ominus}$ $C_{12}H_{25}\overset{\oplus}{N}H(H)CH_2CH_2CSO_3^{\ominus}$ $C_{12}H_{25}\overset{\oplus}{N}H(H)CH_2CH_2OPO_3^{\ominus}$ $C_9H_{19}SO_2NH(CH_2)_3\overset{\oplus}{N}(CH_3)_2(CH_2)_4SO_3^{\ominus}$ $C_{11}H_{23}SO_2NH(CH_2)_3\overset{\oplus}{N}(CH_3)_2(CH_2)_4SO_3^{\ominus}$ $C_{13}H_{27}SO_2NH(CH_2)_3\overset{\oplus}{N}(CH_3)_2(CH_2)_4SO_3^{\ominus}$ $C_{11}H_{23}SO_2NH(CH_2)_3\overset{\oplus}{N}(CH_3)_2CH_2COO^{\ominus}$

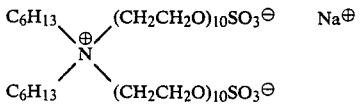

Examples of the cation/anion amphoteric surface active agent and the anion/nonion amphoteric surface active agent which can be used in this invention are illustrated below, but the invention is not to be construed as being limited to these materials.

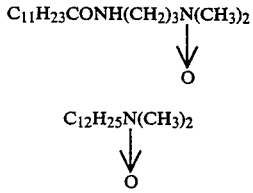

$C_{12}H_{25}O(CH_2CH_2O)_{15}CH_2CH_2OCH_2COOH$
$C_{16}H_{33}O(CH_2CH_2O)_{15}CH_2CH_2OCH_2COOH$
$C_{12}H_{25}O(CH_2CH_2O)_{10}CH_2CH_2OSO_3H$
$C_{18}H_{37}O(CH_2CH_2O)_{15}CH_2CH_2OSO_3H$

Other examples of amphoteric surface active agents which can be used in this invention are described in Takao Karikome, *Tokushu Kinoo Kaimen Kassei Zai* (*Specific Functional Surface Active Agents*), (published by CMC K.K. 1986) and Ryohei Oda and Kazuhiro Teramura, *Kaimen Kasseizai no Gosei to sono Oyoo* (*Synthesis of Surface Active Agents and Application Thereof*), (published by Maki Shoten, 1957).

Furthermore, the amphoteric surface active agent preferably used in this invention includes a compound represented by formula (IV):

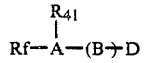

(IV)

wherein Rf represents an alkyl group, an alkenyl group or an aralkyl group, each substituted with at least one fluorine atom and containing from 1 to 18 carbon atoms; $R^{41}$ represents hydrogen or a substituted or unsubstituted saturated or unsaturated hydrocarbon group containing from 1 to 18 carbon atoms, preferably an alkyl group, (in addition, the total number of carbon atoms in $R^{41}$ and Rf preferably is at most 24); A represents a trivalent linkage group; B represents a divalent linkage group; and D represents a betaine group.

In formula (IV), preferred examples of the trivalent linkage group represented by A are

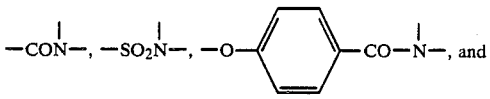

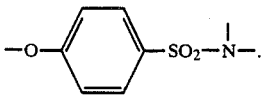

Preferred examples of $R^{41}$ in the above formula are $-CH_3$, $-C_2H_5$, $-C_3H_7$, $-C_8H_{13}$, $-C_8H_{17}$, $C_{10}H_{21}$, $-C_{12}H_{25}$, and $-C_{18}H_{37}$.

Preferred examples of Rf are $-CF_3$, $-C_2F_5$, $-C_3F_7$, $-C_6F_{13}$, $-C_8F_{17}$,

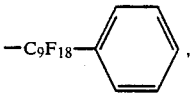

$H(CF_2CF_2)_2-$, and $H(CF_2CF_2)_4-$.

Preferred examples of the divalent group represented by B are $-CH_2CH_2-$, $-CH_2CH_2CH_2-$, $\leftarrow CH_2CH_2)_nCH_2CH_2-$ (n = 1 to 30), and $\leftarrow CH_2CH(CH_3)O\rightarrow_n CH_2CH_2-$ (n = 1 to 30).

Preferred examples of the betaine group represented by D are

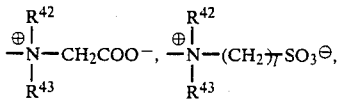

-continued

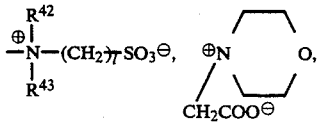

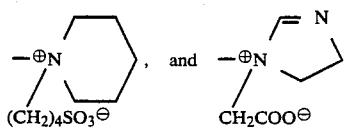

(wherein $R^{42}$ and $R^{43}$ which may be the same or different, each represents an alkyl group having from 1 to 6 carbon atoms and l is an integer of 1 to 6).

Specific examples of the fluorine-containing amphoteric surface active agent represented by formula (IV) are illustrated below, but the present invention is not to be construed as being limited thereto.

IV-1

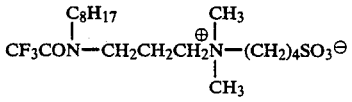

IV-2

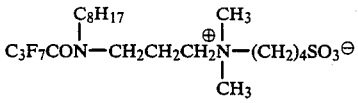

IV-3

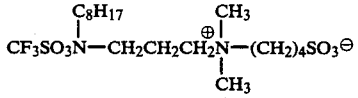

IV-4

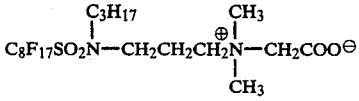

IV-5

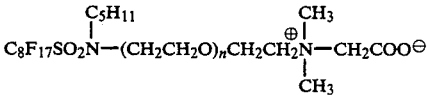

n = 5

IV-6

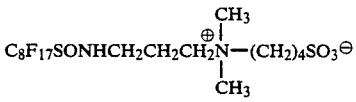

IV-7

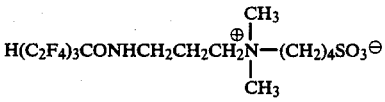

IV-8

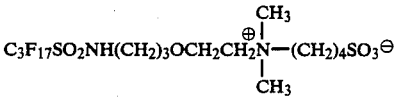

IV-9

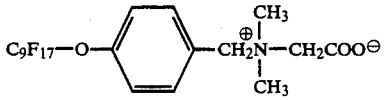

IV-10

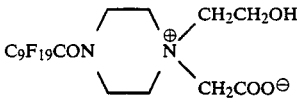

-continued

IV-11

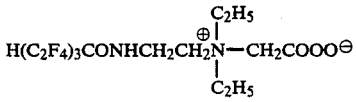

VI-12

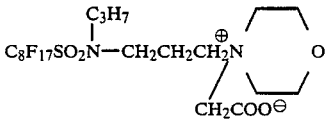

IV-13

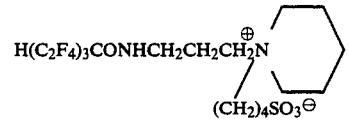

IV-14

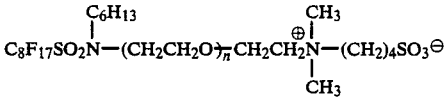

n = 5

IV-15

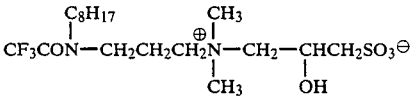

It is suitable that the amphoteric surface active agent is used in an amount (by weight) of from 1/20 to 10 times, and preferably from 1/5 to 2 times the amount of the compound represented by formula (I) described above.

The functional compound for use in this invention represented by formula (I) releases the photographically useful group LA by receiving an electron from a reducing material.

Examples of the preferred reducing agents in this invention are 3-pyrazolidone compounds represented by formula (V):

(V)

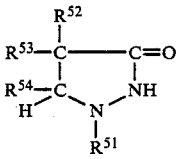

wherein $R^{51}$ represents a substituted or unsubstituted aryl group, preferably having 6 to 12 carbon atoms (including carbon atoms of the substituent if any); and $R^{52}$, $R^{53}$, and $R^{54}$, which may be the same or different, each represents hydrogen or a substituted or unsubstituted alkyl group.

Examples of the substituent for the aryl group represented by $R^{51}$ are methyl, chlorine, amino, methylamino, acetylamino, methoxy, and methylsulfonamidoethyl. Examples of the aryl group represented by $R^{51}$ are phenyl, p-aminophenyl, p-chlorophenyl, p-acetamidophenyl and p-methoxyphenyl.

The alkyl group represented by $R^{52}$, $R^{53}$, and $R^{54}$ may be a substituted or unsubstituted, branched or cyclic alkyl group, having preferably from 1 to 8 carbon atoms (including carbon atoms of the substituent if any). Examples of the alkyl group are methyl, hydroxymethyl, ethyl and propyl, and examples of the substituent for the alkyl group are hydroxyl, carboxyl, and sulfo groups.

Specific examples of the 3-pyrazolidone compounds represented by formula (V) described above are illustrated below.

V-1: 1-Phenyl-3-pyrazolidone
V-2: 1-Phenyl-4,4-dimethyl-3-pyrazolidone
V-3: 1-Phenyl-4-methyl-4-hydroxymethyl-3-pyrazolidone
V-4: 1-Phenyl-4,4-dihydroxymethyl-3-pyrazolidone
V-5: 1-Phenyl-5-methyl-3-pyrazolidone
V-6: 1-Phenyl-4,4-dimethyl-3-pyrazolidone
V-7: 1-p-Aminophenyl-4-methyl-4-propyl-3-pyrazolidone
V-8: 1-p-Chlorophenyl-4-methyl-4-ethyl-3-pyrazolidone
V-9: 1-p-Acetamidophenyl-4,4-diethyl-3-pyrazolidone
V-10: 1-p-Methoxyphenyl-4,4-diethyl-3-pyrazolidone The hydrazine derivative which can preferably be used in the present invention is represented by the following formula (VIa):

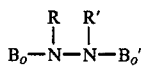

(VIa)

wherein $B_0$ represents an aliphatic group or an aromatic group; $B_0'$ represents a formyl group, an acyl group, an alkyl- or aryl-sulfonyl group, an alkyl- or arylsulfinyl group, a carbamoyl group, an alkoxy- or aryloxy-carbonyl group, a sulfinamoyl group, an alkoxysulfonyl group, a thioacyl group, a thiocarbamoyl group, a sulfamoyl group, a carbamoylcarbonyl group, an oxycarboxylcarbonyl group or a heterocyclic group; R and R' are both hydrogen atoms, or one of them is a hydrogen atom and the other represents a substituted or unsubstituted alkylsulfonyl group, a substituted or unsubstituted arylsulfonyl group or a substituted or unsubstituted acyl group; provided that $B_0'$ and R' and the adjacent nitrogen atom may form a hydrazone partial structure of

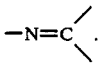

In formula (VIa), the aliphatic group for $B_0$ preferably has from 1 to 30 carbon atoms, and in particular a linear, branched or cyclic alkyl group having from 1 to 20 carbon atoms. The branched alkyl group may be cyclized so as to form a saturated heteroring containing one or more hetero atoms therein. The alkyl group may optionally have substituent(s) selected from an aryl group, an alkoxy group, a sulfoxy group, a sulfonamido group, a carbonamido group, etc.

For instance, there may be mentioned a t-butyl group, an n-octyl group, a t-octyl group, a cyclohexyl group, a pyrrolidyl group, an imidazolyl group, a tetrahydrofuryl group, a morpholino group as specific examples of the group.

In formula (VIa), the aromatic group for $B_0$ is a monocyclic or dicyclic aryl group or an unsaturated heterocyclic group. The unsaturated heterocyclic group may be condensed with a monocyclic or dicyclic aryl group to form a heteroaryl group.

For example, there may be mentioned a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring, etc. In particular, a benzene ring-containing group is preferred among them.

$B_0$ is especially preferably an aryl group.

The aryl group or unsaturated heterocyclic group for $B_0$ may have substituent(s). Specific examples of the substituents for the group include a linear, branched or cyclic alkyl group (preferably having from 1 to 20 carbon atoms), an aralkyl group (preferably a monocyclic o dicyclic group in which the alkyl moiety has from 1 to 3 carbon atoms), an alkoxy group (preferably having from 1 to 20 carbon atoms), a substituted amino group (preferably an amino group substituted by one or more alkyl groups having from 1 to 20 carbon atoms), an acylamino group (preferably having from 2 to 30 carbon atoms), an acylamino group (preferably having from 2 to 30 carbon atoms), a sulfonamido group (preferably having from 1 to 30 carbon atoms), a ureido group (preferably having from 1 to 30 carbon atoms), etc.

In formula (VIa), $B_0$ may contain a ballast group therein which is commonly used in photographic passive additives such as couplers, etc. The ballast group is a group which is relatively photographically inactive and which has 8 or more carbon atoms, and for example, can be selected from an alkyl group, an alkoxy group, a phenyl group, an alkylphenyl group, a phenoxy group, an alkylphenoxy group, etc.

In formula (VIa), $B_0$ may also contain a group therein which can strengthen the absorbency of the compound to the surface of the silver halide grains. As examples of such groups may be mentioned the thiourea groups, the heterocyclic thioamido groups, the mercaptoheterocyclic groups, the triazole groups and others described in U.S. Pat. Nos. 4,385,108 and 4,459,347, JP-A-No. 59-195233, JP-A-Nos. 59-200231, 59-201045, JP-A-No. 59-201046, JP-A-No. 59-201047, JP-A-No. 59-201048, JP-A-No. 59-201049, JP-A-No. 61-170733, JP-A-No. 61-270744 and JP-A-No. 62 948, and Japanese Patent Application Nos. 62-67508, 62-67509 and 62-67510, etc.

$B_0'$ represents a formyl group, an acyl group (e.g., acetyl, propionyl, trifluoroacetyl, chloroacetyl, benzoyl, 4-chlorobenzoyl, pyruvoyl, methoxalyl, methyloxamoyl, etc.), an alkylsulfonyl group (e.g., methanesulfonyl, 2-chloroethanesulfonyl, etc.), an arylsulfonyl group (e.g., benzenesulfonyl, etc.), an alkylsulfinyl group (e.g., methanesulfinyl, etc.), an arylsulfinyl group (e.g., benzenesulfinyl, etc.), a carbamoyl group (e.g., methylcarbamoyl, phenylcarbamoyl, etc.), a sulfamoyl group (e.g., dimethylsulfamoyl, etc.), an alkoxycarbonyl group (e.g., methoxycarbonyl, methoxyethoxycarbonyl, etc.), an aryloxycarbonyl group (e.g., phenoxycarbonyl, etc.), a sulfinamoyl group (e.g., methylsulfinamoyl, etc.), an alkoxysulfonyl group (e.g., methoxysulfonyl, ethoxysulfonyl, etc.), a thioacyl group (e.g., methylthiocarbonyl, etc.), a thiocarbamoyl group (e.g., methylthiocarbamoyl group, etc.), a sulfamoyl group (e.g., unsubstituted sulfamoyl, methylsulfamoyl, etc.), a carbamoylcarbonyl group (e.g., unsubstituted carbamoylcarbonyl, etc.) an oxycarbonylcarbonyl group (e.g., methoxycarbonylcarbonyl, phenoxycarbonylcarbonyl, etc.), or a heterocyclic group (e.g., a pyridine ring, etc.).

$B_0'$ is especially preferably a formyl group or an acyl group.

In formula (VIa), $B_0'$ and R' may form, together with the adjacent nitrogen atom, a hydrazone partial structure of:

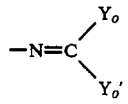

wherein $Y_0$ represents an alkyl group, an aryl group or a heterocyclic group; and $Y_0'$ represents hydrogen, an alkyl group, an aryl group or a heterocyclic group.

R and R' each represents hydrogen, an alkylsulfonyl or arylsulfonyl group having up to 20 carbon atoms (preferably a phenylsulfonyl group, or a phenylsulfonyl group substituted so that the total of the Hammett's substituent constants is −0.5 or more), or an acyl group having up to 20 carbon atoms (preferably a benzoyl group, a benzoyl group substituted so that the total of the Hammett's substituent constants is −0.5 or more), or a linear, branched or cyclic, unsubstituted or substituted aliphatic acyl group, the substituents for the group being selected, for example, from a halogen atom, an ether group, a sulfonamido group, a carbonamido group, a hydroxyl group, a carboxyl group and a sulfonic acid group. R and R' are most preferably hydrogen atoms.

As the hydrazine derivatives, those described in *Research Disclosure*, Item 23516 (November, 1983, page 346) and the references referred to therein as well as U.S. Pat. Nos. 4,080,207, 4,269,929, 4,276,364, 4,278,748, 4,385,108, 4,459,347, 4,560,638 and 4,478,928, British Patent No. 2,011,391B, JP-A-No. 60-179734, JP-A-No. 61-170733, JP-A-No. 61-270744, JP-A-No. 62-948, European Patent No. 217,310, Japanese Patent Application Nos. 61-175234, 61-251482, 61-268249, 61-276283, 62.-67508, 61-67509, 62-67510, 62-58513, 62-130819, 62-143469 and 62-166117 can also be used in the present invention, in addition to the above-mentioned examples.

Of those represented by formula (VIa), compounds represented by formula (VIb) are more preferably used:

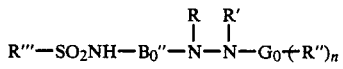

(VIb)

wherein $G_0$ represents a carbonyl group, a sulfonyl group, a sulfoxy group, a phosphoryl group, or an N-substituted or unsubstituted iminomethylene group, R'' represents hydrogen, an alkyl group, an aryl group, an alkoxy group, an aryloxy group, an amino group, a carbamoyl group, or an oxycarbonyl group, $B_0''$ represents a phenylene group or a naphthylene group, R''' represents an aliphatic group, an aromatic group, or a heterocyclic group, R and R' have the same meanings as defined above, and n is 1 or 2, provided that at least one of R'', R''' and $B_0''$ has a ballast group or an absorption acceleration group for silver halide.

The aliphatic group shown by R''' in formula (VIb) include a straight chain, branched or cyclic alkyl group, alkenyl group or alkinyl group.

The aromatic group shown by R''' in formula (VIb) include a monocyclic or bicyclic aryl group such as a phenyl group and a naphthyl group.

The heterocyclic group shown by R''' in formula (VIb) is a 3-membered to 10-membered saturated or unsaturated heterocyclic group containing at least one of N, O, and S, which may be a monocyclic ring or may form a condensed ring with other aromatic ring or heterocyclic ring. The heterocyclic ring group shown by R''' is preferably a 5-membered or 6-membered aromatic heterocyclic group such as a pyridine group, an imidazolyl group, a quinolinyl group, a benzimidazolyl group, a pyrimidyl group, a pyrazolyl group, an isoquinolinyl group, a thiazolyl group, or a benzothiazolyl group.

The groups shown by R''' may be substituted by a substituent such as, for example, an alkyl group, an aralkyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxy group and a hydroxyimino group. These groups shown above may, if possible, combine with each other to form a ring.

When $G_0$ in formula (VIb) is a carbonyl group, R'' is preferably hydrogen, an alkyl group (e.g., methyl, trifluoromethyl, 3-hydroxypropyl, and 3-methanesulfonamidopropyl), an aralkyl group (e.g., o-hydroxybenzyl), or an aryl group (e.g., phenyl, 3,5-dichlorophenyl, o-methanesulfonamidophenyl, and 4-methanesulfonylphenyl) and is particularly preferably a hydrogen atom.

When $G_0$ in formula (VIb) is a sulfonyl group, R'' is preferably an alkyl group (e.g., methyl), an aralkyl group (e.g., o-hydroxyphenylmethyl), an aryl group (e.g., phenyl), or a substituted amino group (e.g., dimethylamino).

When $G_0$ is a sulfoxy group, R'' is preferably a cyanobenzyl group or a methylthiobenzyl group.

When $G_0$ is an N-substituted or unsubstituted iminomethylene group, R'' is preferably a methyl group, an ethyl group, or a substituted or unsubstituted phenyl group.

When $G_0$ is a phosphoryl group, R'' is preferably a methoxy group, an ethoxy group, a butoxy group, a phenoxy group or a phenyl group, and particularly preferably a phenoxy group.

The substituents for the groups shown by R'' are an acyl group, an acyloxy group, an alkyloxycarbonyl group, an aryloxycarbonyl group, an alkenyl group, an alkinyl group, and a nitro group in addition to the substituents illustrated above for the groups shown by R'. These substituents may be further substituted and these groups shown above may, if possible, combine with each other to form a ring.

The ballast group which may be contained in R'', R''' or $B_0''$ is exemplified with those for $B_0$ in formula (VIa).

The sum of the total carbon atoms of R'', R''', and $B_0''$ (including carbon atoms of the substituents, if any) is at least 13, and preferably at least 21.

The absorption accelerating group for silver halide which can be contained in R'', R''', or $B_0''$ is represented by the formula,

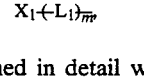

which will be explained in detail with respect to formula (VIc) below.

As the hydrazine derivative used in the present invention, compounds shown by formula (VIc) are particularly preferably used:

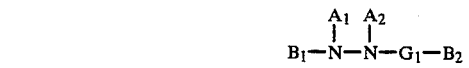

(VIc)

wherein $A_1$ and $A_2$, which may be the same or different, each represents hydrogen or one Of them represents hydrogen and the other represents a sulfinic acid group or an acyl group; $B_1$ represents an aliphatic group, an aromatic group or a heterocyclic group; $B_2$ represents hydrogen, an alkyl group, an aryl group, an alkoxy group, an aryloxy group, or an amino group; and $G_1$ represents a carbonyl group, a sulfonyl group, a sulfoxy group, a phosphoryl group or an iminomethylene group. At least one of $B_1$ and $B_2$ contains an adsorption acceleration group for silver halide.

In formula (VIc) described above, the aliphatic group represented by $B_1$ is a straight chain, branched or cyclic alkyl group, alkenyl group or alkynyl group.

The aromatic group represented by $B_1$ includes monocyclic and dicyclic aryl groups such as phenyl and naphthyl.

The heterocyclic ring represented by $B_1$ is a 3- to 10-membered saturated or unsaturated heterocyclic ring having at least one of N, O, and S, and the heterocyclic ring may be a single ring or form a condensed ring with an other aromatic ring or heterocyclic ring. The heterocyclic ring represented by $B_1$ includes 5- or 6-membered aromatic heterocyclic rings such as, for example, pyridine, imidazolyl, quinoliny), benzimidazolyl, pyrimidyl, pyrazolyl, isoquinolinyl, thiazolyl, and benzithiazolyl.

The group or the heterocyclic ring represented by $B_1$ may be substituted by a substituent such as an alkyl, aralkyl, alkoxy, aryl, substituted amino, acylamino, sulfonylamino, ureido, urethane, aryloxy, sulfamoyl, carbamoyl, alkylthio, arylthio, sulfonyl, sulfinyl, hydroxyl, halogen, cyano, sulfo and carboxyl group, and these substituents may be further substituted.

The groups may be, if possible, combined with each other to form a ring.

$B_1$ is preferably an aromatic group and more preferably an aryl group.

The group represented by $B_2$ is preferably as follows.

When G is a carbonyl group, $B_2$ is preferably hydrogen, an alkyl group (e.g., methyl, trifluoromethyl, 3-hydroxypropyl, and 3-methanesulfonamidopropyl), an aralkyl group (e.g., o-hydroxybenzyl), or an aryl group (e.g., phenyl, 3,5-dichlorophenyl, o-methanesulfonamidophenyl, and 4-methanesulfonylphenyl). In this case, $B_2$ is particularly preferably hydrogen.

When $G_1$ is a sulfonyl group, $B_2$ is preferably an alkyl group (e.g., methyl), an aralkyl group (e.g., o-hydroxyphenylmethyl), an aryl group (e.g., phenyl), or a substituted amino group (e.g., dimethylamino).

When $G_1$ is a sulfoxy group, $B_2$ is preferably cyanobenzyl or methylthiobenzyl.

When $G_1$ is a phosphoryl group, $B_2$ is preferably methoxy, ethoxy, butoxy, phenoxy or phenyl, and particularly preferably phenoxy.

When $G_1$ is an N-substituted or unsubstituted iminomethylene group, $B_2$ is preferably methyl, ethyl or substituted or unsubstituted phenyl.

The groups represented by $B_2$ each may be substituted by the substituent groups illustrated above for $B_1$, as well as other substituents such as acyl, acyloxy, alkoxycarbonyl, aryloxycarbonyl, alkenyl, alkinyl, and nitro.

These substituents may be further substituted by the substituent a described above and they may, if possible, combine with each other to form a ring.

The absorption accelerating agent for silver halide, which can be substituted to $B_1$ or $B_2$ includes those represented by the following formula:

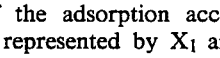

wherein $X_1$ represents an adsorption accelerating group for silver halide; $L_1$ represents a divalent linkage group; and m represents 0 or 1.

Preferred examples f the adsorption accelerating group for silver halide represented by $X_1$ are a thioamido group, a mercapto group, a group having a disulfide bond or a 5- or 6-membered nitrogen containing heterocyclic group.

The thioamido adsorption accelerating group represented by $X_1$ is a divalent group represented by the formula

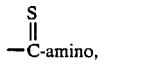

which may be a part of a ring structure or a noncyclic thioamido group.

Suitable thioamido groups are described in, for example, U.S. Pat. Nos. 4,030,925, 4,031,127, 4,080,207, 4,245,037, 4,255,511, 4,266,013, and 4,276,364, and *Research Disclosure,* Vol. 151, No. 15162 (Nov. 1976) and Vol. 176, No. 17626 (Dec. 1978).

Examples of the noncyclic thioamido group are thioureido, thiourethane, and dithiocarbamic acid ester and examples of the cyclic thioamido group are 4-thiazoline-2-thione, 4-imidazoline-2-thione, 2-thiohydrantoin, rhodanine, thiobarbituric acid, tetrazoline-5-thione, 1,2,4-triazoline-3-thione, 1,3,4-thiadiazoline-2-thione, 1,3,4-oxadiazoline-2-thione, benzimidazoline-2-thione, benzoxazoline-2-thione, and benzothiazoline-2-thione. These groups may be further substituted.

As the mercapto group shown by $X_1$, these are an aliphatic mercapto group, an aromatic mercapto group and a heterocyclic mercapto group (when the atom adjacent to the carbon atom is bonded to the —SH group, the group is same as a cyclic thioamido group which is a tautomer thereof, and examples of the group are same as those illustrated above).

As the 5- or 6-membered nitrogen-containing heterocyclic group represented by $X_1$, there are 5- or 6-membered nitrogen-containing heterocyclic rings composed of a combination of nitrogen, oxygen, sulfur and carbon. Preferred examples of the group are benzotriazole, triazole, tetrazole, indazole, benzimidazole, imidazole, benzothiazole, thiazole, benzoxazole, oxazole, thiadiazole, oxadiazole, and triazole. These groups may be further substituted by a proper substituent such as the substituent illustrated above for $B_1$.

Preferred examples of the group represented by $X_1$ are a cyclic thioamido group (e.g., a mercapto-substituted nitrogen-containing heterocyclic group, such as 2-mercaptothiadizole, 3 mercapto-1,2,4-triazole, 5-mercaptotetrazole, 2-mercapto-1,3,4-oxadiazole, and 2-mercaptobenzoxazole) and a nitrogen containing hetrocyclic group (e.g., benzotrizole, benzimidazole and indazole).

Also, $B_1$ or $B_2$ may be substituted with two or more groups represented by $$X_1\text{-}(L_1)_m$$

and these groups may be the same or different.

The divalent linkage group shown by $L_1$ is an atom such as C, N, S, and O or an atomic group having at least one of C, N, S, and O. Specific examples of $L_1$ are an alkylene group, an alkenylene group, an alkynylene group, an arylene group, —O—, —S—, —NH—, —N=, —CO—, and —$SO_2$— (they may have a substituent) or a combination thereof.

Examples of $L_1$ are as follows:

—CONH—, —NHCONH—, —$SO_2$NH—,

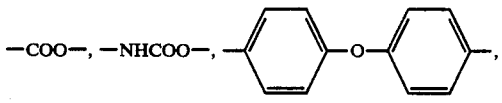

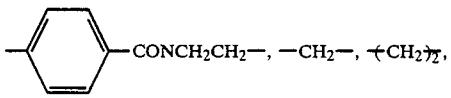

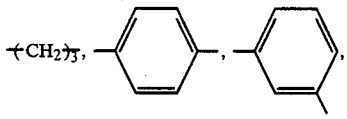

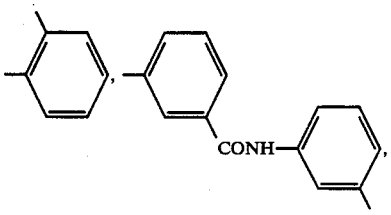

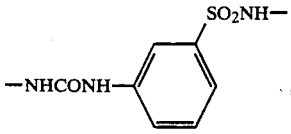

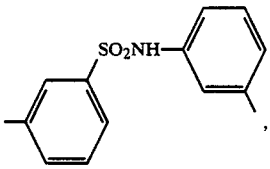

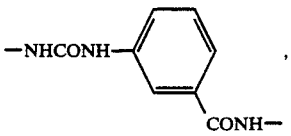

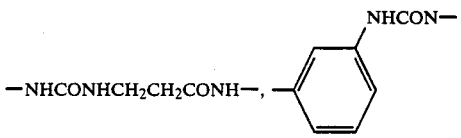

-continued

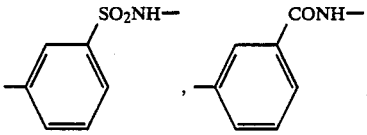

—$CH_2CH_2SO_2NH$—, —$CH_2CH_2CON$—,

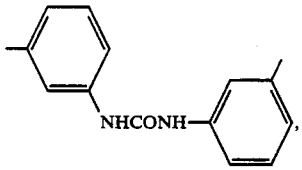

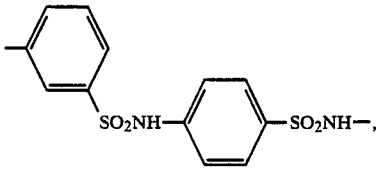

These groups may be further substituted by a substituent such as the substituent illustrated above for $B_1$.

In formula (VIc) described above, $A_1$ and $A_2$ each represents hydrogen, an alkylsulfonyl or arylsulfonyl group (preferably phenylsulfonyl or phenylsulfonyl substituent such that the sum of the Hammett's substituent constants is at least −0.5); an acyl group having at most 20 carbon atoms (preferably benzoyl or benzoyl substituted such that the sum of the Hammett's substituent constants is at least −0.5) or a substituted or unsubstituted straight chain, branched or cyclic aliphatic acyl group (examples of the substituent are halogen, ether, sulfonamido, carbonamido, hydroxyl, carboxyl, and sulfonic acid). Examples of the sulfinic acid group shown by $A_1$ and $A_2$ are described in U.S. Pat. No. 4,478,928.

$A_1$ and $A_2$ are most preferably hydrogen.

Also, $G_1$ in formula (VIc) is most preferably a carbonyl group.

The hydrazone derivative represented by formula (VIc) described above is preferably represented by formula (VII):

$$X_1\text{-}(L_1)_m B_1'\text{-}\overset{A_1}{\overset{|}{N}}\text{-}\overset{A_2}{\overset{|}{N}}\text{-}G_1\text{-}B_2 \qquad \text{(VII)}$$

wherein $B_1'$ represents a group represented by $B_1$ in formula (VIc), from which one hydrogen atom is removed. At least one of $B_1'$, $B_2$ and $L_1$ contains a group capable of being dissociated into an anion having a pKa of at least 6 or an amino group.

As the group capable of being dissociated into an anion having pKa of at least 6, a substituent capable of being dissociated into an anion of pKa of from 8 to 13 is preferred. A substituent which scarcely dissociates in a neutral or weak acid medium and sufficiently dissociates in an alkaline aqueous solution (having, preferably, a pH of from 10.5 to 12.3) such as a developer can be used without specific restriction.

Examples of such a group are a hydroxyl group, a group $SO_2NH$—, a hydroxyimino group

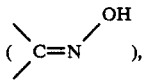

an active methylene group and an active methine group (e.g.,

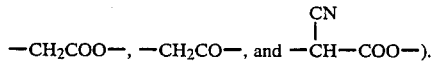

Also, the amino group represented by $B_1'$, $B_2$ or $L_1$ may be a primary, secondary or tertiary amino group, and an amino group the pKa of the conjugate acid of which is at least 6.0 is preferred.

In formula (VIII), $A_1$, $A_2$, $G_1$, $B_2$, $L_1$, $X_1$ and m are same as those described above for formula (VIc).

The hydrozone derivative represented by formula (VII) is particularly preferably represented by formula (VIII):

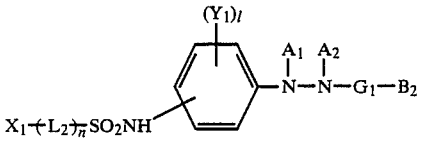

(VIII)

wherein $L_2$ has the same definition as $L_1$ of formula (VIc) and (VII); $Y_1$ has the same definition as the substituent for $B_1$ of formula (VIc); n is 0 or 1; l is 0, 1 or 2, and when l is 2, the $Y_1$ groups may be the same or different.

$A_1$, $A_2$, $G_1$, $B_2$, and $X_1$ have the same definition as in formula (VIc) and (VII).

In a more preferred embodiment,

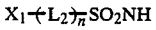

is substituted at the p-position to the hydrazino group.

Specific examples of the compound represented by formula (VIc) are illustrated below, but the invention is not to be construed as being limited to these compounds.

VI-1

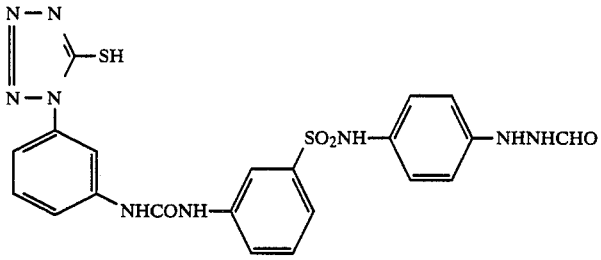

VI-2

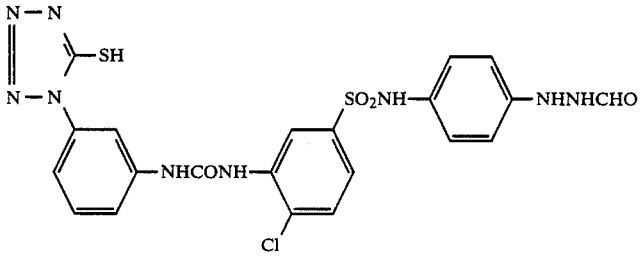

VI-3

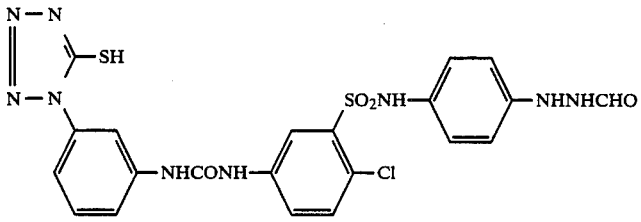

VI-4

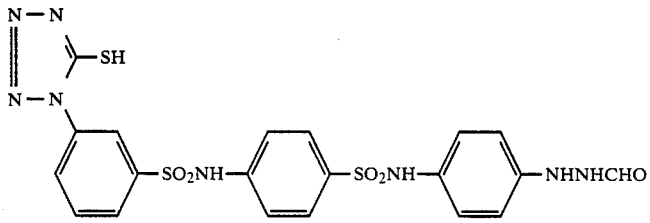

-continued
VI-5
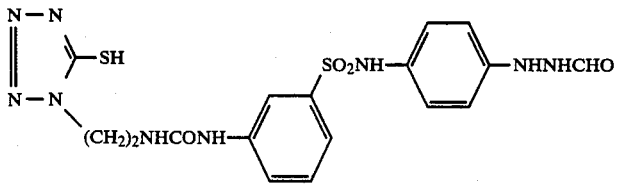
VI-6
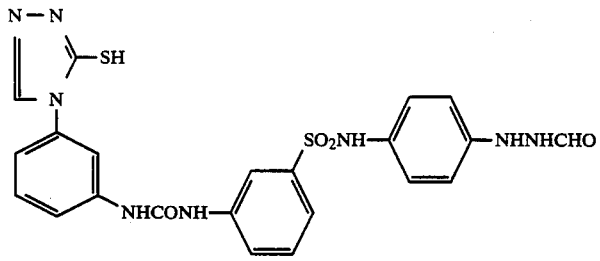
VI-7
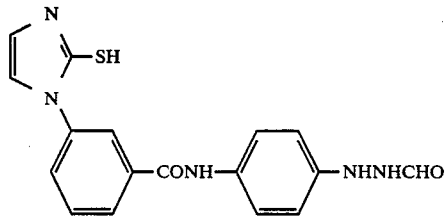
VI-8
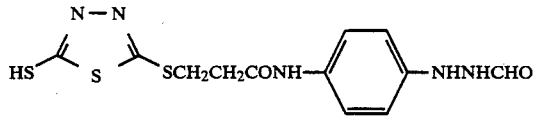
VI-9
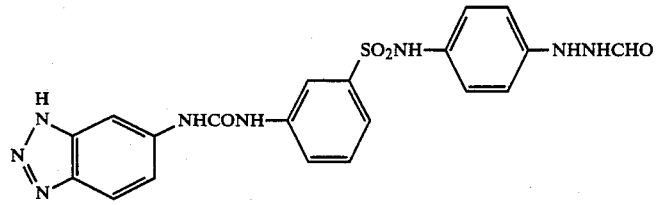
VI-10
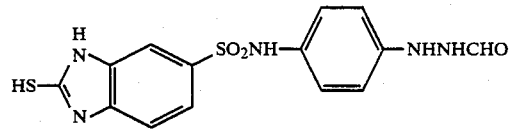
VI-11
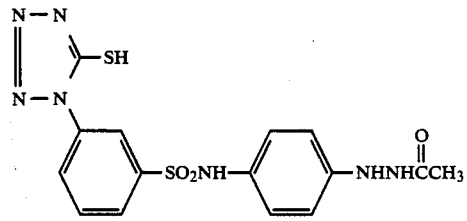
VI-12
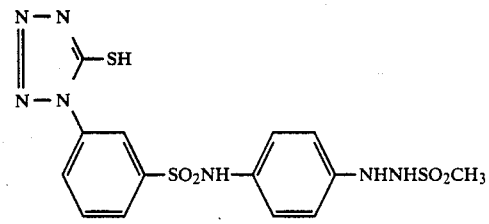

-continued
VI-13
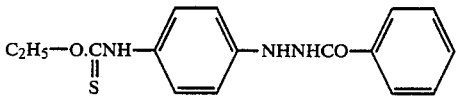
VI-14
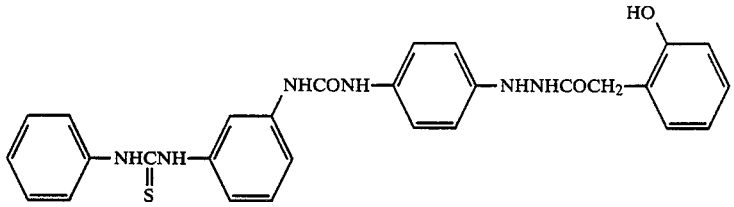
VI-15
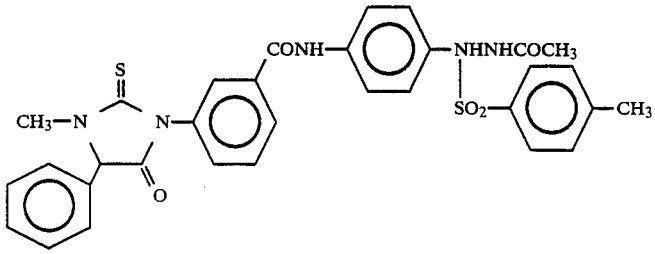
VI-16
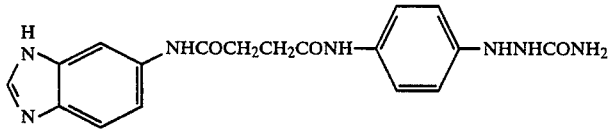
VI-17
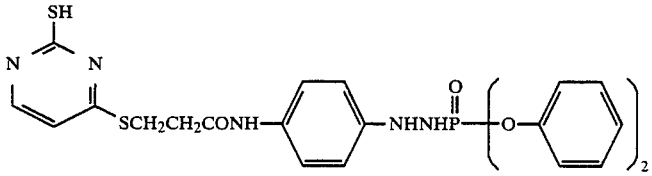
VI-18
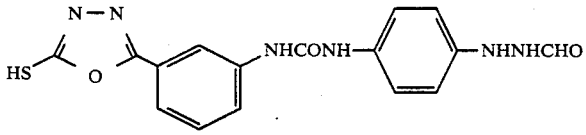
VI-19
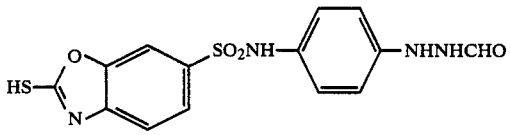
VI-20
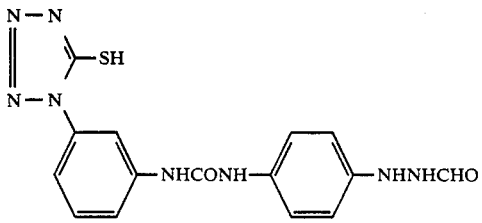

-continued
VI-21
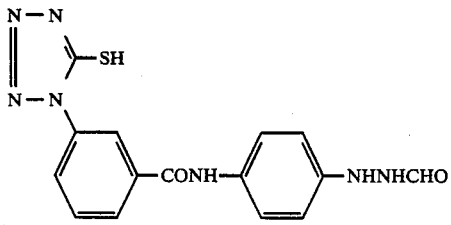
VI-22
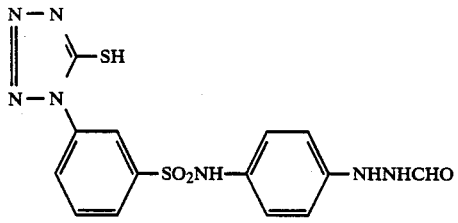
VI-23
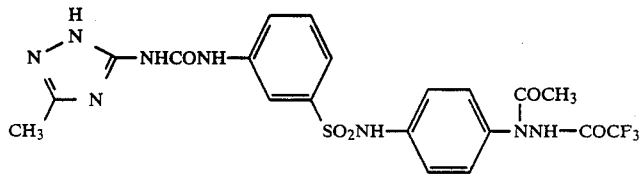
VI-24
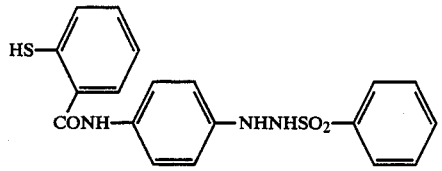
VI-25
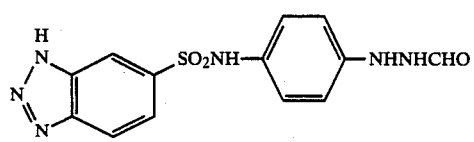
VI-26
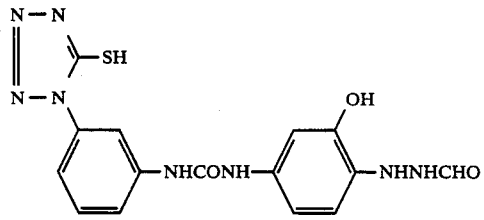
VI-27
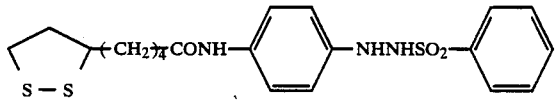
VI-28
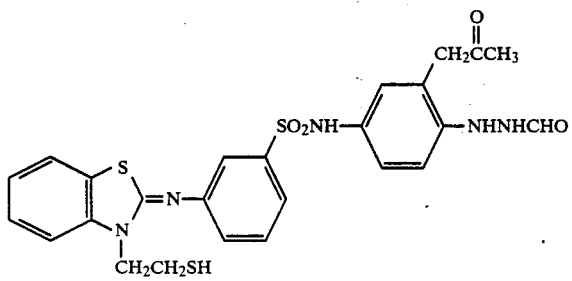

-continued
VI-29
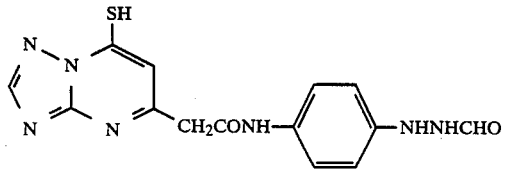
VI-30
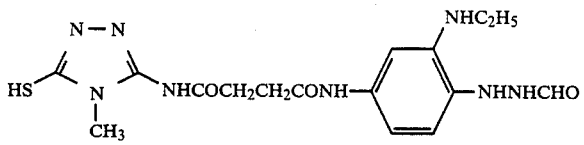
VI-31
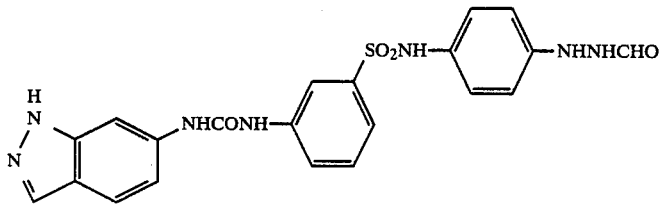
VI-32
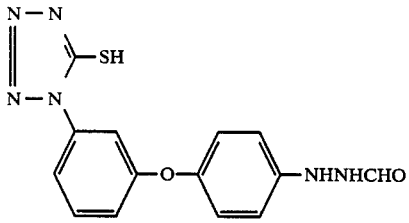
VI-33
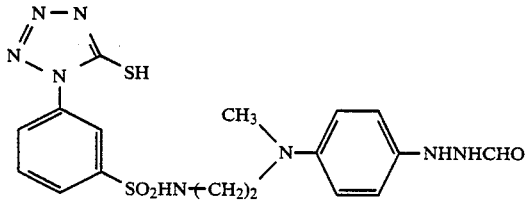
VI-34
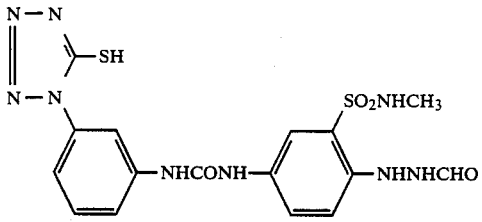
VI-35
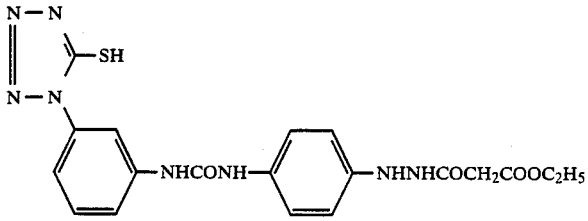
VI-36
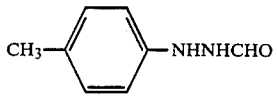

-continued
VI-37
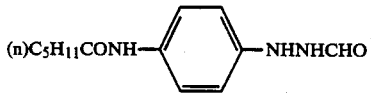
VI-38
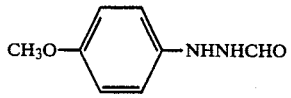
VI-39
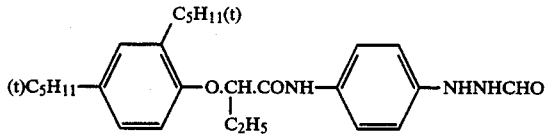
VI-40
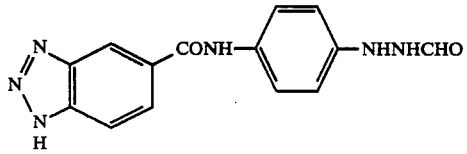
VI-41
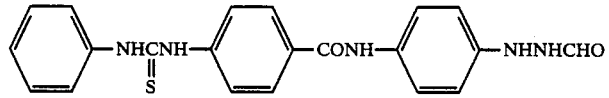
VI-42
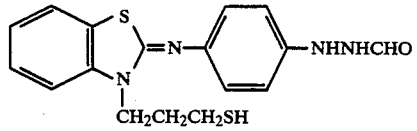
VI-43
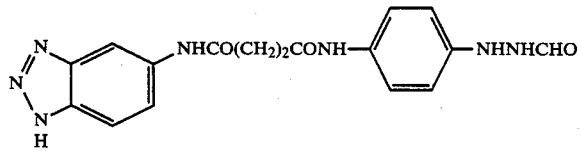
VI-44
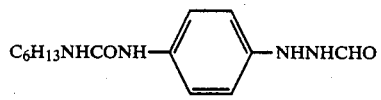
VI-45
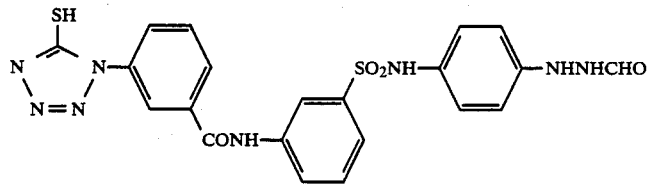
VI-46
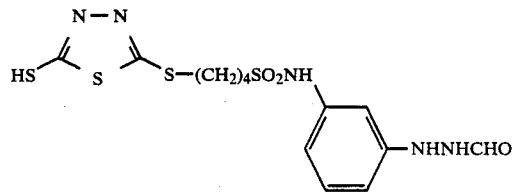

-continued

VI-47

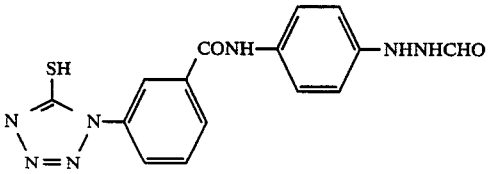

VI-48

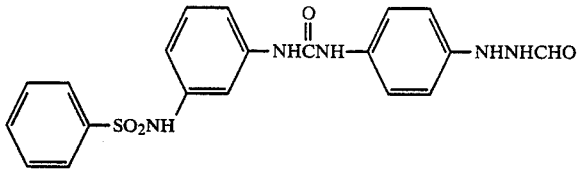

VI-49

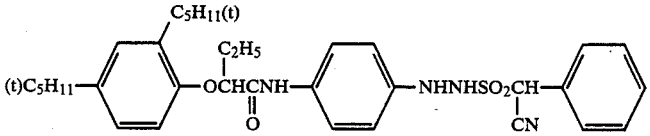

VI-50

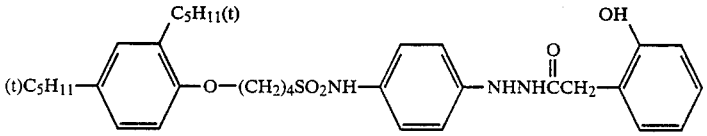

VI-51

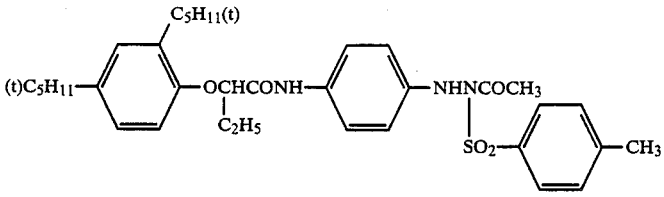

VI-52

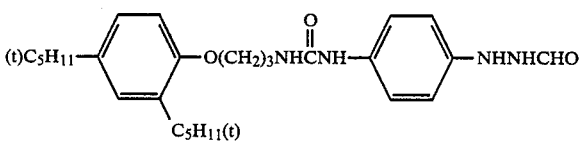

VI-53

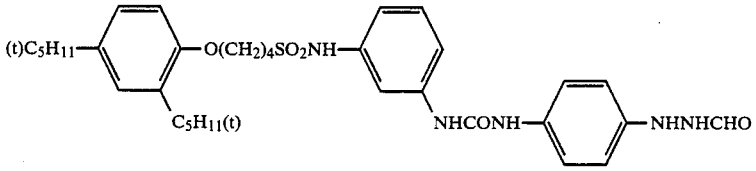

VI-54

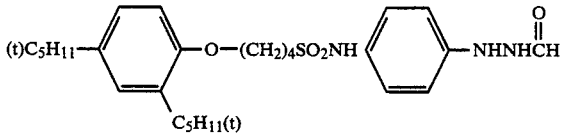

VI-55

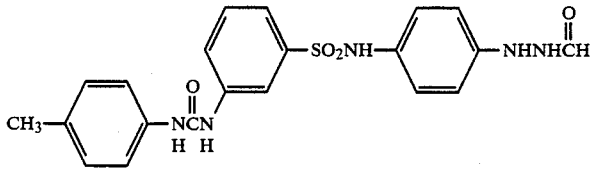

In this invention, when the hydrazine derivative described above is incorporated in the photographic light-sensitive material of this invention, it is preferred to incorporate the hydrazine derivative in the silver halide emulsion layer(s) thereof but the compound may be incorporated in other light-insensitive hydrophilic colloidal layer(s) (e.g., a protective layer, interlayers, filter layer and antihalation layer. The hydrazine derivative may be incorporated in the layer containing the compound represented by formula (I), but preferably in a different layer.

When the hydrazine derivative is later soluble, the derivative may be added to a solution of hydrophilic colloid as an aqueous solution thereof and when the drivative is sparingly soluble in water, it may be added to the solution as a solution in an organic solvent miscible with water, such as alcohols, esters, and ketones. When the drivative is incorporated in the silver halide emulsion layer, the drivative may be added to the emulsion at any time from the initiation of chemical ripening of the emulsion to a time before coating the emulsion, but the drivative is preferably added thereto after the completion of chemical ripening and before coating. In particular, it is preferred to add the drivative to a coating composition prepared for coating.

The content of the hydrazine derivative is selected according to the grain size of the silver halide emulsion, the halogen composition thereof, the method and extent of chemical sensitization, the relation of the layer in which the drivative is incorporated to a silver halide emulsion layer, and the antifoggant. The method for the selection is well known to persons skilled in the art. The amount is preferably from $1\times10^{-6}$ mole to $1\times10^{-1}$ mole, and particularly from $1\times10^{-5}$ mole to $1\times10^{-2}$ mole per mole of silver in all silver halide emulsion layers in the photographic light-sensitive material.

The hydrazine derivative for use in this invention may be used together with a conventionally known hydrazine compound. Specific examples of such a hydrazine compound are described in JP A-53-2092, JP-A-53-20922, and JP-A-53-20318. The proportion (by weight) of such a hydrazine compound used together with the hydrazine derivative of the present invention is from 0.01 to 100 times, and preferably from 0.1 to 10 times the amount of the hydrazine derivative.

Also, the use of at least one of the compounds represented by the following formulae IX or (X) together with the hydrazone derivative is preferred since the storage stability of the high contrast silver halide photographic material of this invention with the passage of time is improved:

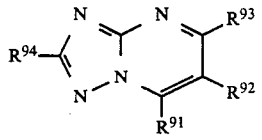
(IX)

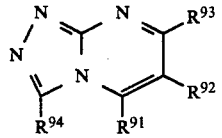
(X)

wherein $R^{91}$, $R^{92}$, $R^{93}$, and $R^{94}$, which may be the same or different, each represents hydrogen, an alkyl group, an aryl group, an amino group, a hydroxyl group, are alkoxy group, an alkylthio group, a carbamoyl group, a halogen atom, a cyano group, a carboxyl group, an alkoxycarbonyl group or a heterocyclic group and $R^{91}$ and $R^{92}$ or $R^{92}$ and $R^{93}$ may be linked to form a 5- or 6-membered ring; provided that at least one of $R^{91}$ and $R^{93}$ represents a hydroxyl group.

More specifically, $R^{91}$, $R^{92}$, $R^{93}$, and $R^{94}$ each represents hydrogen; a substituted or unsubstituted alkyl group having from 1 to 20 carbon atoms, which may be straight, cyclic or branched; a monocyclic or dicyclic substituted or unsubstituted aryl group; a substituted or unsubstituted amino group; a hydroxyl group; an alkoxy group having from 1 to 20 carbon atoms; an alkylthio group having from 1 to 6 carbon atoms; a carbamoyl group which may be substituted by an aliphatic group or an aromatic group; a halogen atom; a cyano group; a carboxyl group; an alkoxycarbonyl group having from 2 to 20 carbon atoms; or a 5- or 6-membered heterocyclic group containing a hetero atom such as nitrogen, oxygen, and sulfur.

Examples of the unsubstituted alkyl group are methyl, ethyl, n-propyl, i propyl, n-butyl, t-butyl, hexyl, cyclohexyl, cyclopentylmethyl, octyl, dodecyl, tridecyl and heptadecyl. Examples of the substituent for the substituted alkyl group are ;monocyclic or dicyclic aryl or heterocyclic groups, a halogen atom, carboxyl, an alkoxycarbonyl group having from 2 to 6 carbon atoms, an alkoxy group having less than 20 carbon atoms, and hydroxyl. Specific examples of the substituted alkyl group are benzyl, phenethyl, chloromethyl, 2-chloroethyl, trifluoromethyl, carboxylmethyl, 2-carboxyethyl, 2-(methoxycarbonyl)ethyl, ethoxycarbonylmethyl, 2-methoxyethyl, hydroxymethyl, and 2-hydroxyethyl.

Examples of the unsubstituted aryl group are phenyl and naphthyl and examples of the substituent for the substituted aryl group are an alkyl group having from 1 to 4 carbon atoms, a halogen atom, nitro, carboxyl, an alkoxycarbonyl group having from 2 to 6 carbon atoms, hydroxyl, and an alkoxy group having from 1 to 6 carbon atoms. Specific examples cf the substituted aryl group are p-tolyl, m-tolyl, p-chlorophenyl, p-bromophenyl, o-chlorophenyl, m-nitrophenyl, p-carboxyphenyl, o-carboxyphenyl, o-(methoxycarbonyl)-phenyl, p-hydroxyphenyl, p-methoxyphenyl, and m-ethoxyphenyl.

The amino group represented by $R^{91}$, $R^{92}$, $R^{93}$, and $R^{94}$ may be substituted an examples of the substituent are an alkyl group (e.g., methyl, ethyl, and butyl) and an acyl group (e.g., acetyl and methylsulfonyl). Specific examples of the substituted amino group are dimethylamino, diethylamino, butylamino and acetylamino.

Specific examples of the alkoxy group represented by $R^{91}$, $R^{92}$, $R^{93}$, and $R^{94}$ are methoxy, ethoxy, butoxy, and heptadecyloxy.

The carbamoyl group represented by $R^{91}$, $R^{92}$, $R^{93}$, and $R^{94}$ can have one or two alkyl groups having from 1 to 20 carbon atoms or one or monocyclic or dicyclic aryl groups as substituents. Specific examples of the substituted carbamoyl group are methylcarbamoyl, dimethylcarbamoyl, ethylcarbamoyl, and phenylcarbamoyl.

Specific examples of the alkoxycarbonyl group represented by $R^{91}$, $R^{92}$, $R^{93}$, and $R^{94}$ are methoxycarbonyl, ethoxycarbonyl and butoxycarbonyl.

Specific examples of the halogen atom represented by $R^{91}$, $R^{92}$, $R^{93}$, and $R^{94}$ are chlorine and bromine.

The heterocyclic group represented by $R^{91}$, $R^{92}$, $R^{93}$, and $R^{94}$ may be single ring or a condensed ring of two or three rings and specific examples thereof are furyl, pyridyl, 2-(3-methyl)benzothiazolyl, and 1-benzotriazolyl.

Specific examples of the ring formed by $R^{91}$ and $R^{92}$ or by $R^{92}$ and $R^{93}$ are cyclopentane, cyclohexane, cyclohexene, benzene, furan, pyridine, and thiophene.

When $R^{94}$ represents a substituted alkyl group, the substituent may be heterocyclic ring and the substituted alkyl group represented by following formula is preferred.

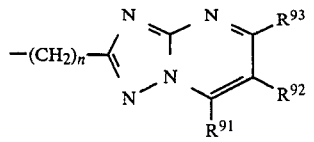

wherein $R^{91}$, $R^{92}$, and $R^{93}$, have the same definition as above and n is 2 to 4.

Specific examples of the compound represented by formula (IX) or (X) are illustrated below, but the present invention is not to be construed as being limited thereto.

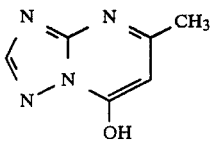

(IX-1)

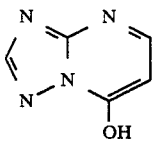

(IX-2)

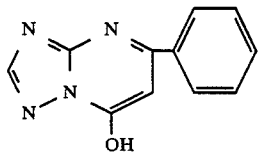

(IX-3)

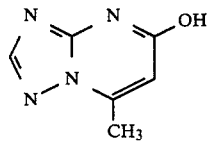

(IX-4)

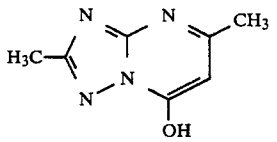

(IX-5)

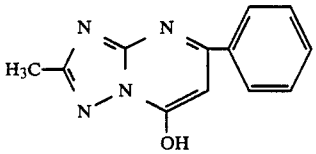

(IX-6)

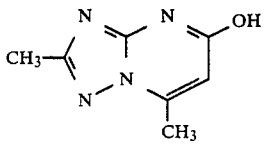

(IX-7)

-continued

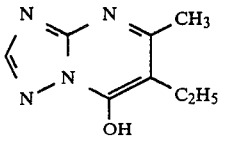

(IX-8)

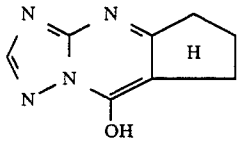

(IX-9)

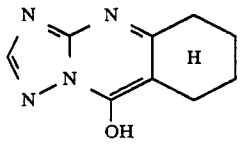

(IX-10)

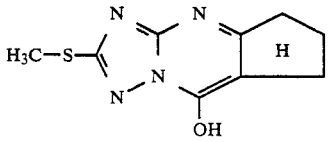

(IX-11)

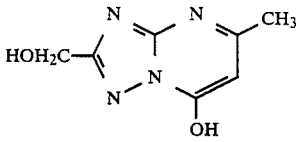

(IX-12)

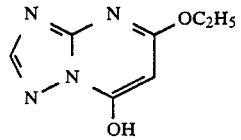

(IX-13)

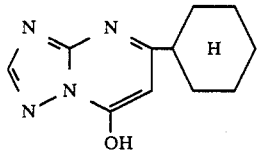

(IX-14)

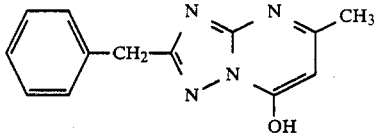

(IX-15)

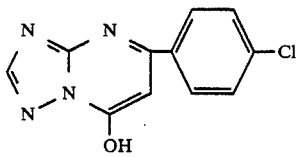

(IX-16)

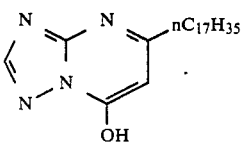

(IX-17)

-continued (IX-18)

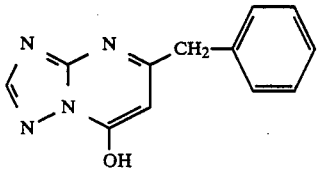

(IX-19)

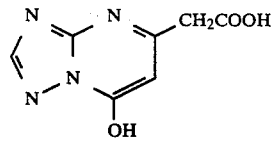

(IX-20)

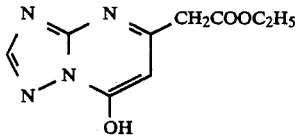

(IX-21)

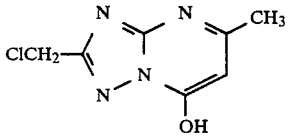

(IX-22)

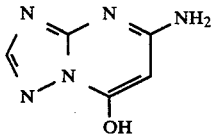

(IX-23)

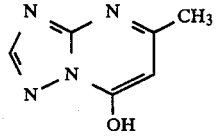

(IX-24)

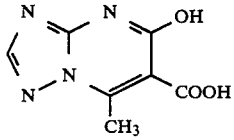

(IX-25)

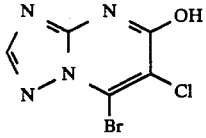

(IX-26)

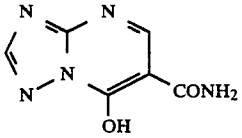

(IX-27)

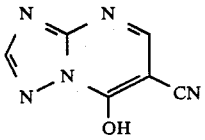

-continued (IX-28)

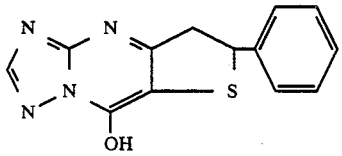

(IX-29)

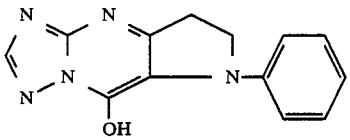

(IX-30)

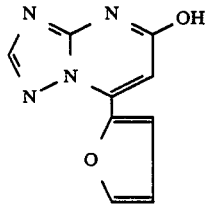

(IX-31)

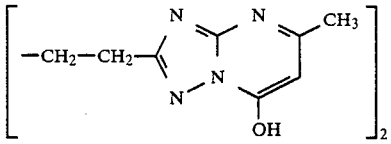

(IX-32)

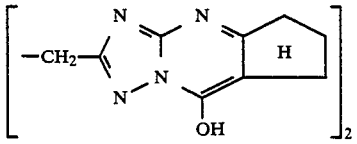

(X-1)

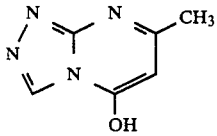

(X-2)

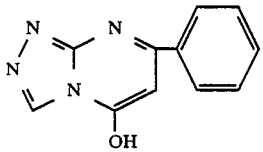

(X-3)

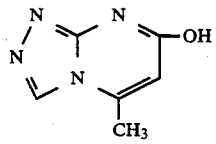

The compounds represented by formula (IX) described above can be easily synthesized by referring to the descriptions of Bölow and Haas, *Berichte,* Vol. 42, 4638 (1907), ibid., Vol. 43, 375 (1910), Allen et al, *Journal of Organic Chemistry,* Vol. 24, 796 (1959), De Cat and Dormael, *Bull. Soc. Chem. Belg.,* Vol. 60, 69 (1951), and Cook et al, *Rec. Trav. Chem.,* Vol. 69, 343 (1950).

Also, the compounds represented by formula (X) can be easily synthesized by referring to the descriptions of Bower and Doyle, *Journal of Chemical Society,* 727

(1957), And Allen et al, *Journal of Organic Chemistry*, Vol. 24, 787 (1959).

When the compound shown by formula (IX) or (X) is incorporated in the photographic light sensitive material of this invention, the compound may be incorporated in the silver halide emulsion layer or other light-insensitive layer such as a protective layer, an interlayer, a filter layer or an antihalation layer.

The compound of formula (IX) or (X) is present in the range of from $10^{-5}$ to $3\times10^{-1}$ mole, and particularly from $3\times10^{-4}$ to $10^{-1}$ mole per mole of silver in all silver halide emulsion layers in the photographic light-sensitive material and it is preferred to select the content of the compound according to the grain size of the silver halide emulsion, the halogen composition of the silver halide, the method and extent of chemical sensitization for the emulsion, the relation of the layer in which the compound is incorporated and a silver halide emulsion layer, and the kind of antifoggant. The method for the selection is well known to a person skilled in the art.

For incorporating the compound of formula (XI) or (X) in a silver halide emulsion layer or light-insensitive layer of the photographic light-sensitive material of this invention, the compound may be added to the silver halide emulsion or the coating composition for the light-insensitive layer and the same method as described above for incorporating the hydrazine derivative in a silver halide emulsion can be used. When the compound is sparingly soluble in water, the compound may be added thereto as a solution in a water-miscible organic solvent such as an alcohol (e.g., methanol and ethanol), an ester (e.g., ethyl acetate), and a ketone (e.g., acetone), and when the compound is soluble in water, the compound may be added thereto an aqueous solution. An alkaline aqueous solution thereof is sometimes convenient for dissolving the compound.

In the case of adding the compound to a silver halide emulsion, the compound may be added thereto at any time from the initiation of chemical ripening to a time before coating the emulsion, but is preferably added to the coating composition prepared for coating.

As a hydrophilic colloid for dispersing the compound represented by formula (I), the reducing agent, and a binder for the silver halide emulsion and other light-insensitive layers of the photographic light-sensitive material of this invention, gelatin is advantageously used but other hydrophilic colloids may be used.

Examples of such hydrophilic colloids are gelatin derivatives; graft polymers of gelatin and other polymers; proteins such as albumin, casein; cellulose derivatives such as hydroxyethyl cellulose, carboxymethyl cellulose, cellulose sulfuric acid ester; saccharose derivatives such as sodium alginate, dextran, starch derivatives; .and synthetic hydrophilic homopolymers or copolymers such as polyvinyl alcohol, polyvinyl alcohol partial acetal, poly N-vinylpyrrolidone, polyacrylic acid, polymethacrylic acid, polyacrylamide, polyvinylimidazole and polyvinylpyrazole.

As gelatin, limed gelatin as well as acid-treated gelatin or enzyme-treated gelatin can be used.

For the silver halide emulsion for the high contrast photographic light-sensitive material which is suitably used for a photographic process for making printing plates, silver chloride, silver chlorobromide, silver iodobromide, silver iodochlorobromide, may be used, but in the case of the daylight type photographic light-sensitive material, a silver halide composed of at least 60 mole %, and particularly at least 75 mole % silver chloride, i.e., silver chlorobromide or silver chloroiodobromide containing from 0 to 5 mole % silver bromide is preferred. The increase of the content of silver bromide or silver iodide reduces the safe-light safety of the light sensitive material or decreases the contrast of the light sensitive material.

For incorporating rhodium in the silver halide grains, a rhodium salt of any form such as a single salt, or complex salt, may be added to the emulsion at the formation of silver halide grains.

As the rhodium salt, there are rhodium monochloride, rhodium dichloride, rhodium trichloride and ammonium hexachlororhodates. Preferred rhodium salts are water-soluble halogen complex compounds of trivalent rhodium such as hexachlorhodic (III) acid and the salts thereof (ammonium salt, sodium salt, potassium salt).

The addition amount of the water-soluble rhodium salt is from $1.0\times10^{-6}$ mole to $1.0\times10^{-3}$ mole, preferably from $1.0\times10^{-5}$ mole to $1.0\times10^{-3}$ mole, and particularly preferably from $5.0\times10^{-5}$ mole to $5.0\times10^{-4}$ mole per mole of silver halide.

If the content of the rhodium salt is higher than $10^{-3}$ mole per mole of silver halide, it becomes impossible to sufficiently increase the contrast of the photographic light-sensitive material. On the other hand, if the content thereof is less than $10^{-6}$ mole, it becomes impossible to reduce the sensitivity suitable for the daylight type photographic light-sensitive material.

The silver halide which is used for the high-contrast photographic light-sensitive material of this invention is preferably a core-shell type silver halide, and particularly preferably a core/shell type silver halide having a higher rhodium content in the shell than in the core.

For incorporating the water-soluble rhodium salt in silver halide grains, it is preferred to add the rhodium salt to an aqueous solution of water-soluble silver salt or an aqueous halide solution when both the solutions are mixed together. Or in another embodiment, when an aqueous silver salt solution is mixed with an aqueous halide solution, the rhodium salt may be added as the third aqueous solution.

The grain size of the silver halide emulsion which is used for the high contrast photographic light-sensitive material of this invention is preferably less than 0.15 $\mu$m, and more preferably less than 0.12 $\mu$m as fine grain emulsion.

For preparing the fine grain silver halide emulsion for the high-contrast light-sensitive material of this invention, good results are obtained by mixing the solutions at a reaction temperature lower than 50° C., preferably lower than 40° C., and more preferably lower than 30° C., at a sufficiently high mixing rate for uniformly mixing them, at a silver potential cf higher than 100 mV, preferably of from 150 mV to 400 mV, and at pH of from 3 to 8, and preferably from 5 to 7.

In the case of forming fine silver chloride grains, grain growth sometimes occurs even in the washing step or dispersion step owing to the high solubility thereof and hence the reaction temperature may be lower than 35° C. or a nucleic acid, a mercapto compound, a tetraazaindene compound, may be added to the system for restraining the growth of the silver halide grains.

Fundamentally, there is no restriction on the grain size distribution of the silver halide emulsion for use in this invention but a monodisperse emulsion is preferred.

The monodisperse emulsion is an emulsion composed of silver halide grains at least 95% by weight or by number of which are within ±40%, and preferably within ±20% of the mean grain size thereof.

The silver halide grains for the high contrast light sensitive material of this invention preferably have a regular crystal form such as cubic and octahedral, and are more preferably cubic.

The silver halide grains for the high-contrast light-sensitive material may contain a cadmium salt, a lead salt, a thallium salt, or an iridium salt in addition to the rhodium salt.

The silver halide emulsion for the high-contrast photographic light-sensitive material of this invention may not be chemically sensitized but may be chemically sensitized. As the chemical sensitization method for the silver halide emulsion, there are a sulfur sensitization method, a reduction sensitization method and a noble metal sensitization method, and these methods can be used singly or as a combination thereof.

In noble metal sensitization, a gold sensitization method is typical and a gold compound such as a gold complex salt is used. The silver halide emulsion may contain a complex salt of another noble metal than gold, such as platinum, palladium, iridium. Specific examples thereof are described in U.S. Pat. No. 2,448,060 and British Patent No. 618,061.

For the sulfur sensitization, sulfur compounds contained in gelatin and also various sulfur compounds such as thiosulfates, thioureas, thiazoles and rhodanines can be used as the sulfur sensitizer.

Also, for the reduction sensitization, stannous salts, amines, formamidinesulfinic acid and silane compounds, can be used as the reduction sensitizer.

The high-contrast silver halide photographic material of this invention may contain an organic desensitizer. An organic desensitizer having at least one water solubilizing group or an alkali dissociable group is preferably used.

The organic desensitizer for use in this invention is defined by the polarographic half wave potential, that is the oxidation reduction potential determined by polarography and is suitable when the sum of the polarographic anodic potential and the polarographic cathodic potential is positive.

The measurement method of the oxidation reduction potential by polarography is described, for example, in U.S. Pat. No. 3,501,307. As the water solubilizing group for the organic desensitizer, there are sulfonic acid group, a carboxylic acid group and a phosphonic acid group, and these groups each may form a salt with an organic base (e.g., ammonia, pyridine, triethylamine, piperidine, and morpholine) or an alkali metal (e.g., sodium and potassium).

The alkali dissociable group for the organic desensitizer is a substituent which undergoes a deprotonation reaction at the pH of a developer (usually in the range of from 9 to 13 but a developer having another pH value may be used) or a pH lower than this pH to become an anionic group. Specifically, the group is a substituent having at least one hydrogen atom bonded to a nitrogen atom by a substituent (such as a substituted or unsubstituted sulfamoyl group, a substituted or unsubstituted carbamoyl group, a sulfonamido group, an acylamino group, a substituted or unsubstituted ureido group) or a hydroxy group.

Also, a heterocyclic group having a hydrogen atom on the nitrogen atom forming the heterocyclic ring of a nitrogen-containing heterocyclic ring is included in the alkali dissociable group.

The water-solubilizing group(s) or the alkali dissociable group(s) may be connected to any portion(s) of the organic desensitizer and the desensitizer may have two or more such groups.

Specific examples of the preferred organic desensitizers for use in this invention are described in Japanese Patent Application No. 61-209169, and several examples of them are shown below, but the present invention is not to be construed as being limited thereto.

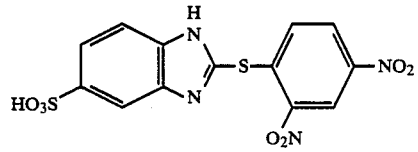

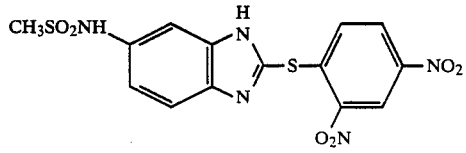

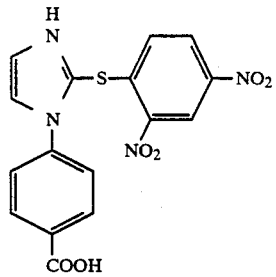

It is preferred that the organic desensitizer be present in the silver halide emulsion in a content of from $1.0\times10^{-8}$ to $1.0\times10^{-4}$ mole/m$^2$, and particularly from $1.0\times10^{-7}$ to $1.0\times10^{-5}$ mole/m$^2$.

The silver halide emulsion layer or other hydrophilic colloid layer of the photographic light-sensitive material of this invention may contain a water-soluble dye together with the compound having LA represented by formula (I), as a filter dye or for other purposes such as irradiation prevention.

As the filter dye, a dye for further reducing the photographic sensitivity and preferably an ultraviolet absorbent having a spectral absorption maximum at the specific sensitivity region of silver halide, or a dye absorbing light mainly in the region of from 350 nm to 600 nm, for increasing the safety to safelight at the case of handling the photographic light-sensitive material under daylight is used.

The filter dye is added in the range of from $10^{-2}$ g/m$^2$ to 1 g/m$^2$, and preferably from 10 mg/m$^2$ to 100 mg/m$^2$ although the amount depends upon the mole extinction coefficient of the dye.

Specific examples of the dye are described in Japanese Patent Application No. 61-209169 and some of them are illustrated below, but the present invention is not to be construed as being limited thereto.

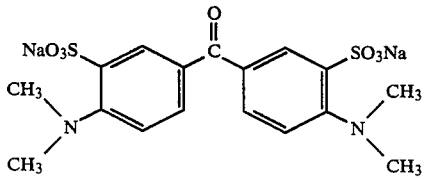

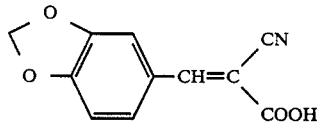

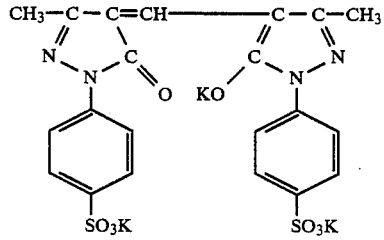

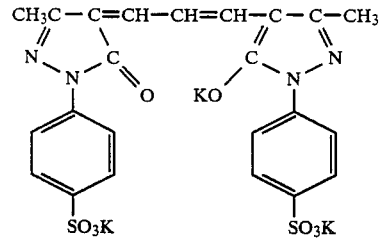

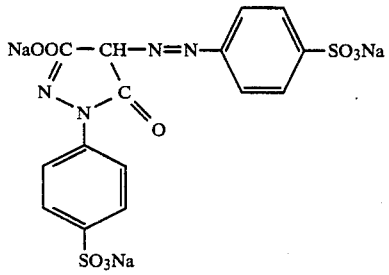

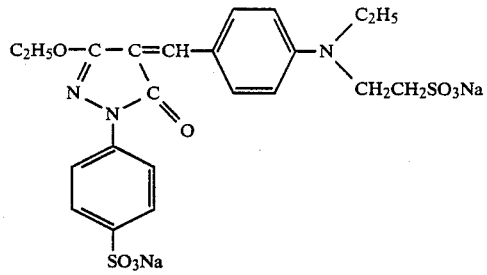

The dye is added to the coating composition for the light-sensitive hydrophilic colloid layer as a solution in a proper solvent such as water, alcohols (e.g., methanol, ethanol, and propanol), acetone, methylcellosolve, and a mixture thereof.

The silver halide emulsion layer(s) for the high-contrast photographic light-sensitive material of this invention may contain a spectral sensitizing dye but preferably does not contain such a dye.

The photographic emulsion layers and other hydrophilic colloid layers of the photographic light-sensitive materials of this invention may further contain various surface active agents in addition to the amphoteric surface active agents for use in this invention as coating aid, static prevention, the improvement of lubrication, the improvement of emulsion-dispersibility, sticking prevention, and the improvement of photographic characteristics (e.g., development acceleration, contrast increase, and sensitization).

Examples of the surface active agent which is used for these purposes are nonionic surface active agents such as saponin (steroid series), alkylene oxide derivatives (e.g., polyethylene glycol, polyethylene glycol/-polypropylene glycol condensates, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, and polyethyleneoxide addition products of silicone), glycidol derivatives (e.g., alkenylsuccinic acid polyglyceride, and alkylphenol polyglyceride), fatty acid esters of polyhydric alcohols and alkyl esters of saccharide; anionic surface active agents having an acid group (such as carboxyl, sulfo, phospho, sulfuric acid ester, phosphoric acid ester), such as alkylcarboxylates, alkylsulfonates, alkylbenzenesulfonates, alkylnaphthalenesulfonates, alkylsulfuric acid esters, alkylphosphoric acid esters, N-acyl-N-alkyltaurins, sulfosuccinic acid esters, sulfoalkyl polyoxyethylene alkylphenyl ethers and polyoxyethylene alkylphosphoric acid esters; amphoteric surface active agents such as amino acids, aminoalkylsufonic acids, aminoalkylsulfuric acid esters, aminoalkylphosphoric acid esters, alkylbetaines and amine oxide; and cationic surface active agents such as alkylamine salts, aliphatic or aromatic quaternary ammonium salts, heterocyclic quaternary ammonium salts (e.g., pyridinium and imidazolium), and phosphonium salts or sulfonium salts having an aliphatic or heterocyclic ring. In particular, polyalkylene oxides having a molecular weight of at least 600 described in JP-B-58 9412 can be used as the surface active agent. (The term "JP-B" as used herein means an "examined Japanese patent publication".)

The polyalkylene oxide compounds for use in this invention include condensates of an alkylene oxide having from 2 to 4 carbon atoms, such as ethylene oxide, propylene-1,2-oxide, butylene-1,2-oxide, or preferably a polyalkylene oxide composed of at least 10 units of ethylene oxide and a compound having at least one active hydrogen such as water, aliphatic alcohols, aromatic alcohols, fatty acids, organic amines, hexitol derivatives, and a block copolymer of two or more kinds of polyalkylene oxides.

Specific examples of the polyalkylene oxide compounds are:

polyalkylene glycols,
polyalkylene glycol alkyl ethers,
polyalkylene glycol aryl ethers,
polyalkylene glycol alkylaryl ethers,
polyalkylene glycol esters,
polyalkylene glycol fatty acid amides,
polyalkylene glycol amines,
polyalkylene glycol block copolymers, and
polyalkylene glycol graft polymers.

It is necessary that the polyalkylene oxide compound has a molecular weight of at least 600.

The polyalkylene oxide compound can contain not only one polyalkylene oxide but also two or more polyalkylene oxide in the molecule. In this case each polyalkylene oxide may be composed of less than 10 alkylene oxide units but the sum of the alkylene oxide units in the molecule must be at least 10. When the polyalkylene oxide compound has two or more polyalkylene oxides in the molecule, each polyalkylene oxide may be composed of a different alkylene oxide unit. For example, one polyalkylene oxide is composed of ethylene the other is composed of propylene oxide. The polyalkylene oxide compound for use in this invention contains preferably from 14 to 100 alkylene oxide units.

Specific examples of the polyalkylene oxide compound for use in this invention are the following compounds described in JP-A-50-156423, JP-A-52-108130 and JP-A-53-3217.

1 $HO(CH_2CH_2O)_{90}H$

2 $C_4H_9O(CH_2CH_2O)_{15}H$

3 $C_{12}H_{25}O(CH_2CH_2O)_{15}H$

4 $C_{18}H_{37}O(CH_2CH_2O)_{15}H$

5 $C_{18}H_{37}O(CH_2CH_2O)_{40}H$

6 $C_8H_{17}CH{=}CHC_8H_{16}O(CH_2CH_2O)_{15}H$

7 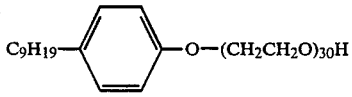

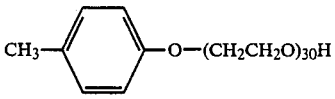

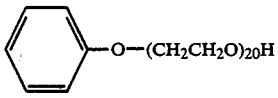

8 $C_{11}H_{23}COO(CH_2CH_2O)_{80}H$

9 $C_{11}H_{23}COO(CH_2CH_2O)_{24}OCC_{11}H_{23}$

10 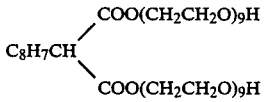

11 $C_{11}H_{23}CONH(CH_2CH_2O)_{15}H$

12 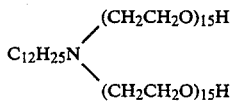

13 $C_{14}H_{29}N(CH_2)(CH_2CH_2O)_{24}H$

14 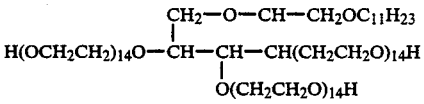

15 $H(CH_2CH_2O)_a(CHCH_2O)_b(CH_2CH_2O)_cH$ ($CH_3$)

16

17 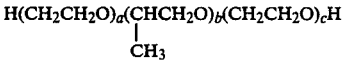

-continued a + b + c = 50 b:a + c = 10:9

18 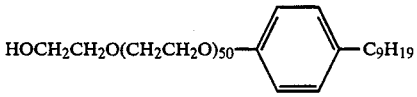

19 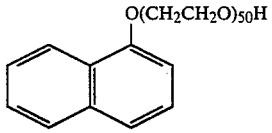

20 $HO(CH_2CH_2O)_a(CH_2CH_2CH_2CH_2O)_b(CH_2CH_2O)_cH$ a + c = 30, b = 14

21 $HO(CH_2CH_2O)_a(CHCH_2O)_b(CH_2CH_2O)_cH$ ($C_6H_5$)

b = 8, a + c = 50

22 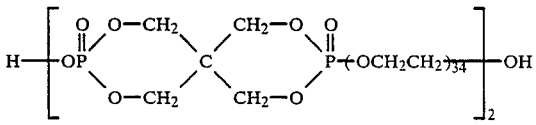

23 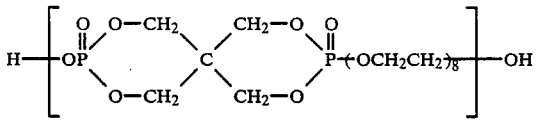

24 $HO(CH_2CH_2O)_{34}H$

These polyalkylene oxide compounds may be used singly or as a combination thereof.

In the case of incorporating the polyalkylene oxide compound in a silver halide emulsion, the compound can be added to the emulsion at a proper step before coating the emulsion, preferably after chemical ripening as an aqueous solution thereof at a proper concentration or a solution in a low-boiling organic solvent miscible with water. The compound may be added to a light-insensitive hydrophilic colloid layer such as an interlayer, a protective layer, or a filter layer, without being added to the emulsion layer. Also, the compound may be added to a processing solution.

As the development accelerator or the accelerator for nucleation infectious development, which is suitably used in this invention, various compounds containing nitrogen or, sulfur are effectively used in addition the compounds disclosed in JP-A-53-77616, JP-A-54-37732, JP-A-53 137133, JP-A-60-140340 and JP-A-60-14959.

Specific examples thereof are illustrated below, but the present invention is not to be construed as being limited thereto.

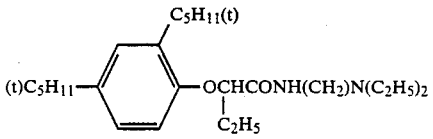

-continued
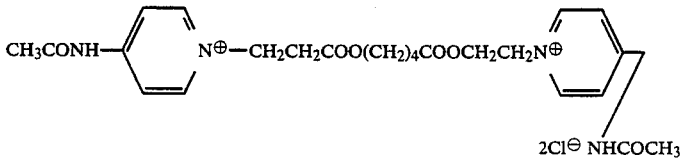
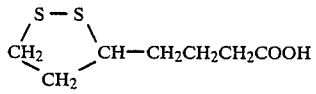
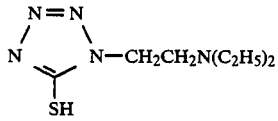
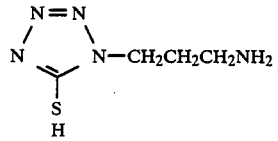
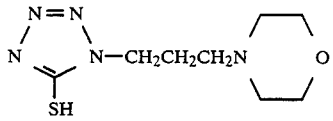
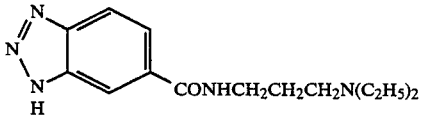
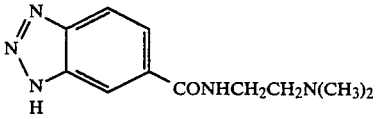
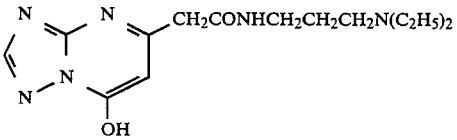
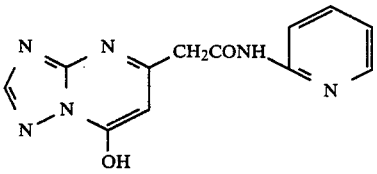
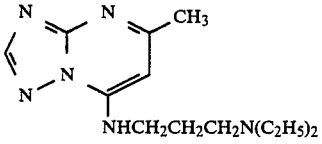
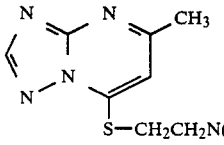

-continued

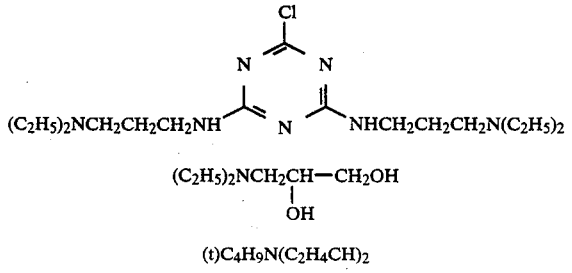

The optimum amount of the accelerator depends upon the compound but is preferably from $1.0\times10^{-3}$ to 0.5 g/m$^2$, and more preferably from $5.0\times10^{-3}$ to 0.1 g/m$^2$. The accelerator is added to the coating composition as a solution in a proper solvent (e.g., water, alcohols such as methanol and ethanol, acetone, dimethylformamide, and methylcellosolve).

The photographic light-sensitive materials of this invention may contain an inorganic or organic hardening agent in the silver halide emulsion layers and other hydrophilic colloid layers thereof. Examples of these hardening agents are chromium salts (e.g., chromium alum), aldehydes (e.g., formaldehyde and glutal aldehyde), N-methylol compounds (e.g., dimethylolurea), dioxane derivatives (e.g., 2,3-dihydroxydioxane), active vinyl compounds (e.g., 1,3,5-triacryloyl-hexahydro-s-triazine and 1,3-vinylsulfonyl 2-propanol), active halogen compounds (e.g., 2,4-dichloro-6-hydroxy-s-triazine), mucohalogenic acids (mucochloric acid), N-carbamoylpyridinium salts (e.g., (1-morpholinocarbonyl-3-pyridino)methane sulfonate), and haloamidinium salts.

Also, the photographic light-sensitive material of this invention may further contain polyalkylene oxide or the derivatives thereof such as ethers, esters, amines, thioether compounds, thiomorpholines, quaternary ammonium salts, urethane derivatives, urea derivatives, imidazole derivatives or 3-pyrazolidone derivatives, for the purposes of increasing sensitivity, increasing contrast, or development acceleration.

The photographic light-sensitive materials of this invention can further contain a dispersion of a water-insoluble or water sparingly soluble polymer in the silver halide emulsion layers and other hydrophilic colloid layers for improving dimensional stability. For example, polymers composed of an alkyl (meth)acrylate, glycidyl (meth)acrylate or styrene, singly or as a combination thereof or polymers composed of a combination of these monomers and acrylic acid, methacrylic acid, can be used as the polymer.

The photographic light-sensitive materials of this invention may further contain water-soluble dyes in the hydrophilic colloid layers as filter dyes or for various purposes such as irradiation prevention. Examples of such a dye include oxonol dyes, hemioxanol dyes, styryl dyes, merocyanine dyes, cyanine dyes, and azo dyes. Of these dyes, oxonol dyes, hemioxonol dyes and merocyanine dyes are useful.

The photographic light-sensitive materials of this invention may further contain various compounds in addition to the compounds represented by formulae (IX) and (X) described above for preventing the formation of fog during the production, storage or processing of the light-sensitive materials or for stabilizing the photographic performance thereof. For example, there are compounds known as antifoggants and stabilizers, such as azoles (e.g., benzothiazolium salts, nitroimidazoles, nitrobenzimidazoles, chlorobenzimidazoles, bromobenzimidazoles, nitroindazoles, benzotriazoles, and aminotriazoles); mercapto compounds (e.g., mercaptothiazoles, mercaptobenzothiazoles, mercaptobenzimidazoles, mercaptothiadiazoles, mercaptotetrazoles (in particular, 1-phenyl-5-mercaptotetrazole), mercaptopyrimidines, and mercaptotriazines); thioketo compounds (e.g., oxadolinethione); azaindenes (e.g., triazaindenes and pentaazaindenes); benzenethiosulfonic acid; benzenesulfinic acid; and benzenesulfonic acid amides.

Also, in this invention, it is preferred to add a matting agent to the upper light-insensitive protective layer on a silver halide emulsion layer. The protective layer may be a single layer or composed of two or more layers and when the protective layer is composed of plural layers, it is preferred to add the matting agent to the uppermost layer. By adding the matting agent to the light-insensitive protective layer together with the compound having LA represented by formula (I), a silver halide photographic material giving images having good edge smoothness and having improved safelight safety can be obtained.

As the matting agent, an amorphous matting agent is preferably used. The term "amorphous matting agent" means an amorphous fine powder that does not have symmetric faces or symmetric points. The mean particle size of the amorphous fine powder is from 0.1 μm to 20 μm, and preferably from 1 μm to 10 μm.

Specific examples of the matting agent are silicon dioxide, titanium dioxide, magnesium oxide, aluminum oxide, calcium carbonate, barium sulfate, strontium sulfate, a mixture of them, colloidal manganese, zinc dust, starch, silver halide desensitized by a known method, and synthetic silica. The matting agent is obtained by grinding an inorganic or organic polymer having relatively large particle size followed by sieving.

The addition amount of the matting agent is from 10 to 400 mg/m$^2$, and preferably from 20 to 200 mg/m$^2$.

The amorphous matting agents may be used singly or as a mixture thereof. Also, a small amount of a spherical matting agent may be used together with the amorphous matting agent for improving the anti-adhesive property, without losing the transparency of the photographic material.

The support for use in this invention includes glass plates, cellulose acetate films, nitrocellulose films, polyethylene terephthalate films, papers, baryta-coated papers, papers laminated with a polyolefin (e.g., polyethylene, polypropylene, etc.), polystyrene films, polycarbonate films, and metal sheets, such as aluminum sheets. These supports may be subjected to corona discharge treatment or subbing treatment.

For photographic processing of the photographic light-sensitive materials of this invention, any known process and known processing solutions can be used. The processing temperature is usually selected between 18° C. and 50° C. but may be lower than 18° C. or higher than 50° C.

The photographic light-sensitive material of this invention is advantageously used as a high contrast photographic light-sensitive material containing the hydrozine derivative as described above.

For obtaining high contrast photographic characteristics using the silver halide photographic material (black-and white photographic material), a stable developer can be used without need of using a conventional infectious developer or a high alkaline developer having a pH of about 13 (described in U.S. Pat. No. 2,419,975).

That is, the silver halide photographic material of this invention can give very high-contrast negative images using a developer containing more than 0.15 mole/liter of sulfite ion as a preservative and having a pH of from 10.5 to 12.3, and particularly from 11.0 to 12.0.

There is no particular restriction on the developing agent which is used for processing the high-contrast photographic materials of this invention and, for example, dihydroxybenzenes (e.g., hydroquinone), 3-pyrazolidones (e.g., 1-phenyl-3-pyrazolidone and 4,4-dimethyl-1-phenyl-3-pyrazolidone) and aminophenols (e.g., N-methyl-p-aminophenol) can be used singly or as a combination thereof.

The high-contrast silver halide photographic material of this invention is suitably processed by a developer containing a dihydroxybenzene as the developing agent and a 3-pyrazolidone or an aminophenol as an auxiliary developing agent. It is preferred that the developer contains from 0.05 to 0.5 mole/liter of the dihydroxybenzene and from less than 0.06 mole/liter of a 3-pyrazolidone or an aminophenol.

Also, by adding amines to the developer as described in U.S. Pat. No. 4,269,929, the development rate can be increased and the developing time can be shortened.

The developer can further contain a pH buffer such as sulfites, carbonates, borates and phosphates of alkali metals and a development inhibitor such as bromides, iodides and organic antifoggants (preferably nitroindazoles and benzotriazoles) or inorganic anti-foggants. Also, if necessary, the developer may further contain a water softener, a dissolution aid, a toning agent, a development accelerator, a surface active agent (particularly the above-described polyalkylene oxides), a defoaming agent, a hardening agent, or a silver stain preventing agent for film (e.g., 2-mercaptobenzimidazole sulfonates).

The developer particularly suitable for the high-contrast silver halide photographic materials of this invention meets the following conditions.

(a) Substantially dihydroxybenzene only is used as the developing agent.

(b) The concentration of free sulfite is at least 0.18 mole/liter.

(c) The pH is at least 11.0.

(d) The developer contains at least 20 mg/liter of a compound represented by formula (XI);

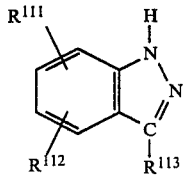

(XI)

wherein $R^{111}$ represents hydrogen or a nitro group and $R^{112}$ and $R^{113}$, which may be the same or different, each represents hydrogen or an alkyl group having from 1 to 4 carbon atoms.

That is, the high-contrast silver halide photographic material of this invention can quickly provide very high-contrast photographic images using a developer containing more than 0.18 mole/liter of sulfite ions as a preservative and having pH of from 11.0 to 12.3, and preferably from 11.3 to 12.0. Since the developer contains a large amount of sulfite ions, the developer is very stable.

The preferred developer contains at most 0.05 g/l of an auxiliary developing agent (e.g., 1-phenyl-3-pyrazolidones or p-aminophenols); contains from 0.05 to 0.5 mole/liter (particularly from 0.1 to 0.4 mole/liter) of a dihydroxybenzene as a developing agent; contains more than 0.18 mole/liter of free sulfite ions; contains more than 20 mg/liter of the compound of formula (XI) (preferably 5- or 6-nitroindazole); and contains an alkali in a sufficient amount to provide a pH of at least 11.0 (particularly from 11.3 to 12.3). The developer containing no auxiliary developing agent and containing a dihydroxybenzene (particularly, hydro-quinone) alone as the developing agent is preferably used.

As the dihydroxybenzene series developing agent which is used for the developer, there are hydroquinone, chlorohydroquinone, bromohydroquinone, isopropylhydroquinone, toluhydrohydroquinone, methylhydroquinone, 2,3-dichlorohydroquinone or 2,5-dimethylhydroquinone. As the 1-phenyl-3-pyrazolidone series developing agent, there are 1-phenyl-3-pyrazolidone, 4,4-dimethyl-1-phenyl-3-pyrazolidone, 4-hydroxymethyl-4-methyl-1-phenyl-3-pyrazolidone, and 4,4-dihydroxymethyl-1-phenyl-3-pyrazolidone. Also, as the p-aminophenol series developing agent, there are p-aminophenol and N-methyl-p-aminophenol.

The developer contains a compound giving free sulfite ions, such as sodium sulfite, potassium sulfite, potassium metahydrogensulfite, sodium hydrogensulfite as a preservative. In the case of infectious development, formaldehyde sodium hydrogensulfite which provides few free sulfite ions in the developer may be used.

The developer contains potassium hydroxide, sodium hydroxide, potassium carbonate, sodium carbonate, sodium acetate, potassium tertiary phosphate, or diethanolamine, triethanol amine as the alkali agent.

In the preferred compound represented by formula (XI), $R^{111}$ is hydrogen or a nitro group and $R^{112}$ and $R^{113}$ each is hydrogen, a methyl group, or an ethyl group. Examples of such a preferred compound are indazole, 5-nitroindazole, 6-nitroindazole, 3-methyl-5-nitroindazole, 3-methyl-6-nitroindazole, 3-methylindazole, and 3-ethyl-5-nitroindazole, although the compound for use in this invention is not limited to these compounds.

The compounds of formula (XI) is added to the developer as an aqueous solution thereof or a solution in a water-miscible low-boiling organic solvent, or the compound is directly added to the developer as a solid. The content of the compound is preferably from 20 mg/liter to 10 g/liter, and more preferably from 40 mg/liter to 5 g/liter.

It is preferred that the developer contains the above-described polyalkylene oxide as a development inhibitor. For example, a polyethylene oxide having a molecular weight of from 1000 to 10,000 can be contained therein in the range of from 0.1 to 10 g/liter. Also, an amine compound described in U.S. Pat. No. 4,269,929 can be added to the developer as a development accelerator.

The developer for use in this invention preferably contains nitrotriacetic acid, ethylenediaminetetraacetic acid, triethylenetetraminehexaacetic acid, diethylenetetraminepentaacetic acid, as a water softener.

As a fixing solution for use in this invention, a solution having a conventional composition can be used.

As a fixing agent, thiosulfates, thiocyanates as well as organic sulfur compounds which are known to have an effect as fixing agent can be used.

The fixing solution may contain a water-soluble aluminum salt as a hardening agent.

The fixing solution may further contain a complex salt of ethylenediaminetetraacetic acid and iron (III) ions as an oxidizing agent.

The processing temperature and processing time may be varied but the processing temperature is usually from 18° C. to 50° C. On the other hand, it is preferred to perform quick processing of from 15 seconds to 120 seconds using an automatic processor.

The developer for use in this invention may contain a compound described in JP-A-56-24347 as a silver stain preventing agent. Also, as a dissolution aid for the developer, a compound described in JP-A-61-67759 can be used. Furthermore, as a pH buffer for the developer, compounds described in JP-A-60-93433 and JP-A-62-186259 can be used.

The invention is further explained in detail with reference to the following examples, but the present invention is not to be construed as being limited thereto. Unless otherwise indicated, all parts, percents and ratios are by weight.

EXAMPLE 1

Preparation of Emulsion A

An aqueous silver nitrate solution and an aqueous sodium chloride solution containing ammonium hexachlororhodate (III) in an amount of $0.5\times10^{-4}$ mole per mole of silver were mixed in an aqueous gelatin solution at 35° C. by a double jet method while controlling the pH to 6.5 to form a monodisperse silver chloride emulsion containing silver chloride grains having a mean grain size of 0.07 μm.

After forming the grains, soluble salts were removed by a flocculation method and then 4-hydroxy-6-methyl-1,3,3a,7-tetraazaindene and 1-phenyl-5-mercaptotetrazole were added to the emulsion as stabilizers. The content of gelatin in 1 kg of emulsion was 55 g and the content of silver was 105 g (Emulsion A).

Preparation of Light-Sensitive Material

Then, the nucleating agents and nucleation accelerators described below were added to Emulsion A and also the safelight dye shown below was added thereto to increase the safelight safety.

| | Amount (mg/m²) |
|---|---|
| Nucleating Agent | |
| 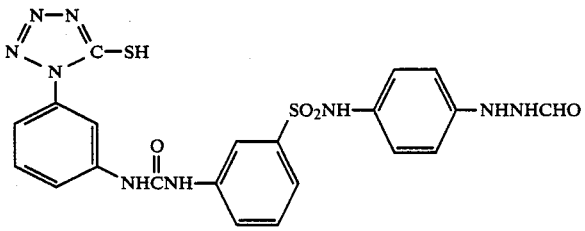 | 11.8 |
| 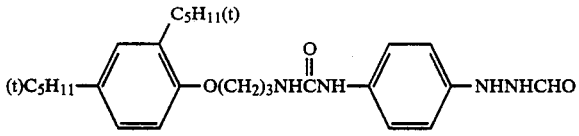 | 9.3 |
| Nucleation Accelerator | |
| 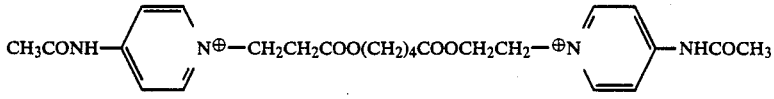 | 28.0 |
| 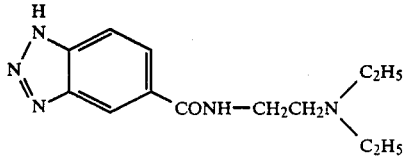 | 60.0 |
| Safelight Dye | |

-continued

| | Amount (mg/m²) |
|---|---|
| 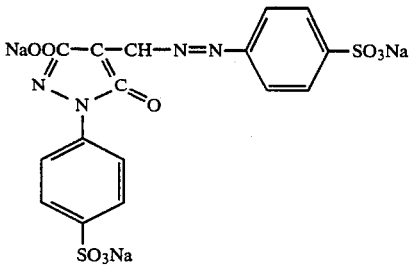 | 50.0 |

Then, after adding thereto 14 mg/m² of polyethyl acrylate latex and further 2,4-dichloro-6-hydroxy-1,3,5-triazine sodium salt as hardening agent, the emulsion was coated on a transparent polyethylene terephthalate film support at a silver amount of 3.5 g/m² and then a protective layer containing 1.3 g/m² of gelatin, 0.1 g/m² of Compound I-69 of this invention, and the following three surface active agents, stabilizer, and matting agent on the emulsion layer and dried. (Sample 1)

| | Amount (mg/m²) |
|---|---|
| Surface Active Agent: | |
| 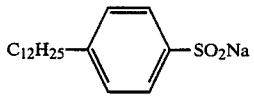 | 37 |
| $CH_2COOC_6H_{13}$ \| $CHCOOC_6H_{13}$ \| $SO_3Na$ | 37 |
| $C_8F_{17}SO_2N(C_3H_7)CH_2COOK$ | 2.5 |
| Stabilizer: | |
| Thiotic Acid | 6.0 |
| Matting Agent: | |
| Polymethyl Methacrylate (mean particle size 2.5 μm) | 9.0 |
| In addition, Compound I-69 of this invention was dispersed by the following manner. | |
| Solution I | |
| Compound I-69 | 2.4 g |
| Dimethylformamide | 4.9 ml |
| Solution II | |
| Amphoteric Surface Active Agent No. 3 | 1.68 g |
| Gelatin | 5.4 g |
| Citric Acid | 0.135 g |
| Water | 104 ml |

The pH of the solution obtained was 5.4.

Preparation of Comparison Sample

By following the same procedure as Example 1 except that the amphoteric surface agent in Solution II was omitted, Comparison Sample A was prepared.

Evaluation of Performance (1) Stability of Dispersion:

The stability of the dispersion used in Example 1 and the dispersion used for Comparison Sample A was tested and the results obtained are shown in Table 1 below.

The viscosity of the dispersion used for Comparison Sample A was greatly reduced with the passage of time at 40° C., while the viscosity of the dispersion in Example 1 was scarcely changed.

TABLE 1

| | Viscosity (40° C.) | | Mechanical Stability* | |
|---|---|---|---|---|
| | (A) | (B) | (A) | (B) |
| Dispersion Example 1 | 47 c.p. | 41 c.p. | 0.04 | 0.10 |
| Dispersion for Comparison Sample A | 150 c.p. | 65 c.p. | 0.07 | 1.38 |

(A): Viscosity 2 hours after dissolution
(B): Viscosity after 4 days at 40° C.
*The mechanical stability was determined by the change of turbidity when 1 kg of the dispersion was circulated by a plunger pump at 150 ml/min. The turbidity was the transmission density at 550 nm of the dispersion diluted with water to 1/500 measured by a spectrophotometer.

(2) State of the Coated Surface of Samples:

Each sample was stored for 4 days at 40° C. and then coated. In the case of Example 1, no unusual state was observed but in Comparison Sample A, rippling wave-like abnormality formed on the surface and partial depositions were observed.

(3) Photographic Properties:

Each sample prepared by using each dispersion stored for 4 days at 40° C. was light-exposed through an optical wedge using a safelight printer P-607 (made by Dainippon Screen Mfg. Co., Ltd.), developed with the developer having the following composition for 20 seconds at 38° C., fixed in an ordinary manner, washed and dried.

As the result, in Comparison Sample A, a strong rippling wave-like abnormality was observed at the blackened portions to make the images impractical for use, while the sample of Example 1 showed no abnormality.

| Developer | |
|---|---|
| Hydroquinone | 35.0 g |
| N-Methyl-p-aminophenol ½ sulfate | 0.8 g |
| Sodium Hydroxide | 13.0 g |
| Potassium Tertiary Phosphate | 74.0 g |
| Potassium Sulfite | 90.0 g |
| Ethylenediaminetetraacetic Acid Sodium Salt | 1.0 g |
| Potassium Bromide | 4.0 g |
| 5-Methylbenzotriazole | 0.6 g |
| 3-Diethylamino-1,2-propanediol | 15.0 g |
| Water to make | 1 liter (pH 11.5) |

EXAMPLE 2

The same procedure as Example 1 was followed while using the amphoteric surface active agents shown in Table 2 below in the amounts shown in the table in place of using 1.68 g of Amphoteric Surface Active Agent No. 3.

The results showed that the viscosity change and the mechanical stability of the dispersions were good as shown in Table 2 and also the surface state and photographic properties of the samples were good.

TABLE 2

| | Amphoteric Surface Active Agent | | Viscosity (40° C.) | | Mechanical Stability | |
|---|---|---|---|---|---|---|
| Sample No. | Kind | Amount* | 2 Hours after dissolution (cp) | After 4 days at 40° C. (cp) | 2 Hours after dissolution | After 4 days at 40° C. |
| 2-1 | Compound No. 1 | 0.7 | 65 | 49 | 0.05 | 0.15 |
| 2-2 | Compound No. 2 | 0.7 | 45 | 40 | 0.04 | 0.13 |
| 2-3 | Compound No. 3 | 0.3 | 80 | 55 | 0.06 | 0.25 |
| 2-4 | Compound No. 3 | 0.5 | 58 | 45 | 0.05 | 0.16 |
| 2-5 | Compound No. 4 | 0.5 | 45 | 41 | 0.05 | 0.13 |
| 2-6 | Compound No. 6 | 0.5 | 53 | 45 | 0.05 | 0.17 |
| 2-7 | Compound No. 7 | 0.5 | 50 | 41 | 0.04 | 0.12 |
| 2-8 | Compound No. 11 | 0.5 | 54 | 43 | 0.04 | 0.17 |
| 2-9 | Compound No. 18 | 0.7 | 57 | 44 | 0.05 | 0.26 |
| 2-10 | Compound No. 19 | 0.7 | 66 | 48 | 0.06 | 0.33 |

*Amount is indicated by the weight ratio of the amphoteric surface active agent to the Compound I-69 in the dispersion.

EXAMPLE 3

The same procedure as Example 1 was followed while using Compound I-71, Compound I-72, Compound I-26, Compound I-73, and Compound I-74 of this invention in place of Compound I-69 in Solution I for the dispersion.

In each case, good dispersion stability, coated surface state, and photographic properties were obtained.

EXAMPLE 4

An aqueous silver nitrate solution and an aqueous sodium chloride solution containing ammonium hexachlororhodate (III) in an amount of $1.1\times10^{-4}$ mole per mole of silver were added to an aqueous gelatin solution kept at 38° C. by a double jet method over a period of 15 minutes to provide a monodisperse emulsion containing cubic silver chloride grains having a mean grain size of 0.08 μm. After the formation of grains soluble salts were removed by a floccuration method and then 4-hydroxy-6-methyl-1,3,3a,7-tetraazaindene and 1-phenyl-5-mercaptotetrazole were added to the emulsion as stabilizers. The content of gelatin and silver in 1 kg of the emulsion were 55 g and 100 g, respectively.

To the emulsion were added 11 mg/m$^2$ of hydrazine Compound (S-1) shown below, 20 mg/m $^2$ of Compound (S-2) shown below, 6 mg/m$^2$ of Compound (S-3) shown below, 20 mg/m$^2$ of Compound (S-4) shown below as a nucleation accelerator, and Compound (S-5) as a dye for increasing the safelight safety. Then, after adding thereto 0.8 g/m$^2$ of a polyethyl acrylate latex and 145 mg/m$^2$ of a hardening agent, 2-bis(vinylsulfonylacetamido)ethane, the emulsion was coated on a polyethylene terephthalate film support at a silver coverage of 3.8 g/m$^2$. Then, Protective Layer 1 containing 0.8 g/m$^2$ of gelatin, 85 mg/m$^2$ of Compound (S-6) shown below, 30 mg/m$^2$ of 1,5-dihydroxy-2-benzaldoxime, 6 mg/m$^2$ of thioctic acid, 140 mg/m$^2$ of a polyethylacrylate latex, and 10 mg/m$^2$ of a coating aid, sodium dodecylbenzenesulfonate, was formed on the emulsion layer.

Compound (S-1)

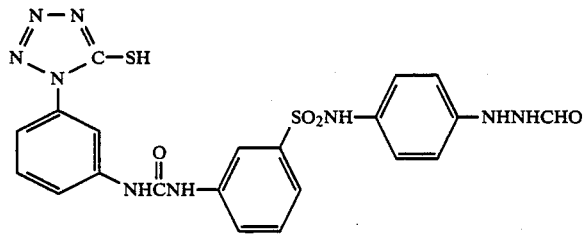

Compound (S-2)

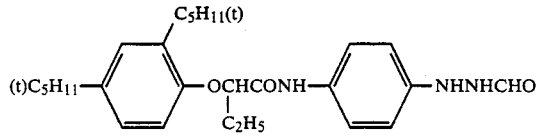

-continued

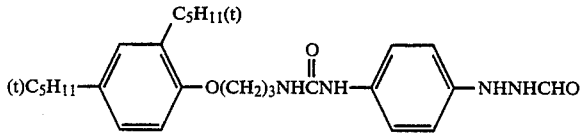

Compound (S-3)

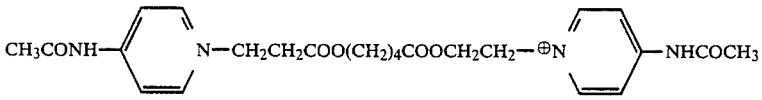

Compound (S-4)

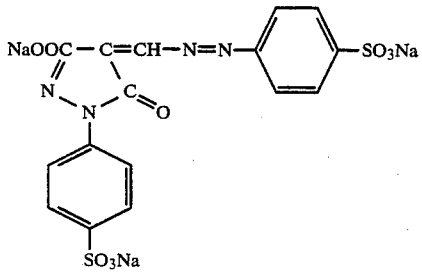

Compound (S-5)

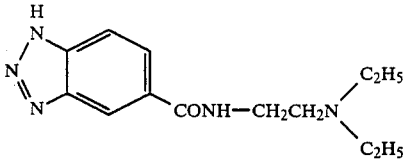

Compound (S-6)

Furthermore, Protective Layer 2 containing 0.6 mg/m$^2$ of gelatin, 0.1 g/m$^2$ of Compound I-69 of the invention (i.e., the compound represented by formula (I)), 16 mg/m$^2$ of a coating aid, sodium dodecylbenzenesulfonate, and 3 g/m$^2$ of N-perfluorooctanesulfonyl-N-propylglycine potassium salt, 40 mg/m$^2$ of a matting agent, polymethyl methacrylate (mean particle size 2.5 μm) was formed thereon.

In addition, the gelatin dispersion of Compound I-69 of this invention represented by formula (I) was prepared in the following manner.

A solution of 10 g of Compound I-69 dissolved in 20 ml of N,N-dimethylsulfonamide was mixed with 465 g of an aqueous solution of 6.5% by weight gelatin containing 17 g of Compound IV-1, 0.57 g of citric acid with stirring at 50° C. to provide the dispersion. The pH of the dispersion obtained was 5.3.

PREPARATION OF COMPARISON SAMPLE

By following the same procedure as above except that Compound IV-1 was not used, Comparison Sample A was prepared. The evaluation of the performance was in the same manner as Example 1. The results are shown in Table 3.

TABLE 3

| Sample No. | | Stability of Dispersion: Immediately after dispersion | Stability of Dispersion: After 4 days at 40° C. | Coated Surface State: Immediately after dispersion | Coated Surface State: After 4 days at 40° C. | Photographic Properties: Immediately after dispersion | Photographic Properties: After 4 days at 40° C. |
|---|---|---|---|---|---|---|---|
| 4-1 (Invention) | Dispersion of Example 1 | 0.03 | 0.04 | O | O | O | O |
| 4-2 | Comparison Sample A | 0.04 | 1.40 | O | x | O | x |

O: Good
x: Practically unusable

As is clear from the results shown in Table 3, it can be seen that Sample 4-1 of this invention had good stability of dispersion, a good coated surface state, and did not adversely influence the photographic images formed.

EXAMPLE 5

By following the same procedure except that the compounds of formula (IV) of this invention shown in Table 4 below were used in the dispersion of Compound I-69 of formula (I), dispersions were obtained. Also, by further following the same procedure as in Example 4 using each of the dispersions, light sensitive materials were prepared. The results are shown in Table 4.

As is clear from the results shown in Table 4, it can be seen that in Samples 5-1 to 5-5 of this invention, the stability of the dispersions was good and also the coated surface state and the photographic properties were good.

TABLE 4

| Sample No. | Fluorine-Series Amphoteric Surface Active Agent | Stability of Dispersion: Immediately after dispersion | Stability of Dispersion: After 4 days at 40° C. | Coated Surface State: Immediately after dispersion | Coated Surface State: After 4 days at 40° C. | Photographic Properties: Immediately after dispersion | Photographic Properties: After 4 days at 40° C. |
|---|---|---|---|---|---|---|---|
| 5-1 (Invention) | IV-3 | 0.03 | 0.05 | O | O | O | O |
| 5-2 (Invention) | IV-7 | " | 0.05 | O | O | O | O |
| 5-3 (Invention) | IV-8 | " | 0.06 | O | O | O | O |
| 5-4 (Invention) | IV-5 | " | " | O | O | O | O |
| 5-5 (Invention) | IV-6 | " | " | O | O | O | O |
| 5-6 | Comparison Sample A | 0.04 | 1.40 | O | x | O | x |

EXAMPLE 6

The same procedure as Example 4 was followed using Compounds I-71, I-72, I-26, I-73 and I-74 represented by formula (I) in place of Compound I-69 of formula (I) in the gelatin dispersion.

In each case good stability of the dispersion and a good coated surface state and photographic properties were obtained.

EXAMPLE 7

In Examples 7 to 9, the developer having the following composition was used.

| Developer | |
|---|---|
| Hydroquinone | 45.0 g |
| N-Methyl-p-aminophenol ½ Sulfate | 0.8 g |
| Sodium Hydroxide | 18.0 g |
| Boric Acid | 78.0 g |
| Potassium Sulfite | 110.0 g |
| Ethylenediaminetetraacetic Acid Disodium Salt | 1.0 g |
| 2-Mercptobenzimidazole-5-sulfonic Acid | 0.3 g |
| Potassium Bromide | 6.0 g |
| 5-Methylbenzotriazole | 0.6 g |
| n-Butylethanolamine | 15.0 g |
| Water to make | 1 liter (pH 11.6) |

An aqueous silver nitrate solution and an aqueous sodium chloride solution containing $1\times10^{-5}$ mole of $(NH_4)_3RhCl_6$ were simultaneously added to an aqueous gelatin solution kept at 40° C. over a 10 minute period while controlling the potential at +50 mV to provide a monodisperse emulsion containing cubic silver chloride grains having a mean grain size of 0.2 μm. Soluble salts were removed therefrom and then gelatin was added thereto.

Then, after adding to the emulsion the compounds of formula (VI) and formula (IX) as shown in Table 5 below, 30 mg/m² of Nucleation Accelerator (1) and 4 mg/m² of Desensitizer (2) shown below were added to the emulsion.

(1)

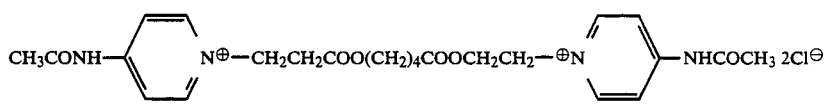

(2)

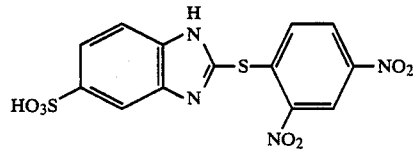

Furthermore, a polyethylene acrylate latex was added thereto in an amount of 30% by weight as solids based on gelatin and 2-bis(vinylsulfonylacetamido)ethane was added thereto as a hardening agent. The emulsion was coated on a polyethylene terephthalate film support at a silver coverage of 3.6 g/m². The content of gelatin was 1.7 g/m².

On the layer was simultaneously formed a protective layer containing 1.5 g/m² of gelatin, 50 mg/m² of polymethyl methacrylate having mean particle size of 3.0 μm, 6 mg/m² of thioctic acid, sodium dodecylbenzenesulfonate as a coating aid, and compound I-19 of formula (I) or yellow compound I-59 represented by formula (I).

The sample thus obtained was light-exposed through an optical wedge by a safelight printer P-607 (made by Dainippon Screen Mfg. Co.), processed for 20 seconds at 38° C., fixed, washed, and dried. (Automatic Processor FG-660F).

Also, these samples were subjected to processing and the quality of white lettering on solid background and fog after irradiation of safelight were compared on these samples.

The results obtained are shown in Table 5 below.

As is clear from the results of Table 5, Samples 7-2 to 7-6 and Samples 7-10 to 7-15 of this invention were good in quality, safelight safety, and storage stability.

TABLE 5

| Sample | Compound of Formula (I) Compound No. | Amount (g/m²) | Compound of Formula (VI) Compound No. | Amount (mol/mol Ag) | Compound of Formula (IX) Compound No. | Amount (mol/mol Ag) | Photographic Properties Sensitivity(1) | γ(2) | Quality of(3) White Lettering on Solid Background | Fog after(4) Safelight Irradiation | Storage(5) Stability with Passage of Time |
|---|---|---|---|---|---|---|---|---|---|---|---|
| 7-1 | — | — | VI-1 | $1 \times 10^{-4}$ | IX-1 | $2.5 \times 10^{-3}$ | 100 | 18.8 | 5 | 5.4 | +0.01 |
| 7-2* | I-19 | 0.1 | " | " | — | — | 26 | 16.2 | 4 | 0.02 | +0.15 |
| 7-3* | " | " | " | " | IX-1 | $2.5 \times 10^{-3}$ | 25 | 15.6 | 3.5 | 0.01 | +0.03 |
| 7-4* | " | " | " | " | " | $5 \times 10^{-3}$ | 24 | 15.4 | 3.5 | 0.00 | +0.02 |
| 7-5* | " | " | " | " | IX-10 | $1 \times 10^{-3}$ | 27 | 15.3 | 3.5 | 0.02 | +0.02 |
| 7-6* | " | " | " | " | " | $2 \times 10^{-3}$ | 26 | 15.0 | 3.5 | 0.01 | +0.01 |
| 7-7 | Comparison Compound (a) | " | " | " | IX-1 | $2.5 \times 10^{-3}$ | 23 | 14.0 | 1 | 0.00 | +0.03 |
| 7-8 | I-41 | " | Comparison Compound (c) | $4 \times 10^{-4}$ | " | " | 28 | 16.0 | 3.5 | 0.04 | +0.16 |
| 7-9 | " | " | Comparison Compound (c) | $5 \times 10^{-4}$ | " | " | 30 | 17.3 | 4.0 | 0.03 | +0.18 |
| 7-10* | I-59 | 0.1 | VI-1 | $1 \times 10^{-4}$ | IX-1 | $2.5 \times 10^{-3}$ | 50 | 18.0 | 4.0 | 0.05 | +0.03 |
| 7-11* | " | " | " | $1.2 \times 10^{-4}$ | " | " | 55 | 18.3 | 4.5 | 0.12 | +0.04 |
| 7-12* | " | " | VI-20 | $1.2 \times 10^{-4}$ | " | " | 49 | 17.0 | 4.0 | 0.06 | +0.03 |
| 7-13* | " | " | " | $1.4 \times 10^{-4}$ | " | " | 52 | 18.0 | 4.5 | 0.11 | +0.04 |
| 7-14* | " | " | " | $1.2 \times 10^{-4}$ | IX-10 | " | 48 | 15.2 | 4.0 | 0.06 | +0.03 |
| 7-15* | " | " | " | $1.4 \times 10^{-4}$ | " | " | 51 | 17.0 | 4.5 | 0.10 | +0.04 |
| 7-16 | Comparison Compound (b) | " | " | $2 \times 10^{-4}$ | IX-1 | " | 45 | 14.0 | 1.5 | 0.04 | +0.02 |
| 7-17 | Comparison Compound (b) | " | " | $2.5 \times 10^{-4}$ | " | " | 49 | 15.2 | 1.5 | 0.09 | +0.03 |
| 7-18 | I-59 | " | Comparison Compound (c) | $4.5 \times 10^{-4}$ | " | " | 45 | 16.8 | 4.0 | 0.08 | +0.17 |
| 7-19 | " | " | Comparison Compound (c) | $5.5 \times 10^{-4}$ | " | " | 51 | 17.4 | 4.5 | 0.16 | +0.19 |

*Samples of this Invention

In addition, Comparison Compounds (a), (b) and (c) employed in Table 5 for making the comparison samples are shown below.

UV Dye (Comparison Compound (a))

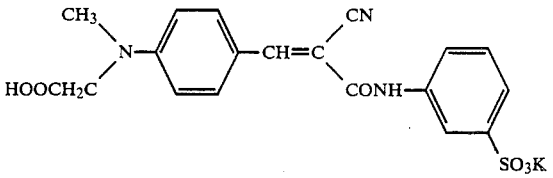

Dye (Comparison Compound (b))

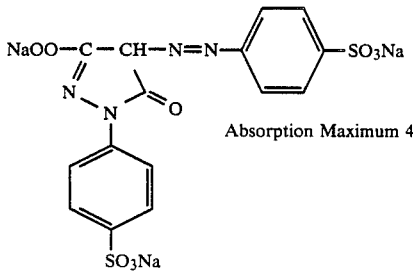

Absorption Maximum 430 nm

Nucleating Agent (Comparison compound (c))

-continued

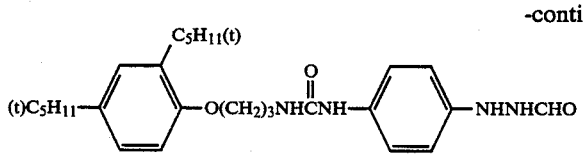

The evaluation terms used in Table 5 are explained as follows.

(1) Sensitivity: A relative sensitivity shown by the reciprocal of an exposure amount giving a density of 1.5, with that of Sample 1 being 100.

(2) Gamma (γ): (3.0—0.3)/—(log A—log B)

A: An exposure amount of giving a density of 0.3

B: An exposure amount of giving a density of 3.0

(3) Quality of white lettering on solid background:

A laminate composed of an insertion film base, a film (line image original) having positive line images formed, an insertion film base, and a film (dot original) having dot images formed thereon was superposed on each sample described above such that the dot image original faced the protective layer of the latter and when an aptitude exposure was applied thereto such that 50% of the dot area became 50% of the dot image area on the sample and the film was processed as described above, the material capable of reproducing a character of 30 μm in width of the line original was classified as 5, the material capable of reproducing a character of 150 μm width only was classified as 1, and ranks 4, 3, and 2 were determined between 5 and 1 by functional evaluation. Rank 2 was the practically usable limit.

(4) Fog after irradiation of safelight:

The fog in the case of developing the sample after irradiating it for 30 minutes by a white fluorescent lamp (F1 40SW), 20 lux made by Toshiba Corporation.

(5) Storage stability with passage of time:

After storing the sample for 3 days under conditions of 50° C. and 75% relative humidity, the sample was developed for 20 seconds at 38° C. and the change of the sensitivity compared to the sensitivity directly after coating wa shown at the evaluation. (Δlog E)

EXAMPLE 8

An aqueous silver nitrate solution and an aqueous sodium chloride solution containing $1\times10^{-4}$ mole of $(NH_4)_3RhCl_6$ were simultaneously added to an aqueous gelatin solution kept at 35° C. while maintaining the potential at 200 mV to provide a monodisperse emulsion containing cubic silver chloride grains having a mean grain size of 0.10 μm. After removing soluble salts therefrom, gelatin was added thereto. (Primitive emulsion)

Then, the compounds of formula (VI) and (IX) as shown in Table 6 below were added to the emulsion and after adding thereto 50 mg/m² of Nucleation Accelerator (S-1) shown below, $1\times10^{-3}$ mole/mole-Ag of hydrazine Compound (S-2) shown below, 30 mg/m² of Dye (S-3) shown below, a polyethylene acrylate latex in an amount of 30% by weight as solids based on gelatin, and a hardening agent, 1,3-divinyl-sulfonyl-2-propanol, the emulsion was coated on a polyester film support at a silver coverage of 3.8 g/m². The content of gelatin was 1.8 g/².

(S-1)

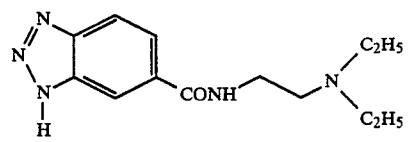

(S-2)

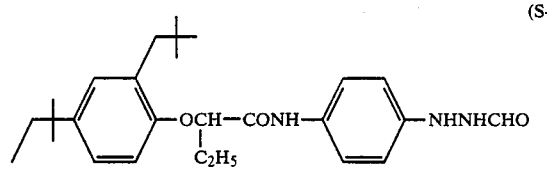

(S-3)

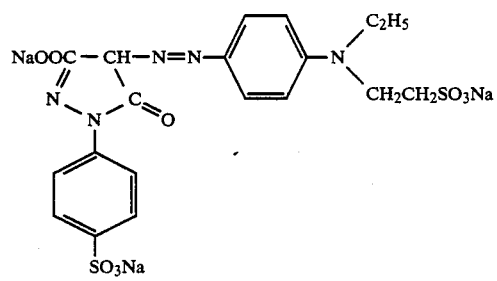

In this case, a protective layer containing 1.5 g/m² of gelatin, 50 mg/m² of polymethyl methacrylate having a mean particle size of 1.0 μm, 6 mg/m² of thioctic acid, a coating aid, sodium dodecylbenzenesulfonate, and the compound of formula (I) shown in Table 6 below was simultaneously formed thereon.

Each of the samples thus obtained was exposed and developed as in Example 7 and the results obtained are shown in Table 6.

As is clear from the results of Table 6, the samples 8-3 to 8-7 of this invention were good in the quality of white lettering on solid background and storage stability.

TABLE 6

| Sample | Compound of Formula (I) | | Compound of Formula (VI) | | Compound of Formula (IX) | | Photographic Properties | | Quality of White Lettering on Solid Background | Storage Stability with Passage of Time |
|---|---|---|---|---|---|---|---|---|---|---|
| | Compound No. | Amount (g/m²) | Compound No. | Amount (mg/m²) | Compound No. | Amount (g/m²) | Sensitivity | γ | | |
| 8-1 | — | — | VI-1 | $2.5\times10^{-4}$ | — | $5\times10^{-3}$ | 100 | 16.5 | 5 | +0.04 |
| 8-2* | I-19 | 0.05 g | " | " | — | " | 50 | 14.6 | 4 | +0.18 |
| 8-3* | " | " | " | " | IX-1 | " | 56 | 15.0 | 4 | +0.06 |
| 8-4* | " | 0.1 | " | $2.5\times10^{-4}$ | " | " | 32 | 14.8 | 3.5 | +0.07 |
| 8-5* | I-41 | 0.05 | " | " | " | " | 52 | 14.2 | " | +0.06 |
| 8-6* | " | " | " | $3\times10^{-4}$ | " | " | 59 | 15.6 | 4 | +0.07 |
| 8-7* | " | 0.1 | " | " | " | " | 33 | 15.0 | 3.5 | +0.07 |
| 8-8 | Comparison | 0.05 | " | " | " | " | 48 | 13.0 | 1.5 | +0.07 |

TABLE 6-continued

| Sample | Compound of Formula (I) Compound No. | Compound of Formula (I) Amount ($g/m^2$) | Compound of Formula (VI) Compound No. | Compound of Formula (VI) Amount ($mg/m^2$) | Compound of Formula (IX) Compound No. | Compound of Formula (IX) Amount ($g/m^2$) | Photographic Properties Sensitivity | Photographic Properties γ | Quality of White Lettering on Solid Background | Storage Stability with Passage of Time |
|---|---|---|---|---|---|---|---|---|---|---|
| 8-9 | Compound (a) Comparison Compound (a) | 0.1 | " | " | " | " | 28 | 11.9 | 1 | +0.08 |
| 8-10 | I-19 | 0.1 | Comparison Compound (d) | $5 \times 10^{-4}$ | IX-1 | $5 \times 10^{-3}$ | 22 | 9 | 1.5 | +0.20 |
| 8-11 | " | " | Comparison Compound (d) | $7 \times 10^{-4}$ | " | " | 26 | 10 | 2 | +0.25 |
| 8-12 | " | " | Comparison Compound (d) | " | " | $1 \times 10^{-2}$ | 18 | 7 | 1 | +0.08 |

*Sample of this Invention
Comparison Compound (d)

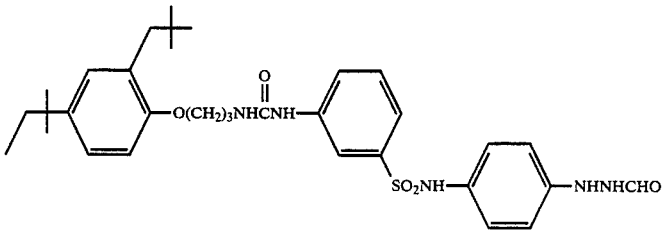

EXAMPLE 9

After adding $5 \times 10^{-3}$ mole/mole-Ag of Compound IX-1 of this invention to the emulsions having the same composition as the emulsion used in Example 8, each emulsion was coated on a film support at a silver coverage of 3.6 $g/m^2$.

Then, gelatin, Surface Active Agents A and B shown below, Mordant C shown below, and Dye Compound D shown below were added to water and the mixture was coated on the emulsion layer at a dye coverage shown in Table 7 below as a protective layer. In this case, the coated amounts of gelatin, Surface Active Agents A and B, and Mordant C were 1.0 $g/m^2$, 0.02 $g/m^2$, 0.07 $g/m^2$, and 1.0 $g/m^2$, respectively.

The sample using the mordant and Samples 8-4 and 8-7 prepared in Example 8 were exposed and processed as in Example 8, the results obtained being shown in Table 7.

As is clear from the results shown in Table 7, the comparison samples were insufficient in the quality of white lettering on solid background and inferior in UV transparency as compared with the samples of this invention.

Surfactant A

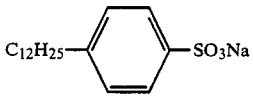

Surfactant B

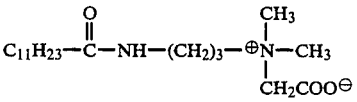

Mordant Agent C

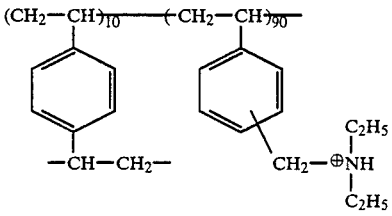

Comparative Dye D

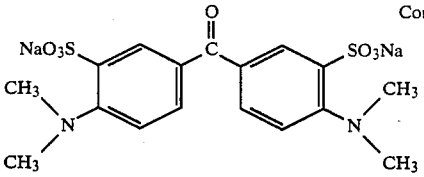

TABLE 7

| Sample | Compound of Formula (I) Compound No. | Compound of Formula (I) Amount (mol/mol-Ag) | Compound of Formula (VI) Compound No. | Compound of Formula (VI) Amount (mol/mol-Ag) | Photographic Properties Sensitivity | Photographic Properties γ | Quality of White Lettering on Solid Background | UV Transparency After Processing** |
|---|---|---|---|---|---|---|---|---|
| Example 8-4* | 19 | 0.1 | VI-1 | $3 \times 10^{-4}$ | 32 | 14.8 | 3.5 | 75% |
| Example 8-7* | 41 | " | " | " | 33 | 15.0 | 3.5 | 73% |
| 1 | Comparison Dye D | 0.05 | " | " | 56 | 14.0 | 3.0 | 65% |
| 2 | Comparison Dye D | 0.1 | " | " | 28 | 11.2 | 2.0 | 55% |
| 3 | Comparison | " | " | $4 \times 10^{-4}$ | 33 | 13.8 | 2.5 | 54% |

TABLE 7-continued

| Sample | Compound of Formula (I) Compound No. | Amount (mol/mol-Ag) | Compound of Formula (VI) Compound No. | Amount (mol/mol-Ag) | Photographic Properties Sensitivity | γ | Quality of White Lettering on Solid Background | UV Transparency After Processing** |
|---|---|---|---|---|---|---|---|---|
| | Dye D | | | | | | | |

*Sample of this Invention
**UV transparency after processing
Transmittance (%) at 360 nm when the unexposed sample was processed and the transmittance was measured by a spectrophotometer

EXAMPLE 10

In Examples 10 to 12, the developer having the following composition was used.

| Developer | |
|---|---|
| Hydroquinone | 50.0 g |
| N-Methyl-p-aminophenol ½ Sulfate | 0.3 g |
| Sodium Hydroxide | 18.0 g |
| 5-Sulfosalicyclic Acid | 55.0 g |
| Potassium Sulfite | 110.0 g |
| Sodium 3-(5-mercaptotetrazole)-benzenesulfonate | 0.2 g |
| Ethylenediaminetetraacetic Acid Disodium Salt | 1.0 g |
| 2-Mercaptobenzimidazole-5-sulfonic Acid | 0.3 g |
| Potassium Bromide | 10.0 g |
| 5-Methylbenzotriazole | 0.4 g |
| n-Butylethanolamine | 15.0 g |
| Sodium Toluenesulfonate | 8.0 g |
| Water to make | 1 liter (pH 11.6) |

An aqueous silver nitrate solution and an aqueous sodium chloride solution containing $5\times10^{-6}$ mole of $(NH_4)_3RhCl_6$ were simultaneously added to an aqueous gelatin solution kept at 40° C. over a period of 15 minutes while keeping the potential at +100 mV to provide a monodisperse emulsion cubic silver halide grains having a mean grain size of 0.15 μm. After removing soluble salts, 4-hydroxy-6-methyl-1,3,3a,7-tetraazaindene and gelatin were added thereto.

(Primitive emulsion)

Then, the compound represented by formula (V) was added to the emulsion as shown in Table 8 below and after adding thereto 30 mg/m² of Nucleation Accelerator (S-1) shown below, 4 mg/m² of Desensitizer (S-2) shown below, $5\times10^{-4}$ mole/mole-Ag of the hydrazine compound of formula (VI-52) of this invention, 100 mg/m² of polyethylene oxide (molecular weight 1000), a polyethyl acrylate latex in an amount of 30% by weight as solids based on gelatin, and a hardening agent, 2-bis(vinylsulfonylacetamido)ethane, the emulsion was coated on a polyethylene terephthalate film support at a silver coverage of 3.6 g/m². The content of gelatin was 1.7 g/m².

(S-1)

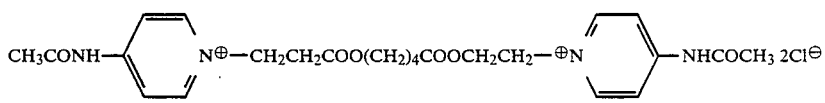

(S-2)

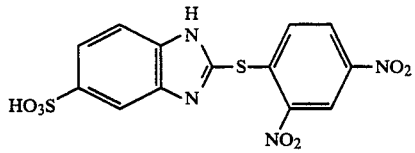

In this case, a protective layer containing 1.5 g/m² of gelatin, 50 mg/m² of polymethyl methacrylate having a mean particle size of 3.0 μm, a hardening agent sodium dodecylbenzenesulfonate, Compound I-19 of formula (I) absorbing ultraviolet light, and yellow compound I-59 of formula (I) was simultaneously formed on the aforesaid layer.

The samples thus obtained were exposed through an optical wedge using a safelight printer P-607 (made by Dainippon Screen Mfg. Co.), developed by the developer for 20 seconds at 38° C., fixed, washed, and dried. (Automatic Processor FG-660F).

Also, these samples were processed in the same manner as above for testing the quality of white lettering on solid background and fog after the irradiation of safelight. The results are shown in Table 8.

As is clear from the results shown in Table 8, Samples 10-3 to 10-5 and 10-9 to 10-11 of this invention were good in the quality, safelight safety, and storage stability.

TABLE 8

| Sample | Compound of Formula (I) Compound No. | Amount (g/m²) | Compound of Formula (V) Compound No. | Amount (mol/mol-Ag) | Photographic Properties Sensitivity | γ | Quality of White Lettering on Solid Background | Fog after Safelight Irradiation | Storage Stability with Passage of Time |
|---|---|---|---|---|---|---|---|---|---|
| 10-1 | — | — | — | — | 100 | 18.0 | 5 | 5.6 | +0.02 |
| 10-2 | I-19 | 0.05 | — | — | 49 | 16.0 | 4 | 0.12 | +0.18 |
| 10-3* | " | " | (V-1) | $(1\times10^{-1})$ | 51 | 15.8 | 4 | 0.14 | +0.03 |
| 10-4* | " | " | (V-1) | $(5\times10^{-1})$ | 55 | 15.9 | 4 | 0.15 | +0.02 |

TABLE 8-continued

| Sample | Compound of Formula (I) Compound No. | Amount ($g/m^2$) | Compound of Formula (V) Compound No. | Amount (mol/mol-Ag) | Photographic Properties Sensitivity | γ | Quality of White Lettering on Solid Background | Fog after Safelight Irradiation | Storage Stability with Passage of Time |
|---|---|---|---|---|---|---|---|---|---|
| 10-5* | " | 0.1 | (V-1) | ($5 \times 10^{-1}$) | 37 | 15.5 | 3.5 | 0.01 | +0.02 |
| 10-6 | Comparison Compound (a) | 0.05 | " | " | 49 | 15.0 | 1.5 | 0.15 | +0.03 |
| 10-7 | Comparison Compound (a) | 0.10 | " | " | 33 | 14.5 | 1 | 0.00 | +0.01 |
| 10-8 | I-59 | " | — | — | 50 | 16.7 | 5 | 0.10 | +0.16 |
| 10-9* | " | " | V-1 | $1 \times 10^{-1}$ | 52 | 16.0 | 4.5 | 0.12 | +0.02 |
| 10-10* | " | " | " | $5 \times 10^{-1}$ | 55 | 16.0 | 4.5 | 0.15 | +0.01 |
| 10-11* | " | " | V-6 | $1 \times 10^{-1}$ | 55 | 16.4 | 4.5 | 0.15 | +0.04 |
| 10-12 | Comparison Compound (b) | 0.10 | — | — | 48 | 15.0 | 1.5 | 0.14 | +0.03 |
| 10-13 | Comparison Compound (b) | " | V-6 | $1 \times 10^{-1}$ | 52 | 15.4 | 1.5 | 0.16 | +0.01 |

*Samples of this Invention

Comparison Compound (a) and (b) (UV); Dye (a) and Dye (b)) shown in the above table were as follows.

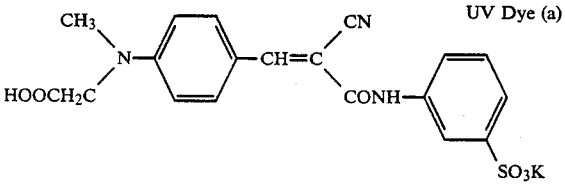

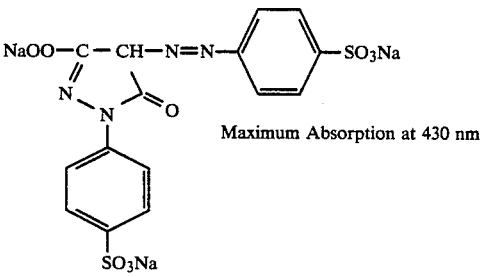

Maximum Absorption at 430 nm

Also, the evaluations shown in Table 8 above are the same as those described in Example 7.

EXAMPLE 11

An aqueous silver nitrate solution and an aqueous sodium chloride solution containing $1 \times 10^{-4}$ mole of $(NH_4)_3RhCl_6$ were simultaneously added to an aqueous gelatin solution kept at 35° C. over a period of 10 minutes while keeping the potential at 200 mV to provide a monodisperse emulsion containing cubic silver chloride grains having a mean grain size of 0.10 μm. After removing soluble salts, 4-hydroxy-6-methyl-1,3,3a,7-tetraazaindene and gelatin were added thereto.

(Primitive emulsion)

The compound of formula (V) was added to the emulsion as shown in Table 9 below and after adding thereto 50 $mg/m^2$ of Nucleation Accelerator (S-1) shown below, 30 $mg/m^2$ of Dye (S-2) shown below, $5 \times 10^{-4}$ mole/mole-Ag of hydrazine compound VI-39, $2 \times 10^{-4}$ mole/mole-Ag of compound VI-1, a polyethyl acrylate latex in an amount of 30% by weight as solids based on gelatin, and a hardening agent, 1,3-divinylsulfonyl-2-propanol, the emulsion was coated on a polyester film support at a silver coverage of 3.8 $g/m^2$. The content of gelatin was 1.8 $g/m^2$.

In this case, a protective layer containing 50 $mg/m^2$ of polymethyl methacrylate having a mean particle size of 3.0 μm, 1.5 $g/m^2$ of gelatin, 6 $mg/m^2$ of thioctic acid, 50 $mg/m^2$ of hydroquinone, a coating aid, sodium dodecylbenzenesulfonate, and fluorine series surface active agent shown by following formula (S-3), and the compound shown by formula (I) as shown in Table 9 below was simultaneously formed thereon.

Each of the samples thus obtained was exposed and processed as in Example 10. The results obtained are shown in Table 9.

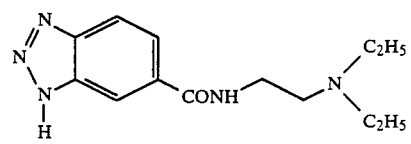

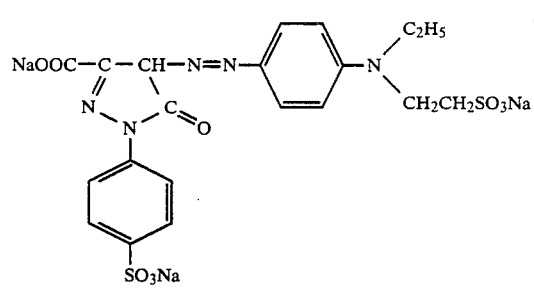

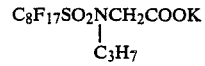

(S-3)

TABLE 9

| Sample | Compound of Formula (I) Compound No. | Amount ($g/m^2$) | Compound of Formula (V) Compound No. | Amount (mol/mol-Ag) | Photographic Properties Sensitivity | γ | Quality of White Lettering on Solid Background | Storage Stability with Passage of Time |
|---|---|---|---|---|---|---|---|---|
| 11-1 | — | — | — | — | 100 | 16.0 | 5 | +0.05 |

TABLE 9-continued

| Sample | Compound of Formula (I) Compound No. | Amount (g/m²) | Compound of Formula (V) Compound No. | Amount (mol/mol-Ag) | Photographic Properties Sensitivity | γ | Quality of White Lettering on Solid Background | Storage Stability with Passage of Time |
|---|---|---|---|---|---|---|---|---|
| 11-2 | I-19 | 0.05 | — | — | 56 | 14.8 | 4 | +0.20 |
| 11-3* | " | " | V-1 | $1 \times 10^{-1}$ | 59 | 15.0 | 4 | +0.05 |
| 11-4* | " | 0.1 | " | " | 40 | 14.6 | 4 | +0.06 |
| 11-5 | I-41 | 0.05 | — | — | 51 | 15.0 | 4 | +0.22 |
| 11-6* | " | " | V-1 | $1 \times 10^{-1}$ | 53 | 15.2 | 4 | +0.06 |
| 11-7* | " | 0.1 | " | " | 38 | 14.8 | 4 | +0.06 |
| 11-8 | Comparison Compound (a) | 0.05 | " | " | 49 | 14.9 | 2 | +0.05 |
| 11-9 | Comparison Compound (a) | 0.1 | " | " | 39 | 13.8 | 1 | +0.06 |

*Samples of this Invention

As is clear from the results shown in Table 9 above, Samples 11-4, 6, and 7 of this invention were good in the quality of white lettering on solid background and the storage stability.

EXAMPLE 12

The emulsion as used in Example 11 and containing the compounds shown in Example 11 was coated on a film support at a silver coverage of 3.6 g/m².

In this case, a protective layer containing gelatin, Surface Active Agents A and B shown below and Mordant C shown below was simultaneously formed on the emulsion layer at the dye coverage as shown in Table 10 below. The coated amounts of gelatin, Surface Active Agents A and B, and Mordant C were 1.0 g/m², 0.02 g/m², 0.07 g/m², and 1.0 g/m², respectively.

The samples using the mordant and Samples 11-4 and 7 prepared in Example 11 were exposed and processed as in Example 11 and the results obtained are shown in Table 10.

-continued

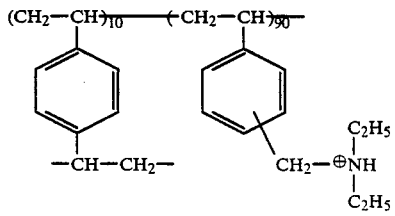

Mordant Agent C

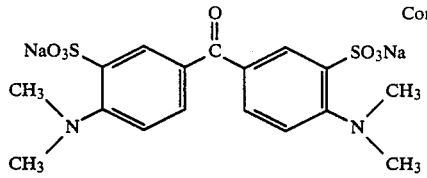

Comparative Dye D

TABLE 10

| Sample | Compound of Formula (I) Compound No. | Amount (g/m²) | Photographic Properties Sensitivity | γ | Quality of White Lettering on Solid Background | UV Transparency After Processing** |
|---|---|---|---|---|---|---|
| Example 11-4* | I-19 | 0.1 | 40 | 14.6 | 4 | 75% |
| Example 11-7* | I-41 | " | 38 | 14.8 | 4 | 73% |
| 12-1 | Comparison Dye D | " | 37 | 14.0 | 2 | 58% |

*Samples of this Invention
**UV transparency after processing
Transmittance (%) at 360 nm when the unexposed sample was processed and the transmittance was measured by a spectrophotometer As is clear from the results shown in Table 10 below, the comparison samples were inferior in the quality of white lettering on solid background and UV transparency as compared to the samples of this invention.

Surfactant A

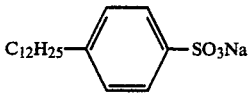

Surfactant B

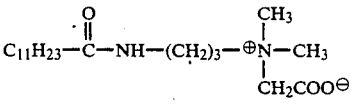

13

When the samples 10-1 to 10-13 in Examples 10 were processed as in Example 10 using the developer having the following composition, the similar results as in Example 10 were obtained.

| Developer | |
|---|---|
| Hydroquinone | 50.0 g |
| 4-Methyl-4-hydroxymethyl-1-phenyl-3-pyrazolidone | 0.2 g |
| Sodium Hydroxide | 18.0 g |
| 5-Sulfosalicyclic Acid | 55.0 g |
| Potassium Sulfite | 110.0 g |
| Ethylenediaminetetraacetic Acid Disodium Salt | 1.0 g |
| Potassium Bromide | 10.0 g |
| 5-Methylbenzotriazole | 0.4 g |
| 2-Mercaptobenzimidazole-5-sulfonic Acid | 0.3 g |
| Sodium 3-(5-mercaptotetrazole)- | 0.2 g |

-continued

| Developer | |
|---|---|
| benzenesulfonate | |
| N-n-butyldiethanolamine | 15.0 g |
| Sodium Toluenesulfonate | 8.0 g |
| Water to make | 1 liter |

pH adjusted to 11.6 with potassium hydroxide.

EXAMPLE 14

In Examples 14 and 15, the developer having the same composition as in Example 7 was used.

An aqueous silver nitrate solution and an aqueous sodium chloride solution containing $1.2\times10^{-4}$ mole/mole-Ag of ammonium hexachlororhodate (III) were simultaneously added to an aqueous gelatin solution kept at 35° C. over a period of 10 minutes while keeping the potential at 200 mV to provide a monodisperse emulsion containing cubic silver chloride grains having a mean grain size of 0.10 μm.

After the formation of grains, soluble salts were removed by flocculation and then 4-hydroxy-6-methyl-1,3,3a,7-tetraazaindene and 1-phenyl-5-mercaptotetrazole were added thereto as stabilizers.

To the emulsion were added $1\times10^{-4}$ mole/mole-Ag of compound VI-1, $1\times10^{-3}$ mole/mole-Ag of hydrazine compound (S-1) shown below, and 50 mg/m$^2$ of compound (S-2) shown below as a nucleation accelerator and after further adding thereto a polyethylene acrylate latex in an amount of 30% by weight as solids based on gelatin and a hardening agent, 2-bis(vinylsulfonylacetamido)-ethane, the emulsion was coated on a polyethylene terephthalate film support at a silver coverage of 3.7 g/m$^2$. Furthermore, a protective layer containing 1.3 g/m$^2$ of gelatin, compound I-69 of formula (I) and a matting agent as shown in Table 11 below, and further a coating aid, sodium dodecylbenzenesulfate, was formed on the emulsion layer.

In addition, the gelatin dispersion of the compound of formula (I) was prepared as follows.

A solution of 18.9 g of the compound of formula (I) dissolved in 25 ml of N,N-dimethylsulfoamide was mixed with 436 g of an aqueous 6.5% by weight gelatin solution containing 13 g of compound (S-3) shown below as a coating aid with stirring to provide the dispersion.

Compound (S-1)

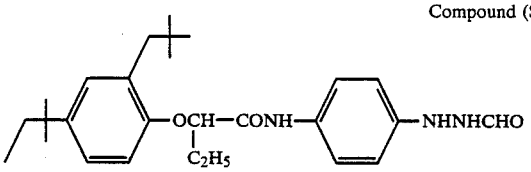

-continued

Compound (S-2)

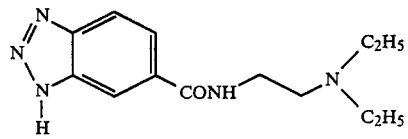

Compound (S-3)

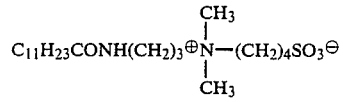

The samples thus obtained were exposed through an optical wedge using a safelight printer P-607 (made by Dainippon Screen Mfg. Co.) and processed for 20 seconds at 38° C. using an automatic processor G-1660G (made by Fuji Photo Film Co., Ltd.). In addition, the relative sensitivity, gamma (γ), and the fogged images after safelight irradiation were determined as follows.

The relative sensitivity, the gamma and the fog after safelight irradiation were similar to those in Example 7.

Evaluation of Image

An original having white lines and black lines of 40 μm in line width was prepared using a photographic film for making printing plates GA-100 (trade name, made by Fuji Photo Film Co., Ltd.).

The white line was a white line portion formed in a solid black portion and the black line was a black line formed on a white background. The line width of the black lines and the white lines was confirmed to be 40 μm at an optical density of 0.6 by scanning the original with a microdensitometer in the line width direction.

The original having the white lines and black lines was contact printed (1:1) on the sample obtained in the example using a safelight printer, P-607 (made by Dainippon Screen Mfg. Co.) and the processed.

The sample thus processed was observed by a microscope (50 magnification) and the smoothness of the edge portions of the black line and the white line formed was evaluated. The evaluation was made by fine grades, grade [5] being the best quality and grade [1]the worst grade. Grades [5] and [4] were practically usable grades, grade [3] was rough but the threshold for practical use. Grades [2] and [1] were not practically usable grades.

The results are shown in Table 11 below together with the number of relatively small black peppers in the white line of each sample in one look.

As is clear from the results shown in Table 11, it can be seen that Samples 14-4 to 14-7 of this invention had good edge smoothness and greatly reduced black pepper in white line portions.

TABLE 11

| | Compound of Formula (I) | | Matting Agent | | | | | | Image Evaluation | |
|---|---|---|---|---|---|---|---|---|---|---|
| Sample No. | Compound No. | Amount (g/m$^2$) | Material | Mean Particle Size (μ) | Amount (mg/m$^2$) | Relative Sensitivity | γ | Fog After Safelight Irradiation | Edge Smoothness | Black Pepper in White Line Portion |
| 14-1 | — | — | Polymethyl Methacrylate (sphere) | 2.5 | 45 | 100 | 16.8 | 4.3 | 5 | 0 |
| 14-2 | I-69 | 0.1 | Polymethyl Methacrylate (sphere) | " | " | 48 | 15.5 | 0.02 | 2 | 20 |
| 14-3 | " | " | Polymethyl | 3.4 | " | " | 15.4 | " | 1 | 25 |

TABLE 11-continued

| Sample No. | Compound of Formula (I) Compound No. | Compound of Formula (I) Amount (g/m²) | Matting Agent Material | Matting Agent Mean Particle Size (μ) | Matting Agent Amount (mg/m²) | Relative Sensitivity | γ | Fog After Safelight Irradiation | Image Evaluation Edge Smoothness | Image Evaluation Black Pepper in White Line Portion |
|---|---|---|---|---|---|---|---|---|---|---|
| | | | Methacrylate (sphere) | | | | | | | |
| 14-4 (This Invention) | " | " | Silicon Dioxide (amorphous) | 2.5 | " | " | 15.7 | " | 5 | 0 |
| 14-5 (This Invention) | " | " | Silicon Dioxide (amorphous) | 3.4 | " | " | 15.6 | " | 5 | 0 |
| 14-6 (This Invention) | " | " | Strontium Barium Sulfate (amorphous) | 2.2 | " | " | 15.5 | " | 5 | 0 |
| 14-7 (This Invention) | " | " | Starch (amorphous) | 3.5 | " | " | 15.6 | " | 5 | 0 |
| 14-8 | Comparison Compound (a)* | 0.1 | Polymethyl Methacrylate (sphere) | 2.5 | 45 | 32 | 11.2 | 0.02 | 4 | 3 |

*

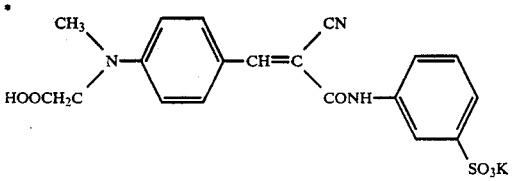

EXAMPLE 15

An aqueous silver nitrate solution and an aqueous sodium chloride solution containing $1\times10^{-5}$ mole/mole of ammonium hexachlororhodate (III) were simultaneously added to an aqueous gelatin solution kept at 40° C. over a period of 10 minutes while keeping the potential at +50 mV to provide a monodisperse emulsion containing cubic silver chloride grains having a mean grain size of 0.22 μm.

After the formation of grains, soluble salts were removed by flocculation as in Example 14, and the compounds used in Example 14 were added to the emulsion as stabilizers.

After adding to the emulsion $1\times10^{-4}$ mole/mole-Ag of compound VI-1, 30 mg/m² of compound (S-4) shown below as a nucleation accelerator, 4 mg/m² of compound (S-5) shown below as a desensitizer, a polyethyl acrylate latex, and a hardening agent, bis(vinylsulfonylmethyl)ether, the emulsion was coated on a polyethylene terephthalate film support at a silver coverage of 3.6 g/m².

(S-4)

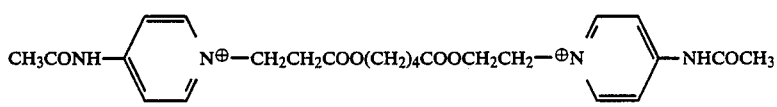

(S-5)

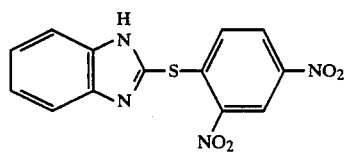

Furthermore, a protective layer containing 1.3 g/m² of gelatin, compounds I-19, I-65, and I-69 of formula (I) absorbing ultraviolet light, and a matting agent as shown in Table 12 was coated on the emulsion layer using the same coating aid as used in Example 14. In addition the dispersion of the compounds of formula (I) was prepared as in Example 14.

These samples thus obtained were evaluated in the same manner as in Example 14 and the results obtained are shown in Table 12 below.

As is clear from the results shown in Table 12, it can be seen that Samples 15-5 to 15-7 and Samples 15-11 to 15-15 of this invention had good edge smoothness, had very little black pepper in black line portions, and thus provided good images.

TABLE 12

| Sample No. | Compound of Formula (I) No. | Compound of Formula (I) Amount (g/m²) | Matting Agent Material | Matting Agent Mean Particle Size (μ) | Matting Agent Amount (mg/m²) | Relative Sensitivity | γ | Fog After Safelight Irradiation | Image Evaluation Edge Smoothness | Image Evaluation Black Pepper in White Line Portion |
|---|---|---|---|---|---|---|---|---|---|---|
| 15-1 | — | — | Polymethyl | 2.5 | 50 | 100 | 18.7 | 5.2 | 5 | 0 |

TABLE 12-continued

| Sample No. | Compound of Formula (I) No. | Compound of Formula (I) Amount (g/m²) | Matting Agent Material | Matting Agent Mean Particle Size (μ) | Matting Agent Amount (mg/m²) | Relative Sensitivity | γ | Fog After Safelight Irradiation | Image Evaluation Edge Smoothness | Image Evaluation Black Pepper in White Line Portion |
|---|---|---|---|---|---|---|---|---|---|---|
| | | | Methacrylate (sphere) | | | | | | | |
| 15-2 | I-19 | 0.1 | Polymethyl Methacrylate (sphere) | " | 12.5 | 26 | 16.0 | 0.02 | 3 | 7 |
| 15-3 | " | " | Polymethyl Methacrylate (sphere) | " | 25 | 25 | " | " | 2 | 20 |
| 15-4 | " | " | Polymethyl Methacrylate (sphere) | " | 50 | 26 | " | " | 1 | 30 |
| 15-5 (This Invention) | " | " | Silicon Dioxide (amorphous) | 2.7 | 12.5 | 26 | 15.8 | " | 5 | 0 |
| 15-6 (This Invention) | " | " | Silicon Dioxide (amorphous) | " | 25 | 26 | 15.9 | " | 5 | 0 |
| 15-7 (This Invention) | " | " | Silicon Dioxide (amorphous) | " | 50 | 25 | 16.0 | " | 5 | 0 |
| 15-8 | I-65 | " | Polymethyl Methacrylate (sphere) | 2.5 | 12.5 | 27 | 16.1 | " | 3 | 8 |
| 15-9 | " | " | Polymethyl Methacrylate (sphere) | " | 25 | 26 | 15.9 | " | 2 | 18 |
| 15-10 | " | " | Polymethyl Methacrylate (sphere) | " | 50 | 25 | 16.0 | " | 1 | 32 |
| 15-11 (This Invention) | I-65 | 0.1 | Silicon Dioxide (amorphous) | 2.7 | 12.5 | 25 | 16.0 | 0.02 | 5 | 0 |
| 15-12 (This Invention) | " | " | Silicon Dioxide (amorphous) | " | 25 | 26 | 15.8 | " | 5 | 0 |
| 15-13 (This Invention) | " | " | Silicon Dioxide (amorphous) | " | 50 | 26 | 15.9 | " | 5 | 0 |
| 15-14 (This Invention) | I-69 | " | Polymethyl Methacrylate (sphere) | 2.5 | 10 | 25 | 15.8 | " | 4 | 3 |
| | | | Silicon Dioxide (amorphous) | 2.7 | 40 | 25 | 15.9 | | | |
| 15-15 (This Invention) | " | " | Polymethyl Methacrylate (sphere) | 2.5 | 20 | 26 | 15.7 | " | 4 | 4 |
| | | | Silicon Dioxide (amorphous) | 2.7 | 30 | 25 | 16.0 | | | |
| 15-16 | Comparison Compound (A)* | " | Polymethyl Methacrylate (sphere) | 2.5 | 50 | 22 | 11.3 | " | 4 | 2 |

*The same as in Table 11

EXAMPLE 16

An aqueous silver nitrate solution and an aqueous sodium chloride solution containing $1\times10^{-5}$ mole/mole of $(NH_4)_3RhCl_6$ were simultaneously added to an aqueous gelatin solution kept at 40° C. over a period of 10 minutes while keeping the potential at +50 mV to provide a monodisperse emulsion containing cubic silver chloride grains having a mean grain size of 0.2 μm. After removing soluble salts, 4-hydroxy-6-methyl-1,3,3a,7-tetraazaindene and gelatin were added thereto.

To the emulsion was added the hydrazine compound as shown in Table 13 below and after adding thereto 30 mg/m² of Nucleation Accelerator (S-1) shown below, 4 mg/m² of Desensitizer (S-2) shown below, 20 mg/m² of Compound (S-3) shown below, a polyethyl acrylate latex in an amount of 30% by weight as solids based on gelatin, and a hardening agent, 2-bis(vinylsulfonylacetamido)ethane, the emulsion was coated on a polyethylene terephthalate film support at a silver coverage of 3.6 g/m². The content of gelatin was 1.7 g/m².

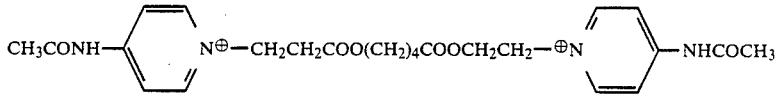

(S-1)

-continued

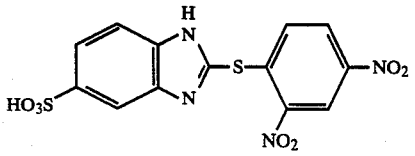

(S-2)

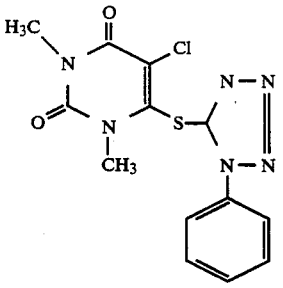

(S-3)

In this case a protective layer containing 1.5 g/m² of gelatin, 50 mg/m² of polymethyl methacrylate having a mean particle size of 2.0 μm, 6 mg/m² of thioctoic acid, 50 mg/m² of hydroquinone, and a coating aid, sodium dodecylbenzenesulfonate together with compound I-19 of formula (I) absorbing ultraviolet light and compound I-59 of formula (I) as shown in Table 13 was simultaneously formed on the emulsion layer. Thus, Samples (1) to (5) were prepared.

The samples thus obtained were exposed through an optical wedge using a safelight printer P-607 (made by Dainippon screen Mfg. Co.), developed by the developer shown in Table 14 below for 20 seconds at 38° C., fixed, washed and dried. (Automatic Processor FG-660F).

Also, these samples were also processed as above for observing the quality of white lettering on solid background and fog after safelight irradiation. The results are shown in Table 13.

In addition, the evaluation techniques in Table 13 were the same as those described in Example 7.

As is clear from the results of Table 13, the samples of this invention (Test Nos. 4 and 11) were good in image quality and safelight safety.

TABLE 13

| Test No. | Compound of Formula (I) Compound No. | Compound of Formula (I) Amount (mg/m²) | Hydrazine Compound Compound No. | Hydrazine Compound Amount (mol/mol-Ag) | Developer | Photographic Properties Sensitivity | Photographic Properties γ | Quality of White Lettering on Solid Background | Fog After Safelight Irradiation |
|---|---|---|---|---|---|---|---|---|---|
| Sample 1 | | | | | | | | | |
| 1 | — | — | VI-1 | $1 \times 10^{-4}$ | B | 100 | 18.8 | 5 | 5.4 |
| 2 | — | — | " | " | C | 107 | 18.9 | 5 | 5.4 |
| Sample 2 | | | | | | | | | |
| 3 | I-19 | 100 mg | " | " | A | 13 | 7.0 | 1 | 0.00 |
| 4* | " | " | " | " | B | 26 | 17.8 | 5 | 0.01 |
| 5 | " | " | " | " | C | 29 | 15.0 | 3.5 | 0.01 |
| 6 | " | " | " | " | D | 35 | 14.8 | 3 | 0.09 |
| 7 | " | " | " | " | E | 12 | 7.1 | 1 | 0.00 |
| 8 | " | " | — | — | B | 12 | 6.8 | 1 | 0.00 |
| Sample 3 | | | | | | | | | |
| 9 | Comparison Compound (a) | 100 mg | VI-22 | $1 \times 10^{-4}$ | B | 23 | 14.0 | 2 | 0.01 |
| Sample 4 | | | | | | | | | |
| 10 | I-59 | " | " | " | A | 26 | 6.8 | 1 | 0.00 |
| 11* | " | " | " | " | B | 51 | 18.6 | 5 | 0.05 |
| 12 | " | " | " | " | C | 54 | 15.3 | 3.5 | 0.04 |
| 13 | " | " | " | " | D | 58 | 14.0 | 3 | 0.15 |
| 14 | " | " | " | " | E | 25 | 7.7 | 1.5 | 0.00 |
| Sample 5 | | | | | | | | | |
| 15 | Comparison Compound (b) | " | " | " | B | 48 | 15.8 | 1.5 | 0.00 |

*This Invention

In Table 13, Comparison Compounds (a) and (b) (YV Dye (a) and Dye (b)) were as follows.

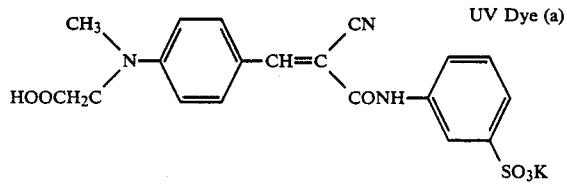

UV Dye (a)

-continued

Dye (b)

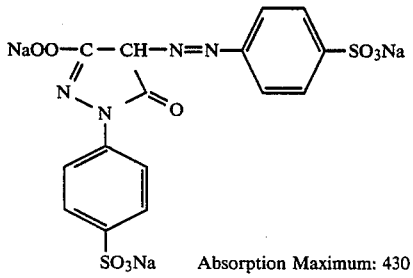

Absorption Maximum: 430 nm polyester film support at a silver coverage of 3.8 g/m$^2$. The content of gelatin was 1.9 g/m$^2$.

(S-1)

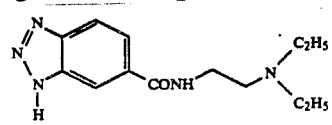

(S-2)

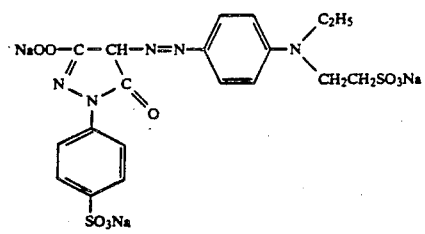

TABLE 14

| | Developer A | Developer B | Developer C | Developer D | Developer E |
|---|---|---|---|---|---|
| Tetrasodium Ethylenediamine-tetraacetic Acid | 2.0 g | 2.0 g | 2.0 g | 2.0 g | 2.0 g |
| Potassium Bromide | 2.0 g | 2.0 g | 2.0 g | 2.0 g | 2.0 g |
| Potassium Hydroxide | 8.0 g | 20.0 g | 20.0 g | 20.0 g | 8.0 g |
| Potassium Carbonate | 35.0 g | 35.0 g | 35.0 g | 35.0 g | 35.0 g |
| Potassium Sulfite | 80.0 g | 80.0 g | 80.0 g | 80.0 g | 80.0 g |
| 1-Phenyl-3-pyrazolidone | 0.2 g | — | 0.2 g | — | — |
| Hydroquinone | 20.0 g | 20.0 g | 20.0 g | 20.0 g | 20.0 g |
| Triethylene Glycol | 30.0 g | 30.0 g | 30.0 g | 30.0 g | 30.0 g |
| Polyethylene Glycol (mol. wt. 3,000) | 2.0 g | 2.0 g | 2.0 g | 2.0 g | 2.0 g |
| 5-Nitroindazole | 0.1 g | 0.1 | 0.1 | — | 0.1 g |
| 5-Methylbenzotriazole | 0.1 g | 0.1 g | 0.1 g | 0.1 g | 0.1 g |
| Water to make | 1 l | 1 l | 1 l | 1 l | 1 l |
| pH adjusted with NaOH to | 10.5 | 11.6 | 11.6 | 11.6 | 10.6 |

EXAMPLE 17

An aqueous silver nitrate solution and an aqueous sodium chloride solution containing $1\times10^{-4}$ mole/mole-Ag of $(NH_4)_3RhCl_6$ were simultaneously added to an aqueous gelatin solution kept at 35° C. over a period of 10 minutes while keeping the potential at 200 mV to provide a monodisperse emulsion containing cubic silver chloride grains having a mean grain size of 0.08 μm. After removing soluble salts, 4-hydroxy-6-methyl-1,3,3a,7-tetraazaindene and gelatin were added. (Primitive emulsion)

To the emulsion were added the hydrazine compound as shown in Table 15 and $5\times10^{-4}$ mole/mole-Ag of the hydrazine compound VI-39 and then after adding thereto 50 mg/m$^2$ of Nucleation Accelerator (S-1) shown below, 30 mg/m$^2$ of Dye (S-2) shown below, 10 mg/m$^2$ of 1-phenyl-5-mercaptotetrazole, a polyethyl acrylate latex in an amount of 30% by weight as solids based on gelatin, and a hardening agent, 1,3-divinyl-sulfonyl-2-propanol, the emulsion was coated on a In this case a protective layer containing 1.5 g/m$^2$ of gelatin, 50 mg/m$^2$ of polymethyl methacrylate having a mean particle size of 3.0 μm, sodium dodecylbenzenesulfonate as a coating aid, and the compound of formula (I) of the present invention shown in Table 15 were simultaneously formed on the emulsion layer. Thus, Samples 6 to 9 were prepared.

The samples were exposed and processed as in Example 16. The results obtained are shown in Table 15 below.

As is clear from the results shown in Table 15, the samples of this invention (Test Nos. 4 and 7) were good in the quality of white lettering on solid background and the safelight safety.

TABLE 15

| | Compound of Formula (I) | | Hydrazine COMPOUND | | | Photographic Properties | | Quality of White Lettering on Solid Background | Fog After Safelight Irradiation |
|---|---|---|---|---|---|---|---|---|---|
| Test No. | Kind | Amount (mg/m$^2$) | No. | Compound Amount (mol/mol-Ag) | Developer | Sensitivity | γ | | |
| Sample 6 | | | | | | | | | |
| 1 | — | — | VI-22 | $2.5\times10^{-4}$ | B | 100 | 18.2 | 5 | 5.8 |
| 2 | — | — | " | " | C | 105 | 18.0 | 5 | 5.9 |
| 3 | — | — | " | " | D | 107 | 17.6 | 5 | 5.8 |
| Sample 7 | | | | | | | | | |
| 4* | I-19 | 75 mg | " | " | B | 35 | 17.6 | 5 | 0.01 |
| 5 | " | " | " | " | C | 37 | 13.8 | 3.5 | 0.02 |
| 6 | " | " | " | " | D | 40 | 13.0 | 3 | 0.07 |
| Sample 8 | | | | | | | | | |
| 7* | I-50 | " | " | " | B | 33 | 17.4 | 5 | 0.01 |
| 8 | " | " | " | " | C | 36 | 14.0 | 3.5 | 0.03 |

TABLE 15-continued

| Test No. | Compound of Formula (I) Kind | Amount (mg/m²) | Hydrazine COMPOUND No. | Compound Amount (mol/mol-Ag) | Developer | Photographic Properties Sensitivity | γ | Quality of White Lettering on Solid Background | Fog After Safelight Irradiation |
|---|---|---|---|---|---|---|---|---|---|
| 9 | " | " | " | " | D | 41 | 12.8 | 3 | 0.10 |
| Sample 9 | | | | | | | | | |
| 10 | Comparison Compound (a)** | 75 mg | VI-22 | $2.5 \times 10^{-4}$ | B | 33 | 14.8 | 1.5 | 0.02 |
| 11 | Comparison Compound (a)** | " | " | $5 \times 10^{-4}$ | " | 35 | 16.8 | 2 | 0.03 |

*This Invention
**The same as in Table 13

EXAMPLE 18

After adding to the emulsion used in Example 17 the additives in Example 17 and compound VI-1 of this invention ($5\times10^{-3}$ mole/mole-Ag), the emulsion was coated on film at a silver coverage of 3.6 g/m².

In this case a protective layer containing gelatin, Surface Active Agents A and B shown below, Mordant C shown below and Dye Compound D shown below was simultaneously formed on the emulsion layer. Thus, Samples 10 to 12 were prepared. The coated amounts of gelatin, Surface Active Agents A and B, and the mordant were 1.0 g/m², 0.02 g/m², 0.07 g/m², and 1.0 g/m², respectively.

Surface Active Agent A

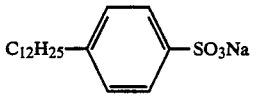

Surface Active Agent B

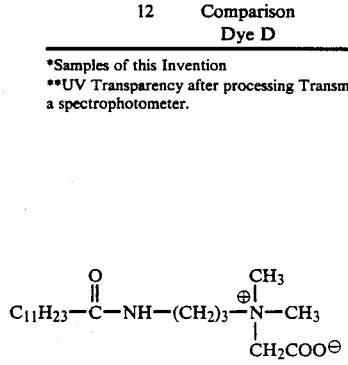

Mordant C

-continued

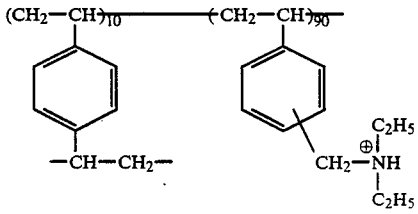

Dye Compound D (Comparison Dye D)

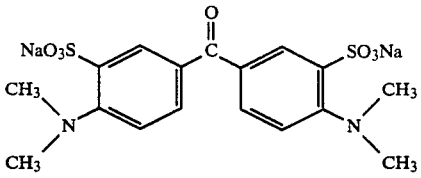

The samples using the mordant and Samples 7 and 8 prepared in Example 17 were exposed and processed using Developer B as in Example 17. The results obtained are shown in Table 16 below.

TABLE 16

| Sample | Compound of Formula (I) Compound No. | Amount (mg/m²) | Hydrazine Compound No. | Amount (mol/mol-Ag) | Photographic Properties Sensitivity | γ | Quality of White Lettering on Solid Background | UV Transparency After Processing** |
|---|---|---|---|---|---|---|---|---|
| Example 17-7* | I-19 | 75 | VI-22 | $2.5 \times 10^{-4}$ | 35 | 17.6 | 5 | 75% |
| 8* | I-50 | " | " | " | 33 | 17.4 | 5 | 74% |
| 10 | Comparison Dye D | 50 | " | " | 54 | 17.0 | 3.0 | 65% |
| 11 | Comparison Dye D | 100 | " | " | 29 | 16.5 | 2.5 | 55% |
| 12 | Comparison Dye D | " | " | $4 \times 10^{-4}$ | 33 | 17.3 | 3.0 | 54% |

*Samples of this Invention
**UV Transparency after processing Transmittance (%) at 360 nm when the unexposed sample was processed and the transmittance was measured by a spectrophotometer.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer, and containing in the silver halide emulsion layer or another hydrophilic colloid layer (i) a compound represented by formula (I)

$$PWR\text{-}(Time)_t\text{-}LA \quad (I)$$

wherein PWR represents a group capable of releasing $$(Time)_t\text{-}LA$$

upon being reduced; Time represents a group capable of releasing LA after being released from PWR, t is 0 or 1; and LA represents a group having an absorption maximum in the wavelength region longer than 310 nm, (ii) a hydrazine derivative, and (iii) at least one compound represented by formulae (IX) and (X)

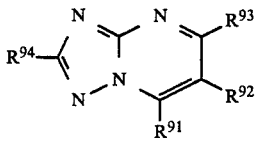

(IX)

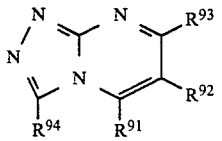

(X)

wherein $R^{91}$, $R^{92}$, $R^{93}$, and $R^{94}$, which may be the same or different, each represents hydrogen, an alkyl group, an aryl group, an amino group, a hydroxyl group, an alkoxy group, an alkylthio group, a carbamoyl group, a halogen atom, a cyano group, a carboxyl group, an alkoxycarbonyl group or a heterocyclic group and $R^{91}$ and $R^{92}$ or $R^{92}$ and $R^{93}$ may be linked to form a 5- or 6-membered ring; provided that at least one of $R^{91}$ and $R^{93}$ represents a hydroxyl group.

2. A silver halide photographic material as claimed in claim 1, wherein the compound (i) is a compound represented by formula (III)

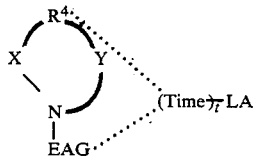

(III)

wherein $(Time)_tLA$ is bonded to at least one of $R^4$ and EAG, X represents —O—, —S—, or a group —N($R^3$)— in which $R^3$ represents an alkyl group, an aryl group, a heterocyclic group, an acyl group or a sulfonyl group, Y represents a divalent linking group, $R^4$ represents an atomic group necessary for forming a 5- to 8-membered monocyclic or condensed heterocyclic ring in combination with X, Y and N, and EAG is a group capable of receiving electron from a reducing material.

3. A silver halide photographic material as claimed in claim 1, wherein the compound (i) is contained in an amount of from about $1.0\times10^{-3}$ g/m$^2$ to about 3.0 g/m$^2$.

4. A silver halide photographic material as claimed in claim 1, wherein the hydrazine derivative (ii) is a compound represented by formula (VIa):

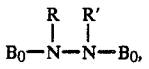

(VIa)

wherein $B_0$ represents an aliphatic group or an aromatic group; $B_{0'}$ represents a formyl group, an acyl group, an alkyl- or aryl-sulfonyl group, an alkyl- or aryl-sulfinyl group, a carbamoyl group, an alkoxy- or aryloxy-carbonyl group, a sulfinamoyl group, an alkoxysulfonyl group, a thioacyl group, a thiocarbamoyl group, a sulfamoyl group, a carbamoylcarbonyl group, an oxycarboxylcarbonyl group, a heterocyclic group,

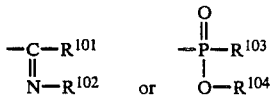

wherein $R^{101}$, $R^{102}$, $R^{103}$ and $R^{104}$ each represents hydrogen, an alkyl group, an aryl group, an alkoxy group, an aryloxy group, an amino group, a carbamoyl group, or an oxycarbonyl group; R and R′ are both hydrogen atoms, or one of them is a hydrogen atom and the group, a substituted or unsubstituted arylsulfonyl group or a substituted or unsubstituted acyl group; provided that $B_{0'}$, and R′ and the adjacent nitrogen atom may form a hydrazone partial structure of

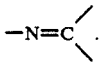

5. A silver halide photographic material as claimed in claim 4, wherein the hydrazine derivative (ii) is a compound represented by formula (VIb):

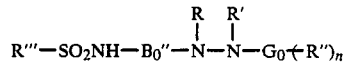

(VIb)

wherein $G_0$ represents a carbonyl group, a sulfonyl group, a sulfoxy group, a phosphoryl group, or an N-substituted or unsubstituted iminomethylene group, R″ represents hydrogen, an alkyl group, an aryl group, an alkoxy group, an aryloxy group, an amino group, a carbamoyl group, or an oxycarbonyl group, $B_0''$ represents a phenylene group or a naphthylene group, R‴ represents an aliphatic group, an aromatic group, or a heterocyclic group, and n is 1, or 2, provided that at least one of R″, R‴ and $B_0''$ has a ballast group or an absorption acceleration group for silver halide.

6. A silver halide photographic material as claimed in claim 1, wherein the hydrazine derivative (ii) is a compound represented by formula (VIc):

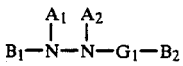

(VIc)

wherein $A_1$ and $A_2$, which may be the same or different, each represents hydrogen or one of them represents hydrogen and the other represents a sulfinic acid group or an acyl group; $B_1$ represents an aliphatic group, an aromatic group or a heterocyclic group; $B_2$ represents hydrogen, an alkyl group, an aryl group, an alkoxy group, an aryloxy group, or an amino group; and $G_1$ represents a carbonyl group, a sulfonyl group, a sulfoxy group, a phosphoryl group or an iminomethylene group, at least one of $B_1$ and $B_2$ contains an adsorption acceleration group for silver halide.

7. A silver halide photographic material as claimed in claim 1, wherein the hydrazine derivative (ii) is contained in an amount of from $1\times10^{-6}$ to $1\times10^{-1}$ mole per mole of silver in all silver halide emulsion layers of the silver halide photographic material.

8. A silver halide photographic material as claimed in claim 1, wherein the compound (iii) represented by formula (IX) to (X) is contained in an amount of from $10^{-5}$ to $3\times10^{-1}$ mole per mole of silver in all silver halide emulsion layers of the silver halide photographic material.

9. A silver halide photographic material as claimed in claim 1, wherein the silver halide emulsion layer or another hydrophilic colloid layer contains an amphoteric surface active agent.

10. A silver halide photographic material as claimed in claim 9, wherein the amphoteric surface active agent is an anion-cation type compound selected from a carboxybetaine type compound, a sulfobetaine type compound, a sulfuric acid ester type compound, a phosphoric acid ester type compound, an amino acid type compound and an aminosulfonic acid type compound.

11. A silver halide photographic material as claimed in claim 9, wherein the amphoteric surface active agent is a compound represented by formula (IV):

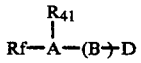

(IV)

wherein Rf represents an alkyl group, an alkenyl group or an aralkyl group, each substituted with at least one fluorine atom and containing from 1 to 18 carbon atoms; $R^{41}$ represents hydrogen or a substituted or unsubstituted saturated or unsaturated hydrocarbon group containing from 1 to 18 carbon atoms; A represents a trivalent linkage group; B represents a divalent linkage group; and D represents a betaine group.

12. A silver halide photographic material as claimed in claim 9, wherein the amphoteric surface active agent is contained in an amount of from 1/20 to 10 times by weight the amount of the compound (i).

13. A silver halide photographic material as claimed in claim 1, wherein the silver halide emulsion layer or another hydrophilic colloid layer contains a 3-pyrazolidone compound.

14. A silver halide photographic material as claimed in claim 13, wherein the 3-pyrazolidone compound is a compound represented by formula (V):

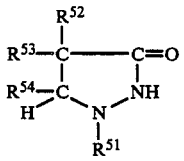

(V)

wherein $R^{51}$ represents a substituted or unsubstituted aryl group; and $R^{52}$, $R^{53}$, and $R^{54}$, which may be the same or different, each represents hydrogen or a substituted or unsubstituted alkyl group.

15. A silver halide photographic material as claimed in claim 1, wherein the compound (i) is contained in a light-insensitive hydrophilic colloidal protective layer together with a matting agent.

16. A silver halide photographic material as claimed in claim 15, wherein the matting agent is an amorphous matting agent having a mean particle size of from 0.1 to 20 μm.

17. A silver halide photographic material as claimed in claim 16, wherein the matting agent is selected from the group consisting of silicon dioxide, titanium dioxide, magnesium oxide, aluminum oxide, calcium carbonate, barium sulfate, strontium sulfate, colloidal manganese, zinc dust, starch, desensitized silver halide, and synthetic silica.

18. A silver halide photographic material as claimed in claim 17, wherein the matting agent is contained in an amount of from 10 to 400 mg/m$^2$.

* * * * *